US010513377B2

(12) United States Patent
Lenz et al.

(10) Patent No.: US 10,513,377 B2
(45) Date of Patent: Dec. 24, 2019

(54) CLOSURE FOR A CONTAINER AND UTENSIL THEREFOR

(71) Applicant: AptarGroup, Inc., Crystal Lake, IL (US)

(72) Inventors: Franz Lenz, Hinterschmiding (DE); Nils Deringer, Freyung (DE); Timothy Mazurkiewicz, Waukesha, WI (US)

(73) Assignee: APTARGROUP, iNC, Crystal Lake, IL (US)

( * ) Notice: Subject to any disclaimer, the term of this patent is extended or adjusted under 35 U.S.C. 154(b) by 119 days.

(21) Appl. No.: 15/326,151

(22) PCT Filed: Aug. 6, 2015

(86) PCT No.: PCT/US2015/043906

§ 371 (c)(1),
(2) Date: Jan. 13, 2017

(87) PCT Pub. No.: WO2016/022744

PCT Pub. Date: Feb. 11, 2016

(65) Prior Publication Data

US 2017/0203890 A1 Jul. 20, 2017

Related U.S. Application Data

(60) Provisional application No. 62/034,253, filed on Aug. 7, 2014.

(51) Int. Cl.
*B65D 51/24* (2006.01)
*B65D 43/16* (2006.01)
(Continued)

(52) U.S. Cl.
CPC ..... *B65D 51/246* (2013.01); *B65D 41/465* (2013.01); *B65D 43/162* (2013.01);
(Continued)

(58) Field of Classification Search
CPC .... B65D 51/246; B65D 41/465; B65D 43/22; B65D 51/26; B65D 43/162;
(Continued)

(56) References Cited

U.S. PATENT DOCUMENTS 5,706,974 A * 1/1998 Murdick ..... B65D 51/246 206/230
8,302,805 B2 11/2012 Blomdahl et al.
(Continued)

OTHER PUBLICATIONS

The "International Search Report and the Written Opinion of the International Searching Authority, or the Declaration" dated "Jan. 4, 2016" for the International Application No. PCT/US2015/043906 of which the above-captioned instant U.S. patent application Serial No. (not yet designated) is a U.S. national phase application.

*Primary Examiner* — James N Smalley
(74) *Attorney, Agent, or Firm* — Wood, Phillips, Katz, Clark & Mortimer

(57) ABSTRACT

A closure (100, 100A, 100B, 100C, 100D, 100F, 100G, 100H, 100I) having a base (112, 112A, 112B, 112C, 112D, 112F, 112G, 112H, 112I), a lid (116, 116A, 116B, 116D, 116F, 116I), and a utensil (124, 124A, 124B, 124E, 124F, 124G, 124I) is provided for a container (104). One of the base (112, 112A, 112B, 112C, 112D, 112F, 112G, 112H, 112I) and the lid (116, 116A, 116B, 116D, 116F, 116I) includes a raised platform region (198, 198A) for releasably holding the utensil (124, 124A, 124B, 124E, 124F, 124G, 124I) and includes a recessed region (194, 194A) such that a handle portion (172, 172B, 172E, 172F, 172G, 172I) of the utensil (124, 124A, 124B, 124E, 124F, 124G, 124I) projects beyond the platform region (198, 198A) over the recessed region (194, 194A).

2 Claims, 77 Drawing Sheets

(51) Int. Cl.
*B65D 43/22* (2006.01)
*B65D 51/26* (2006.01)
*B65D 41/46* (2006.01)

(52) U.S. Cl.
CPC ..... *B65D 43/22* (2013.01); *B65D 51/26* (2013.01); *B65D 2101/0038* (2013.01); *B65D 2101/0076* (2013.01); *B65D 2543/00222* (2013.01)

(58) Field of Classification Search
CPC .. B65D 2101/0038; B65D 2543/00222; B65D 2101/0076
USPC ..... 220/254.3, 574.1
See application file for complete search history.

(56) References Cited

U.S. PATENT DOCUMENTS

| | | | | |
|---|---|---|---|---|
| 8,376,179 | B2 | 2/2013 | Horton et al. | |
| 8,567,629 | B2 | 10/2013 | VanDamme et al. | |
| 8,651,311 | B1 | 2/2014 | Drummond et al. | |
| 8,770,423 | B2 | 7/2014 | McGeough | |
| 2006/0000840 | A1* | 1/2006 | Kipperman | A61J 9/00 220/735 |
| 2010/0051631 | A1* | 3/2010 | Blomdahl | B65D 51/246 220/735 |
| 2011/0192847 | A1* | 8/2011 | Vandamme | B65D 43/169 220/315 |
| 2013/0001227 | A1* | 1/2013 | Groubert | B65D 47/0828 220/212 |
| 2015/0129597 | A1* | 5/2015 | McBroom | B65D 43/169 220/324 |

* cited by examiner

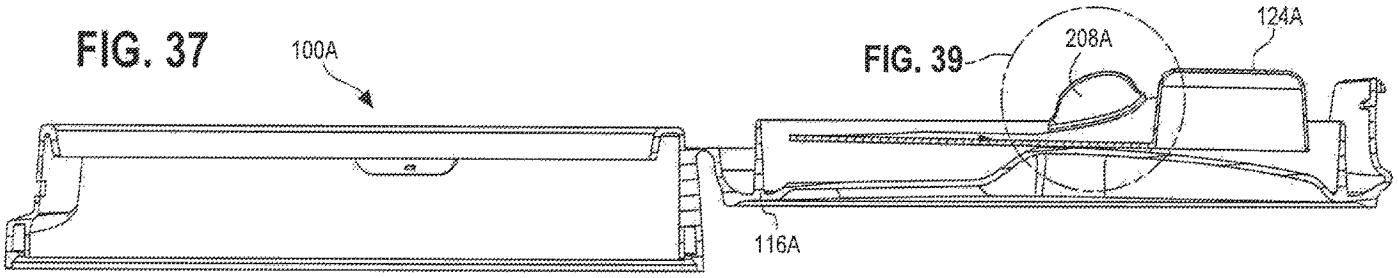
FIG. 37
FIG. 39
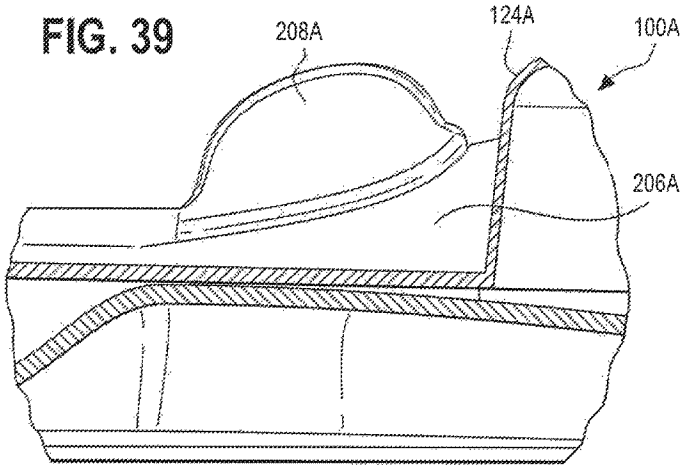
FIG. 39
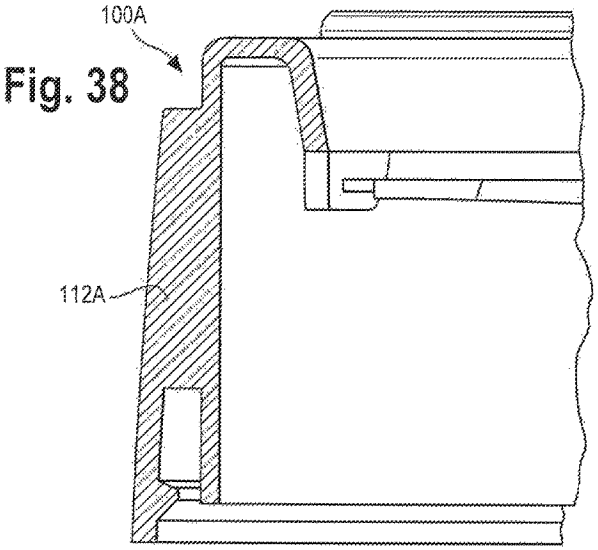
Fig. 38

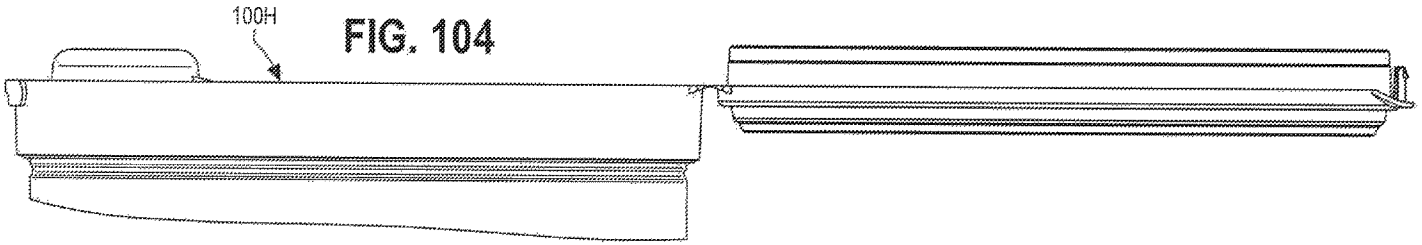
FIG. 104
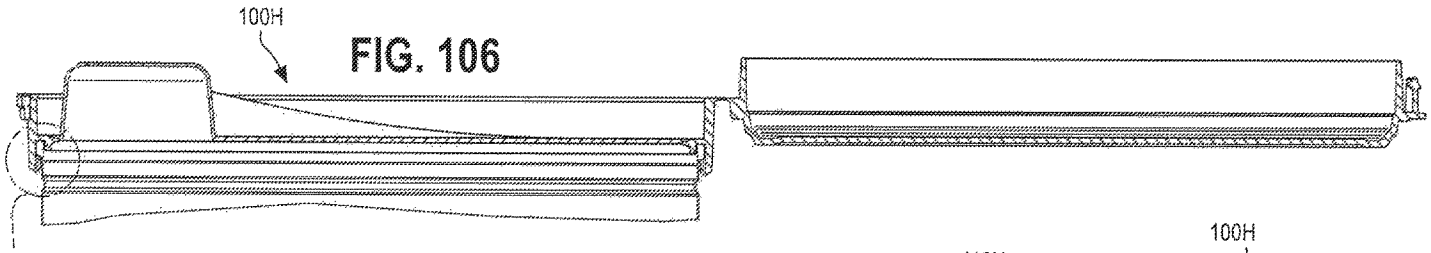
FIG. 106
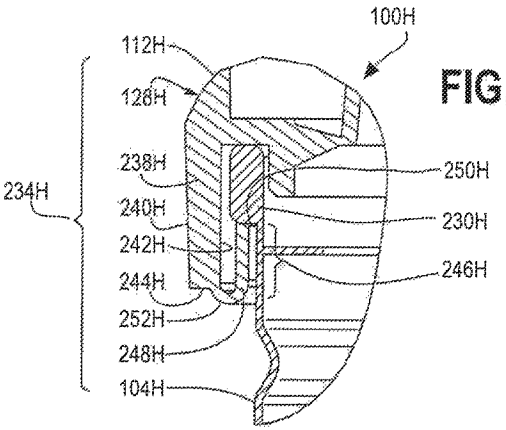
FIG. 107
FIG. 103

CLOSURE FOR A CONTAINER AND UTENSIL THEREFOR

CROSS-REFERENCE TO RELATED APPLICATION(S)

Not Applicable.

STATEMENT REGARDING FEDERALLY SPONSORED RESEARCH OR DEVELOPMENT

Not applicable.

REFERENCE TO A MICROFICHE APPENDIX

Not applicable.

TECHNICAL FIELD

This invention relates to a closure for a container and to a utensil that can be used with a container.

BACKGROUND OF THE INVENTION AND TECHNICAL PROBLEMS POSED BY THE PRIOR ART

There are a variety of types of closures for containers. One type of closure includes a body for being attached to the top of a container. The closure, container, and product within the container are referred to as a "package". Such a closure can be molded or otherwise manufactured from a suitable material (e.g., a thermoplastic material). Such a closure typically has a hollow body (which may be alternatively described as the closure base or base portion) that, when installed on the open end of a container, defines an opening to the container interior. Such a closure typically also includes a lid (which may or may not be hingedly mounted on the closure base) which can be lifted up to expose the container mouth (i.e., the opening defined by the open end of the container). With some such closures, a liner in the form of a removable membrane is disposed across a lower portion of the closure or across the container to initially seal the contents (i.e., a product) from the ambient environment.

For some types of products, it can be desirable to provide a closure that has a base with a relatively large access passage (e.g., opening) normally covered with a hinged lid that can provide access to the product (such as fluent products, as well as non-fluent products), and that, when opened, can accommodate the insertion of a utensil (e.g., scoop, spoon, knife, ladle, etc.) through the open closure to permit the product to be stirred and/or scooped out of the container with the utensil.

Some containers, especially some types of wide mouth metal and composite containers, have significant manufacturing tolerances with respect to the design dimensions of the container open end that defines the container mouth.

Some such containers, especially some types of metal containers, have a open end that may also have some other type of irregularity that is unintentionally created during manufacturing and/or during subsequent processing (e.g., labeling, storage, shipping, etc.) prior to the closure being installed on the container. For example, during shipping of empty metal containers, one or more of the containers could be subjected to an accidental impact that could create a small irregularity (e.g., a deformation or "dent") in a portion of the container end around the mouth of the container.

The inventors of the present invention have determined that a container which has an open end with significant manufacturing tolerances and/or deformations or other irregularities can pose problems with respect to proper installation of a closure, securement of the closure, sealing of the closure, etc.

The inventors of the present invention have determined that in some applications, the use of a non-removable closure is preferred so as to increase the consumer confidence in the integrity of the package (e.g., by showing evidence of tampering) and to inhibit counterfeiting of the package filled with a substandard product.

The inventors of the present invention have determined that for some applications using some types of container closures, it may also be desirable to provide a latch for securing the lid to the closure base. The inventors of the present invention have more particularly determined that it may also be desirable in some closure applications to provide an improved lid latch retention feature that increases the opening resistance of the lid latch.

The inventors of the present invention have determined that for some types of containers, it may be advantageous to provide a utensil (e.g., spoon, scoop, knife, ladle, etc.) that can be used to stir and/or remove the product from the container after the container closure is opened. For some containers, the utensil might be advantageously initially provided inside the container or closure, or otherwise provided for use along with the container. The inventors of the present invention have determined that for larger containers requiring a longer utensil, it can be advantageous to provide a utensil that (1) has a first, self-maintained, "short" configuration which can accommodate shipping, storing, etc., and (2) has a second, self-maintained "long" configuration which can be deployed for removing the product from a container.

The inventors of the present invention have also determined that it can be advantageous to provide a utensil in the form of a scoop that (1) has a first "storage" configuration wherein the scoop is of reduced height or depth to accommodate shipping, storing, etc., and (2) has a second "use" configuration of the desired operating height or depth for removing a product from a container.

The inventors of the present invention have determined that in some applications it could be advantageous to provide (1) a utensil initially attached to the closure inside the closure so that a user can detach the utensil after initially opening the closure, and (2) means for releasably holding and storing the utensil inside the closure after use so that the utensil can be isolated from the exterior environment but can be readily available for subsequent use.

BRIEF SUMMARY OF THE INVENTION

The inventors of the present invention have discovered how to provide (1) an improved utensil for stirring a product in, or removing a product from, a container, and (2) an improved closure that would be especially suitable for a metal container in addition to non-metal containers, wherein the utensil and closure include novel, advantageous features not heretofore taught or contemplated by the prior art.

One aspect of the present invention includes an improved closure for a container wherein the closure is especially suitable for metal containers, but may be used with non-metallic containers. One form of such an improved closure of the present invention can better accommodate some manufacturing tolerances and/or other irregularities in the top end portion of a container around the mouth of the container.

One form of an improved closure of the invention can include an improved lid latch employing a resilient seal member in the closure for increasing the resistance of the latch to being opened.

One form of the improved closure of the invention can include a utensil initially carried in the closure.

One form of the improved closure of the invention can include means for releasably retaining and storing a utensil in the closure lid or base after the utensil has been used.

One form of the improved closure of the invention can include a combination of two or more of the above-described features relating to (1) the accommodation of manufacturing tolerances or other irregularities of a container, (2) a latch, (3) a tamper-evident feature for a latch, (4) the provision of a utensil initially in the closure, and (5) means for releasably retaining or storing a utensil in the closure after use.

Another aspect of the invention includes a separate utensil for use with a closure and/or container.

One form of the utensil invention can include a utensil having (1) a first, self-maintained, "short" configuration that can accommodate shipping, storing, etc., and (2) a second, self-maintained "long" configuration that can be deployed for stirring a product in, or removing the product from, a container.

Another form of the utensil is a scoop having (1) a "storage" configuration wherein the scoop has a reduced height or depth to accommodate shipping, storing, etc., and (2) a "use" configuration of the desired operating height or depth for removing a product from a container.

Another aspect of the invention includes a utensil integral with, or initially integrally attached to, a closure.

An inventive article of the present invention may include just the closure alone, just the utensil alone, or the closure and utensil together in combination.

The inventive utensil and the inventive closure may each include various features that are discussed and claimed hereinafter and that may be considered to be separate features which may provide utility separately apart from other features. Thus, it is contemplated that the inventive utensil and closure may be designed based on the teachings herein using any, or a variety of, combinations or permutations of any one or more of the separate features without necessarily being in combination with one or more of the other features. Accordingly, the utensil and closure of the present invention, either together or separately, may be claimed as including any combination or permutation of any one or more of the features.

Numerous other advantages and features of the present invention will become readily apparent from the following detailed description of the invention, from the claims, and from the accompanying drawings.

BRIEF DESCRIPTION OF THE DRAWINGS

In the accompanying drawings forming part of the specification, in which like numerals are employed to designate like parts throughout the same.

FIG. 37 is a cross-sectional view of the closure taken along the plane 37-37 in FIG. 36;

FIG. 38 is an enlarged, fragmentary, cross-sectional view of a side portion of the closure of FIG. 34;

FIG. 39 is an enlarged, fragmentary, cross-sectional view of a portion of the closure shown in FIG. 37;

FIG. 45 shows the closure in the as-molded, "open" condition with the lid open prior to the lid being closed and prior to the closed closure being installed on a container;

FIG. 60 shows a latch member of the lid in an unlatched position;

FIG. 83 shows the utensil in a "short," stored, "non-use" configuration;

FIG. 86 shows the utensil as initially provided by a manufacturer in a "non-use" configuration connected to a base of a closure that is installed on a container and that has a lid in an opened position;

FIG. 90 shows the utensil as initially provided by a manufacturer in a "non-use" configuration and connected to a closure base with the closure shown in an open lid position, and with the closure installed on a container to form a package;

FIG. 100 shows the closure in the as-molded, open configuration prior to the closure being installed on a container;

FIG. 104 is a fragmentary, right side elevation view of the open closure shown in FIG. 100, shown installed on a container—the closure and the container (and any product therein) together forming a package;

FIG. 106 is a fragmentary, cross-sectional view of the container and open closure taken along the plane 106-106 in FIG. 105;

FIG. 107 is an enlarged, fragmentary, cross-sectional view of the package shown in FIG. 106;

DESCRIPTION OF THE PREFERRED EMBODIMENTS

Figure 1:
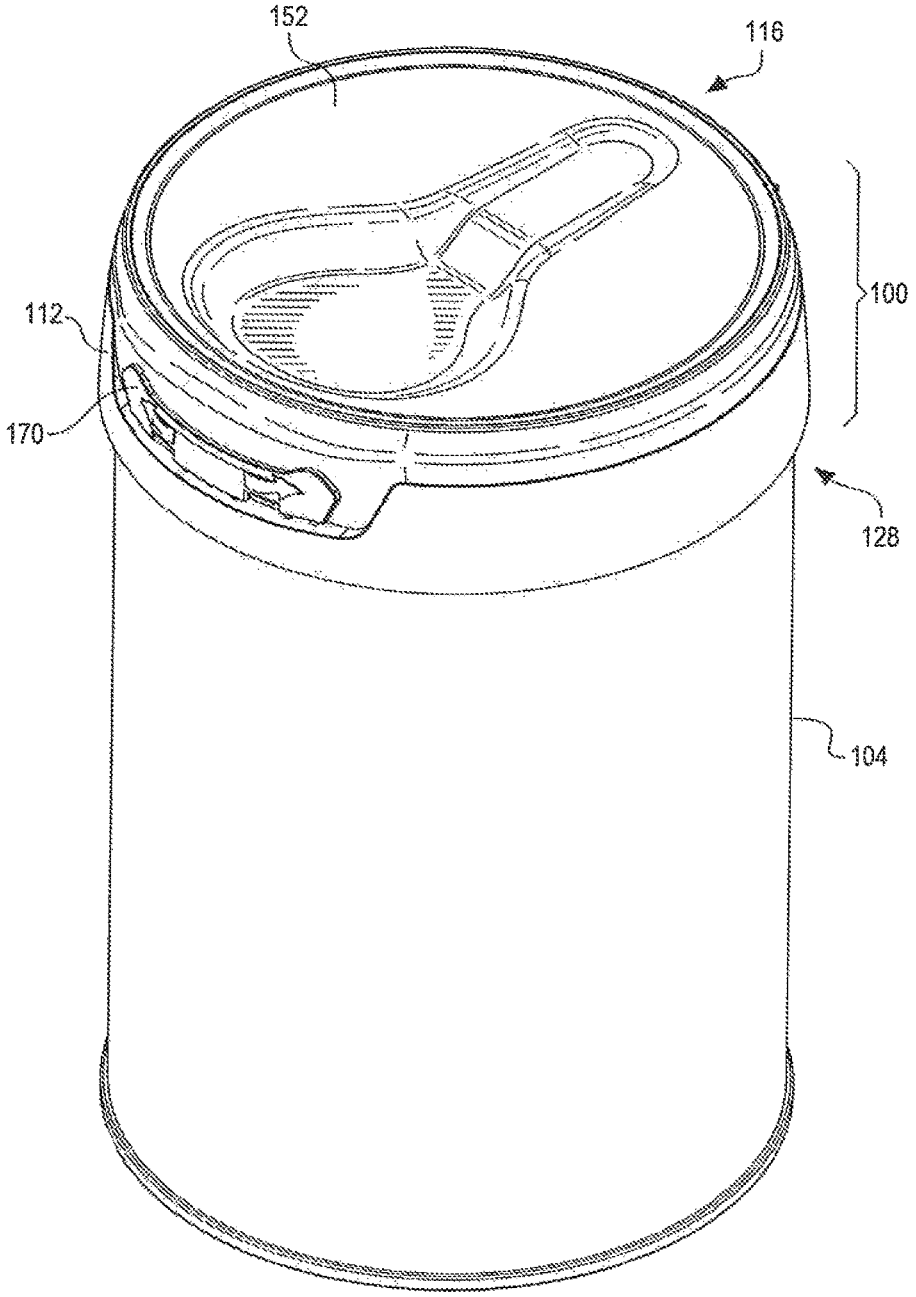
FIG. 1 is a perspective view taken from above of a first embodiment of a closure of the present invention shown in a closed condition installed on a container in which a product may be stored—the closure, container, and product therein together constituting a "package"

While this invention is susceptible of embodiment in many different forms, this specification and the accompanying drawings disclose only specific forms as examples of the invention. The invention is not intended to be limited to the embodiments so described, however.

For ease of description, the closure of this invention is described in a generally upright orientation that it could have at the upper end of a container when the container is stored upright on its bottom or base. It will be understood, however, that the closure of this invention may be manufactured, stored, transported, used, and sold in orientations other than those shown.

The closure of this invention and the utensil of this invention are suitable for use with a variety of conventional or special systems or containers having various designs, the details of which, although not illustrated or described, would be apparent to those having skill in the art and an understanding of such containers. With respect to the illustrated embodiments of the closure and utensil invention described herein, the container, per se, forms no part of, and therefore is not intended to limit, the broadest aspects of the present invention. It will also be understood by those of ordinary skill that novel and non-obvious inventive aspects can be embodied in the described exemplary closures alone and exemplary utensils alone.

One embodiment of a closure of the present invention is illustrated in FIGS. 1-6 where it is designated generally therein by reference number 100. This first embodiment of the closure 100 is initially provided as a separately manufactured article for mounting to the top of a system, such as a container 104.

The container 104 typically has a mouth or opening 108 (FIG. 6) which provides access to the container interior where the contents, such as a product, may be contained. The product may be, for example, infant formula, mayonnaise, nuts, candies, jelly, margarine, paste, pickles, olives, etc., which can be stirred and/or removed from a container with a utensil, such as a scoop, spoon, ladle, knife, spear, etc. The product may also be a more highly fluent material that can be poured, as well as removed with a utensil, such as ground coffee, sugar, or other material, such as liquids, powders, slurries, etc. Such materials may be sold, for example, as a food product, a personal care product, an industrial or household product, or other substance (e.g., for internal or external use by humans or animals, or for use in activities involving medicine, manufacturing, commercial or household maintenance, construction, agriculture, etc.).

The particular illustrated container 104 does not have a reduced size upper end, such as a reduced size neck. However, if desired, the upper end of the container 104 may have a neck or other suitable structure that defines the container mouth 108 and that has a cross-sectional configuration with which the closure 100 is adapted to engage. Below the neck of such a container 104, the body of the container 104 may have another cross-sectional configuration that differs from the cross-sectional configuration of the container mouth 108. On the other hand, as is the case with the illustrated container 104, the container 104 may have a substantially uniform shape along its substantially all of its length or height without a neck portion of any significantly reduced size or significantly different cross-section.

The container 104 may or may not be a squeezable container having a flexible, resilient wall or walls which can be grasped by the user and compressed somewhat (i.e., temporarily, elastically deformed). However, the illustrated embodiment of the closure 100 is especially suitable for use with a container 104 having a cylindrical wall that is not necessarily intended to be temporarily squeezed inwardly by the user.

Figure 5:
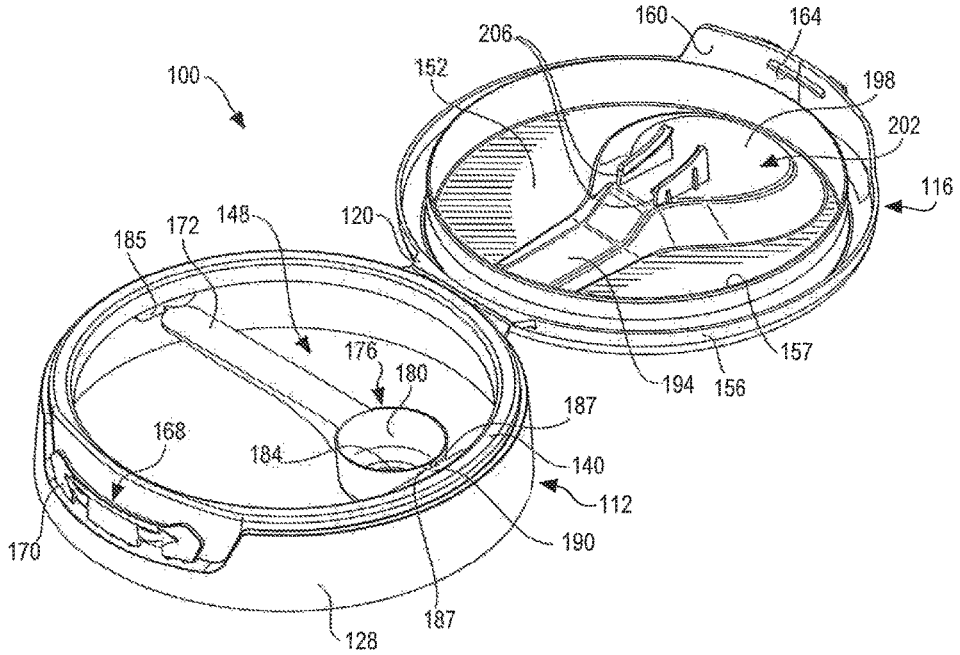
FIG. 5 is a perspective view of only the closure shown in FIG. 1, but in FIG. 5 the closure is shown in the initial, as-molded, "open" condition wherein the lid is open and the utensil is attached at each end to the closure base with a molded, frangible connection.

The closure 100 comprises a base 112 (i.e., a base peripheral wall or other peripheral structure) and a lid 116 (i.e., closing element, top, or cover) joined to the base 112 by a hinge 120 (FIG. 5). In the first embodiment illustrated, the closure base 112, lid 116, and hinge 120 can be readily molded together as a unitary structure in an open condition from a suitable thermoplastic material such as polyethylene, polypropylene or the like. Other materials may be employed instead.

The closure base 112 initially holds a utensil 124, such as, in the first illustrated embodiment of FIGS. 1-6, a scoop, molded unitary with the closure base 112 in a manner that permits the utensil 124 to be subsequently detached from the base 112 by the user.

In the embodiment illustrated in FIGS. 1-6, the closure 100 is initially molded as a completely separate article that is subsequently attached to the container 104 after the container 104 has been initially filled with a product. The closure base 112 has a depending, peripheral, outer skirt 128 with a conventional, internal bead 132 (FIG. 6) for snap-fit engagement with the bottom of a rim flange 136 on the upper end portion of the container 104 so as to secure the closure base 112 to the container 104. Bead 132 could be segmented instead of continuous (not illustrated). Near the upper end of the container 104, the container 104 also has a radially inwardly extending flange 133.

The closure base 112 and container 104, if they have appropriately sized circular configurations, could also be releasably connected together with a screw thread system (not shown), a bead and groove system, or by other means. Alternatively, the closure base 112 may be permanently attached to the container 104 by means of induction bonding, ultrasonic bonding, gluing, or the like, depending upon the materials employed for the container 104 and closure base 112.

The closure base 112 may also include additional special or conventional seal features to provide an enhanced leak-tight seal between the closure base 112 and the container 104. The illustrated snap-fit closure base 112 does not employ such an enhanced seal feature.

With reference to FIG. 5, the closure base 112 has an inwardly extending flange or rim 140 near the top of the base 112. The base 112 has an interior wall 144 (FIG. 6) extending downwardly from the rim 140 and adjacent, but spaced inwardly from, the skirt 128. The interior wall 144 abuts the container flange 133 and interior surface of the container bead 136 when the closure base 112 is secured to the container bead 136 with the closure bead 132.

Figure 6:
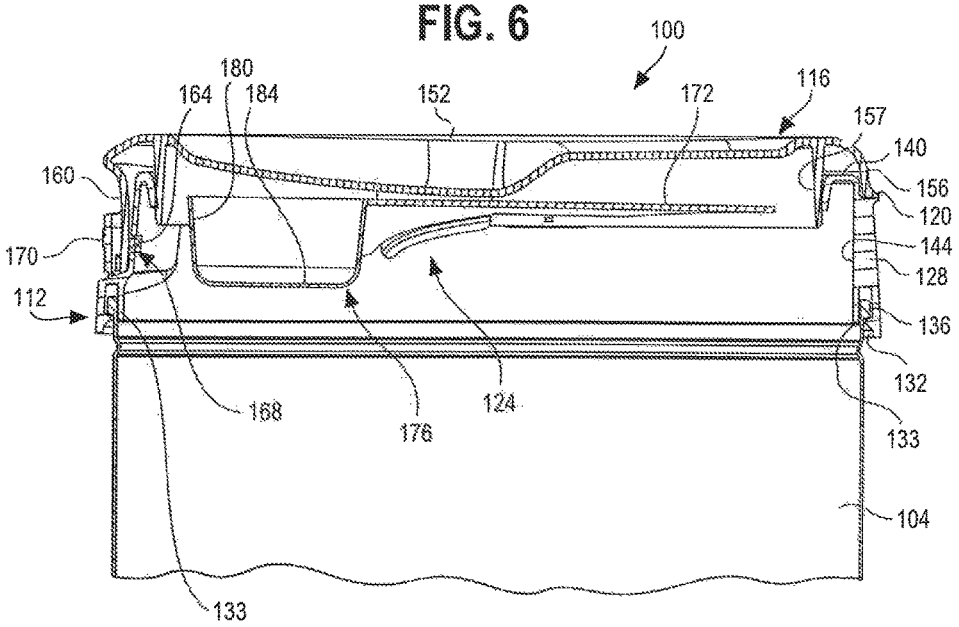
FIG. 6 is a fragmentary, cross-sectional, perspective view of the top portion of the package shown in FIG. 4, but in FIG. 6 the lid (with the utensil retained therein) is shown closed.
Figure 7:
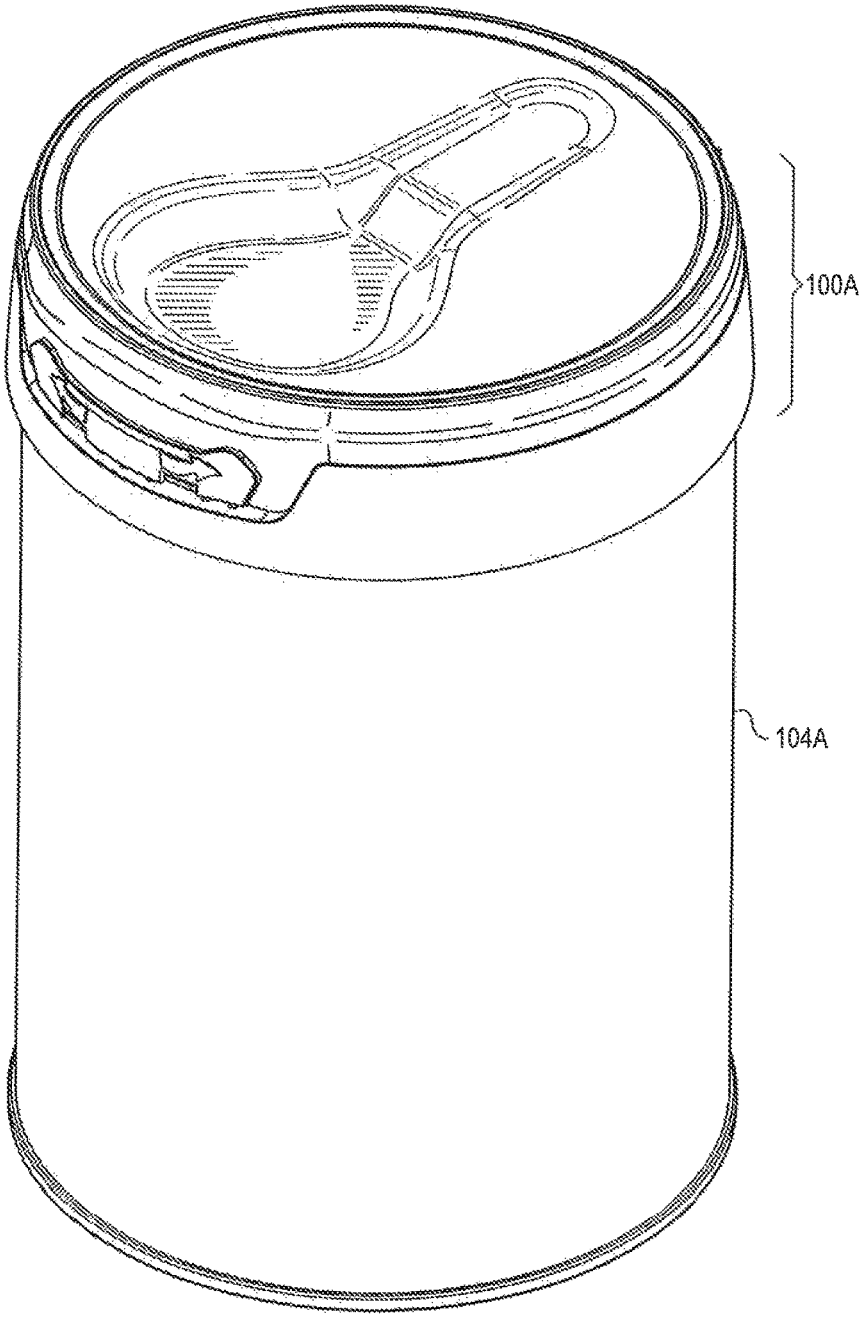
FIG. 7 is a perspective view taken from above of a second embodiment of a closure of the present invention shown in a closed condition installed on a container in which a product may be stored—the closure, container, and product therein together constituting a "package"

The closure base 112 has an opening or access passage 148 (FIG. 5) that is defined by the rim 140 and that can be covered by the lid 116 when the lid 116 is closed. The lid 116 includes a top deck or cover 152 (FIG. 5) substantially surrounded by an outer peripheral flange 156 (FIG. 5). An inner plug seal flange 157 projects from the underside of the deck 152 to sealingly engage the inside of the closure base rim 140 when the lid 116 is closed (FIG. 6).

The closure hinge 120 is molded unitarily together with the closure lid 116 and closure base 112 near the top of the base skirt 128 (FIG. 5) so as to accommodate movement of the lid 116 between the open position exposing the base access passage 148, and the closed position occluding the body access passage 148.

With reference to FIG. 5, the hinge 120 may be of any suitable conventional or special design. For example, the hinge 120 illustrated in the Figures may be of a conventional snap-action type such as described in the U.S. Pat. Nos. 5,356,017 or 5,642,824, the details of which form no part of the present invention. The hinge 120 could also be a non-snap-action type, including a strap or tether. However, preferably, the hinge 120 is molded unitarily with closure base 112 and lid 116.

A resilient latch member 160 projects downwardly at the front of the lid 116 and has an inwardly projecting latch bead 164. As can be seen in FIG. 6, when the lid 116 is closed on the base 112, the laterally inwardly extending lid latch bead 164 snaps into, and is received in, an aperture 168 in the closure base 112 to secure the lid 116 to the base 112. To open the lid 116, the user first removes a tamper-evident band 170 described in detail below, and then the user pulls with a thumb or finger outwardly and upwardly on the bottom of the latch member 160 to disengage the lid latch bead 164 from the aperture 168 in the base 112. Other conventional or special latch designs could be used instead.

Figure 2:
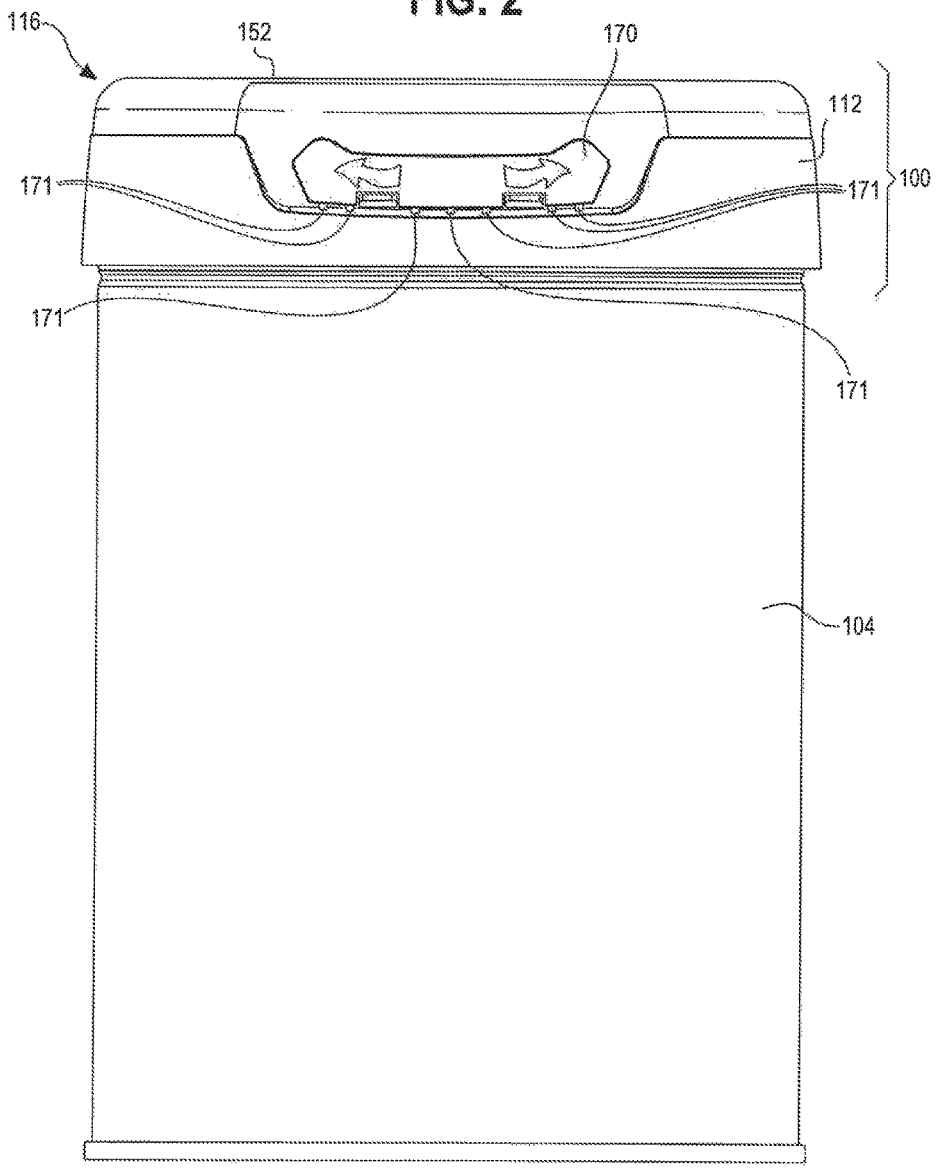
FIG. 2 is a perspective view of the front of the package shown in FIG. 1.
Figure 3:
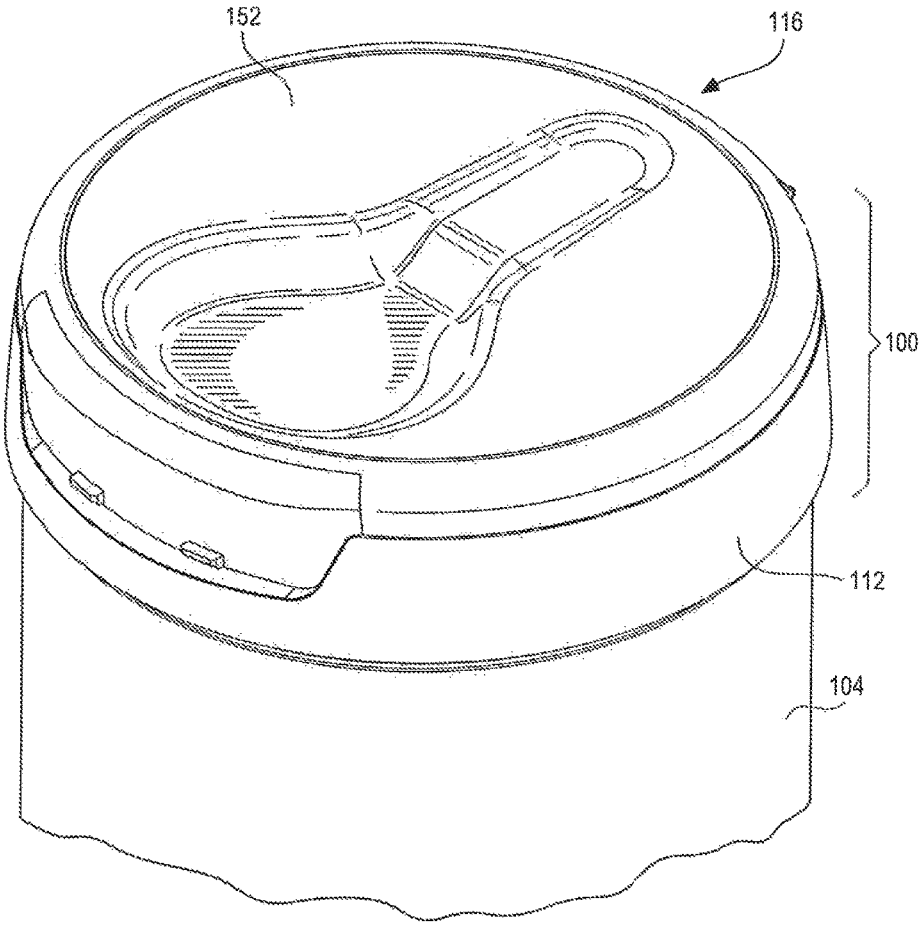
FIG. 3 is a fragmentary, perspective view taken from above the package shown in FIG. 1, but in FIG. 3 only an upper portion of the package is shown, and a tamper-evident member that is visible in FIG. 1 has been removed.
Figure 4:
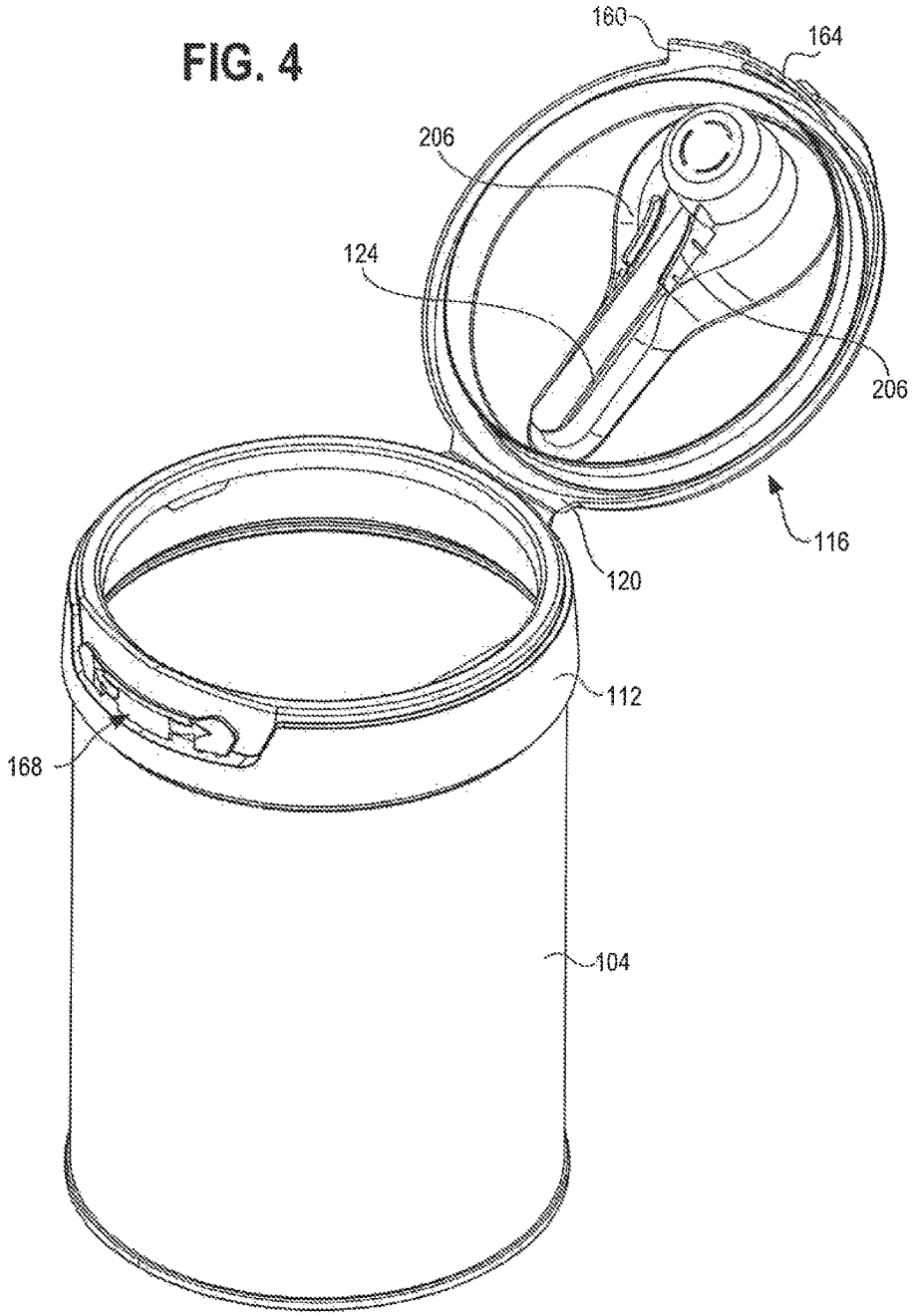
FIG. 4 is a perspective view similar to the perspective view in FIG. 3, but in FIG. 4 the lid of the closure has been moved from a closed position to an open position allowing access to the container interior, and a utensil (that had been attached to the closure base inside the closure as shown in FIG. 5 described below, and that has been separated from the closure base) is shown retained in the opened closure lid.

With reference to FIGS. 1 and 2, the closure 100 has a tamper-evident band or member 170 that extends from, and is frangibly connected to, a portion of the closure skirt 128. The tamper-evident member 170 serves to confront the lid latch member 160 such that the latch member may not move from the closed latch position to the open latch position. The tamper-evident member 170 may be removed from the closure 100 when the frangible connections 171 (best seen in FIG. 2) are broken by a user of the closure 100, as is shown in FIGS. 3 and 4. The tamper-evident member 170 may have indicia for instructing the user of the closure 100 how to separate the tamper-evident member 170 from the closure 100.

In an alternate embodiment (not illustrated), it will be understood that the tamper-evident member 170 may instead be initially connected to the closure lid 116, and the latch member 160 may instead be provided on the closure body 112 rather than on the lid 116. Furthermore, the tamper-evident member 170 need not be frangibly connected to the closure 100, and may be attached to the closure 100 by adhesive, heat shrinking, secondary molding, heat or vibratory welding, or the like. Further, the closure 100 need not have any type tamper-evident member 170.

With reference to FIG. 5, closure 100 further includes a utensil 124, which is initially molded integrally therewith to provide a single, unitary, closure article. Utensil 124 includes handle portion 172 and utility portion 176. In the embodiment illustrated in FIGS. 1-6, utensil 124 is a handled scoop, and utility portion 176 is a scoop portion defining an open-ended receptacle. However, it is understood that other types of utensils could readily be implemented in accordance with other embodiments of the invention, such as a spoon, ladle, knife, fork, spear, or other structure, particularly those having an elongated handle. For example, in an embodiment featuring a fork utensil, the utility portion may include a plurality of fork tines, while in an embodiment featuring a knife utensil, the utility portion may include a cutting edge.

Returning to the first illustrated embodiment, and with reference to FIGS. 5 and 6, utility portion 176 defines a recess of 180, and a recessed bottom surface 184. Handle portion 172 is preferably connected to utility portion 176 at a location that is proximate the opening 180, for reasons described further herein below.

Utensil 124 is initially molded unitarily with the closure base 112, as illustrated in FIG. 5. Utensil 124 is connected to the closure base 112 with short, frangible bridges or connections 185, 187 which can be broken by a user to manually separate utensil 124 from closure base 112. Preferably, utensil 124 includes the frangible connections 185, 187 to closure base 112 at two locations so as to provide an attachment to base 112 that is stable, but readily separable with manual manipulation. There is one frangible connection or bridge 185 between the closure base 112 and the end of utensil handle portion 172. The handle portion 172 is connected to rim 140 by a thin, frangible web in the form of a frangible bridge 185 that is defined by a reduced cross-sectional thickness of material. However, more than one frangible bridge 185 could be provided if desired.

Still referring to FIG. 5, a second frangible connection between utensil 124 and closure base 112 is provided at the utility portion 176. Closure base 112 includes a leveling flange 190 extending laterally from the base rim 140 for leveling product across the top of the utensil scoop recess 180 of the utility portion after the utensil 124 has been separated from the closure base 112 and use to scoop product into its scoop recess 180. The utility portion 176 is connected to the leveling flange 190 by two frangible webs in the form of spaced-apart bridges 187 defined by reduced cross-sectional thicknesses of the material. However, it is understood that a lesser or greater number of bridges, having the same or different dimensions, could readily be implemented.

Frangible bridges 185 and 187 facilitate the unitary molding of utensil 124 with closure 100, and maintain utensil 124 in a desired position during initial installation of closure 100 on the container 104, and during subsequent delivery of the container 104 and closure 100 to a user or other recipient. However, upon application of twisting or other manual force to utensil 124, such as by an end user of a packaged product to which closure 100 is applied, the frangible bridges 185 and 187 can be readily broken, thereby releasing utensil 124 from closure base 112. Once released, utensil 124 can be utilized to remove, stir, or otherwise manipulate the contents of container 104.

The detailed design of the frangible bridges, 185 and 187 including the shapes, number, and arrangement of the bridges 185 and 187, form no part of the broad aspects of the invention as embodied in the closure illustrated in FIGS. 1-6.

In some applications, it may be desirable to provide a foil or laminar seal (not illustrated) across the mouth 108 of the container 104 or across the interior of the closure base 112. In those applications, the utensil 124 may be connected to the closure base 112 at a location further outwardly relative to container mouth 108 so as to create additional clearance for such a seal (not illustrated).

As can be seen in FIG. 5, the underside of the lid 116 is exposed to a user when the lid 116 is in the open position. The underside of the lid 116 has a raised platform region 198 which slopes to a recessed region 194. The raised platform region 198 has a utensil retainer or receiving structure 202 for releasably receiving, retaining, and storing the utensil 124 in the lid 116 after use. The receiving structure 202 has spaced-apart, parallel walls 206 extending from the raised platform region 198 for frictionally retaining a portion of the utensil 124. One or both of the walls 206 are configured for undergoing temporary elastic deformation to permit outward deflection of the wall or walls so as to accommodate insertion of the utensil handle portion 172 between the walls so that the walls resiliently engage and retain the lid 116. When a sufficient force is later applied by a user to pull out the utensil 124, the utensil 124 is released from the lid 116 by the walls 206 again temporarily, elastically deforming or deflecting outwardly. The location of the retainer 202 on the raised platform region 198 is such that at least part of the length of the utensil handle portion 172 is spaced away from the recessed region 194 to accommodate a user's finger engaging the utensil handle portion 172 located beyond the raised platform region 198 so as to facilitate the user grasping the utensil handle portion 172.

It will be understood that the raised platform region 198 and the utensil retainer 202 may have a variety of geometries and configurations for retaining the utensil 124 in the lid 116 such that the handle portion 172 is spaced away from the recessed region 194. For example, in an alternate embodiment (not illustrated), the utensil retainer or receiving structure 202 may be a peg, spud or catch for frictionally retaining, or otherwise releasably retaining, the utility portion 176 on the raised platform region 198. Also, the exterior side of the lid deck 152 need not be recessed (as visible in FIG. 1) to follow the contour of the raised platform region 198 below the lid deck 152.

In the broadest concept of this aspect of the invention, the utensil 124 need not be stored in the lid 116 after use. Rather, the utensil 124 could be stored after use on the closure base 112. To that end, the closure base 112 could be modified to provide a suitable storage region (say, at an inwardly extending region adjacent the rim 140). The previously described raised platform 198, recessed region 194, and retainer 202 could be located at such a region on the closure base 112 instead of the lid 116, wherein the utensil 124 could then be retained after use in the closure base 112 instead of the lid 116 (not illustrated).

Figure 8:
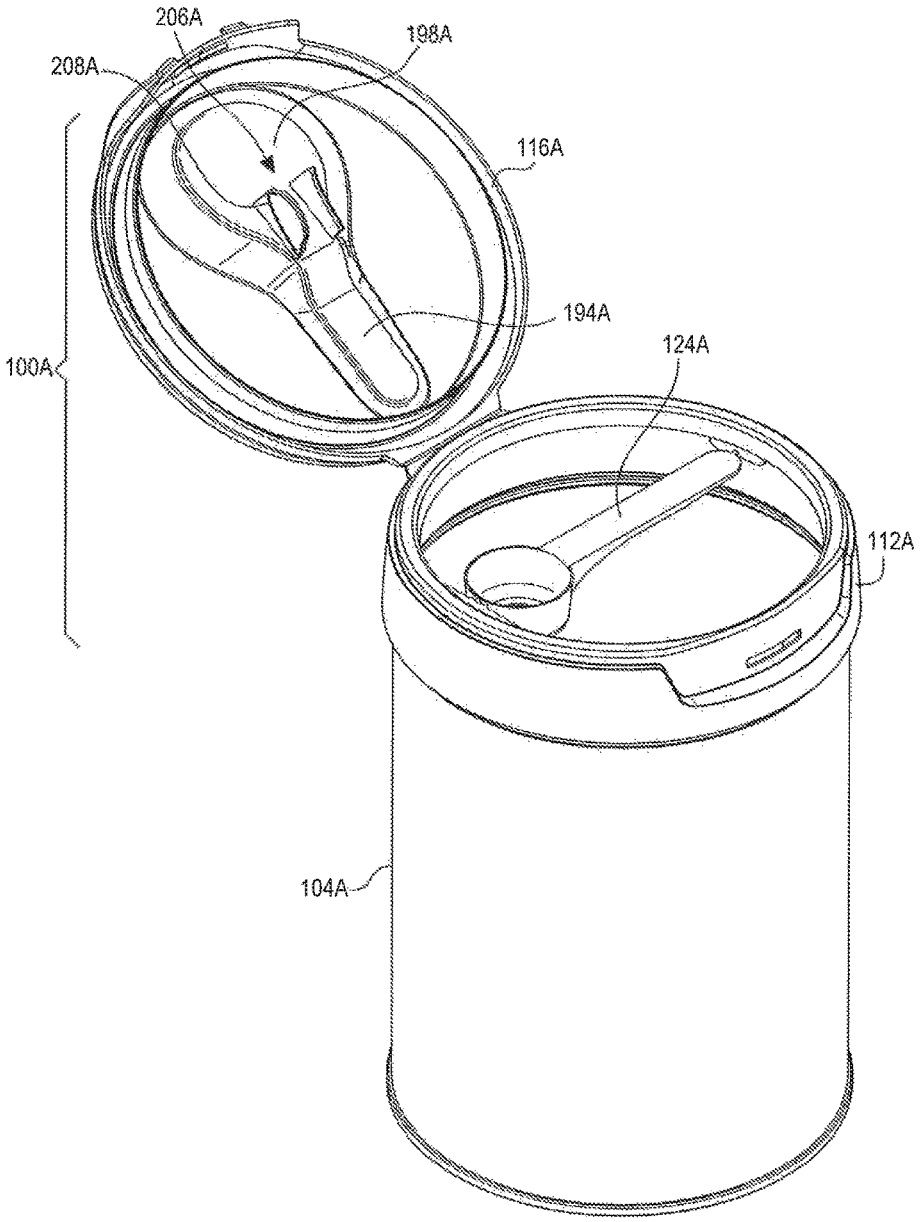
FIG. 8 is a perspective view similar to the perspective view in FIG. 7, but FIG. 8 shows the lid of the closure moved from a closed position to an open position allowing access to the container interior, and FIG. 8 also shows a utensil frangibly connected at each end to a base of the closure in an initially manufactured configuration wherein the closure and utensil are molded together as a unitary article.
Figure 9:
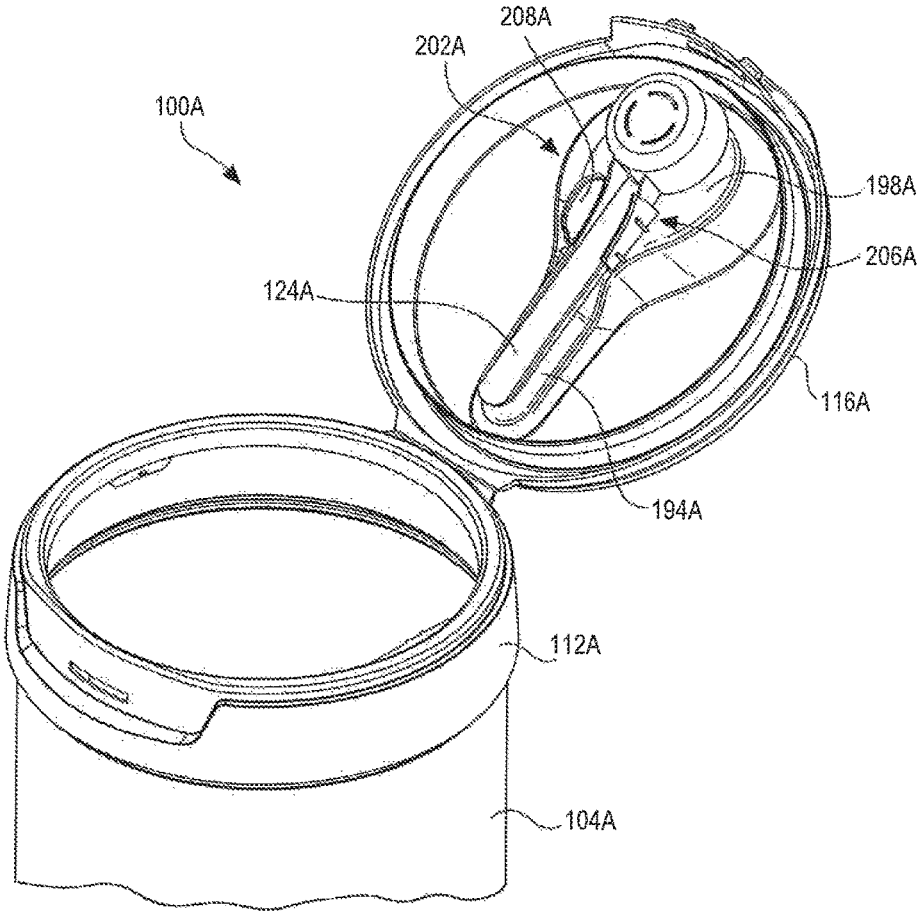
FIG. 9 is an enlarged, fragmentary, perspective view similar to FIG. 8, but FIG. 9 shows the utensil separated from the closure base and retained in the closure lid.
Figure 10:
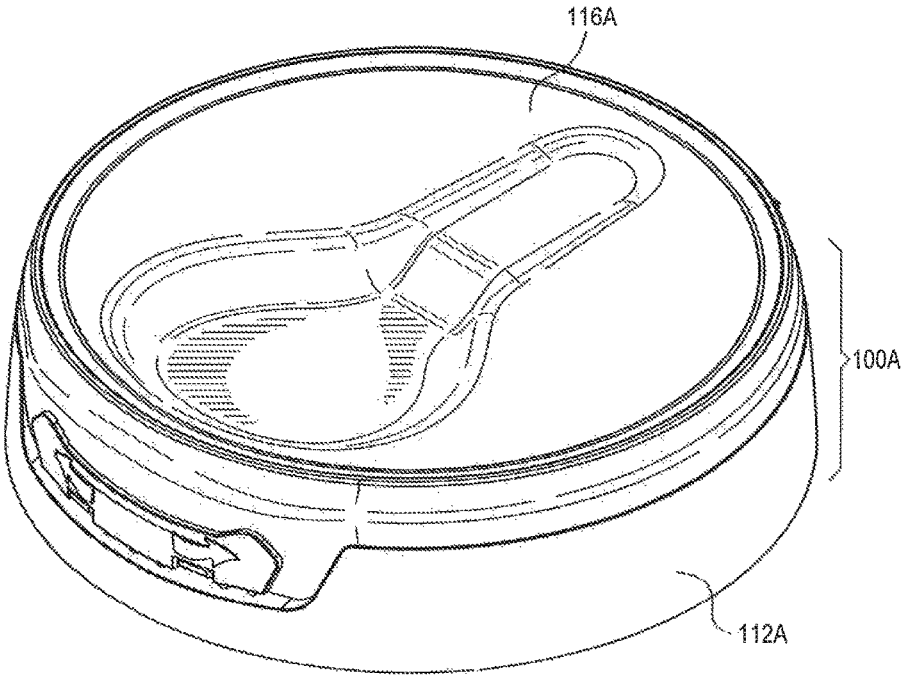
FIG. 10 is a perspective view taken from above of just the closure of the package of FIG. 7, the closure shown in a closed condition.
Figure 11:
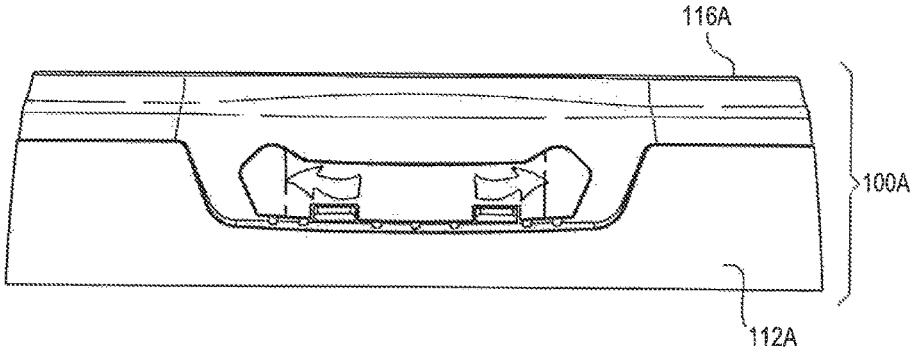
FIG. 11 is a front elevation view of the closure shown in FIG. 10.
Figure 12:
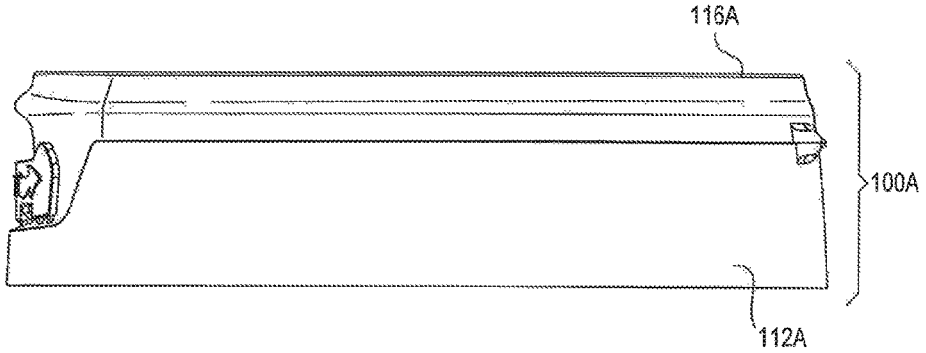
FIG. 12 is a right side elevation view of the closure shown in FIG. 10.
Figure 13:
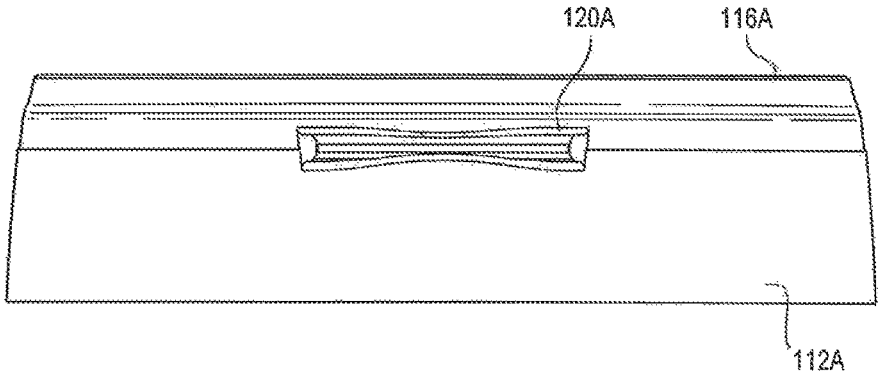
FIG. 13 is a rear elevation view of the closure shown in FIG. 10.
Figure 14:
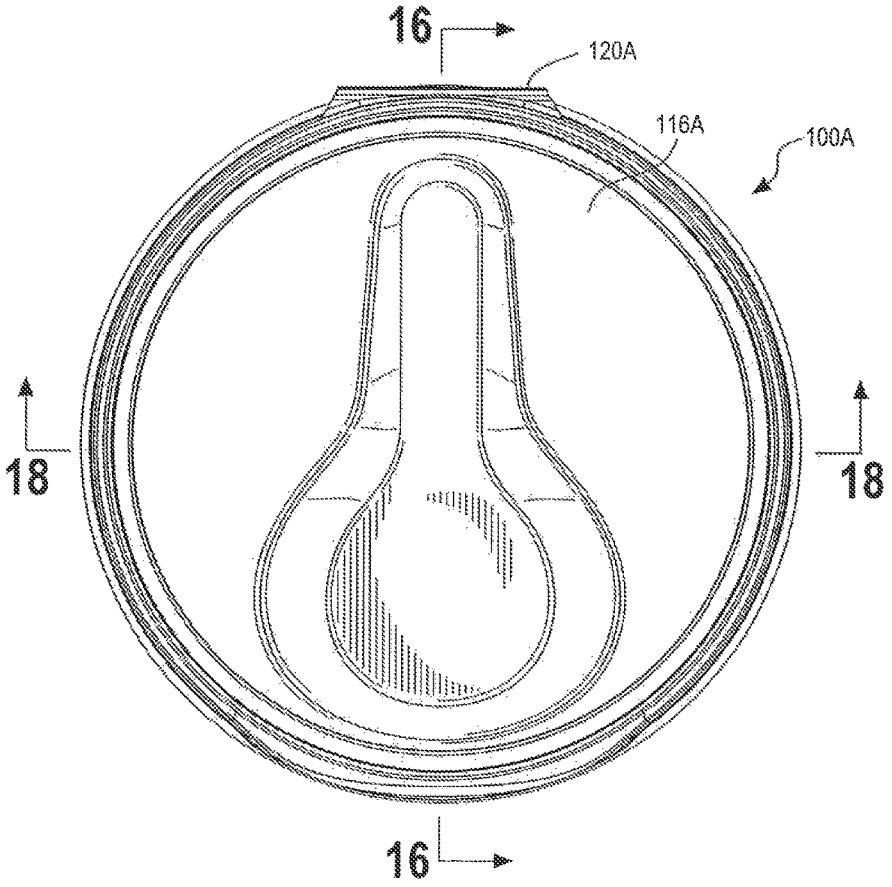
FIG. 14 is a top plan view of the closure shown in FIG. 10.
Figure 15:
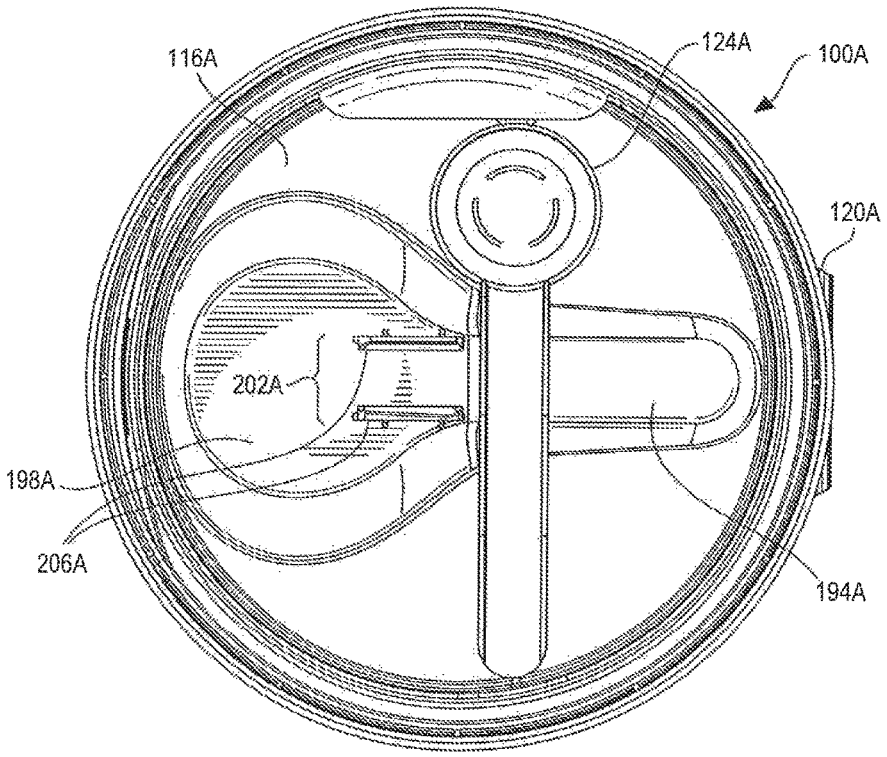
FIG. 15 is a bottom plan view of the closure shown in FIG. 10.
Figure 16:
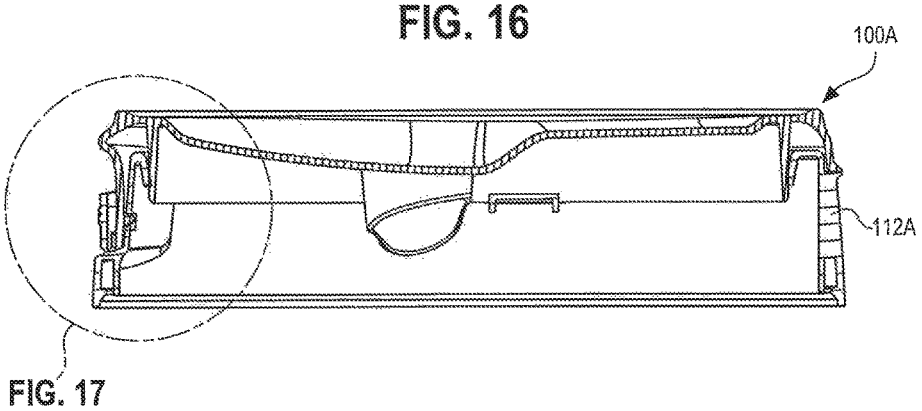
FIG. 16 is a cross-sectional, side elevation view of the closure taken along the plane 16-16 in FIG. 14.
Figure 17:
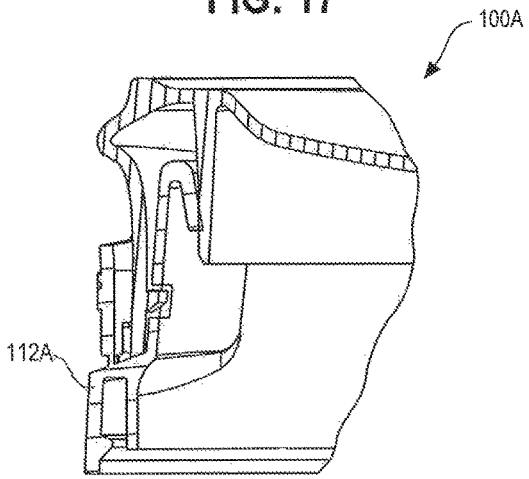
FIG. 17 is an enlarged, fragmentary, cross-sectional view of a front portion of the closure shown in FIG. 16.
Figure 18:
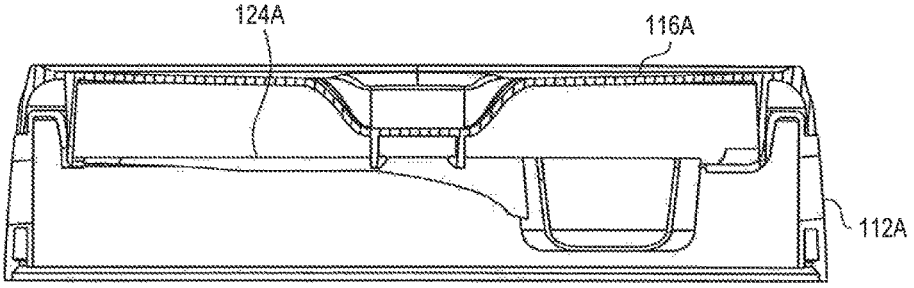
FIG. 18 is a cross-sectional view of the closure taken along the plane 18-18 in FIG. 14.
Figure 19:
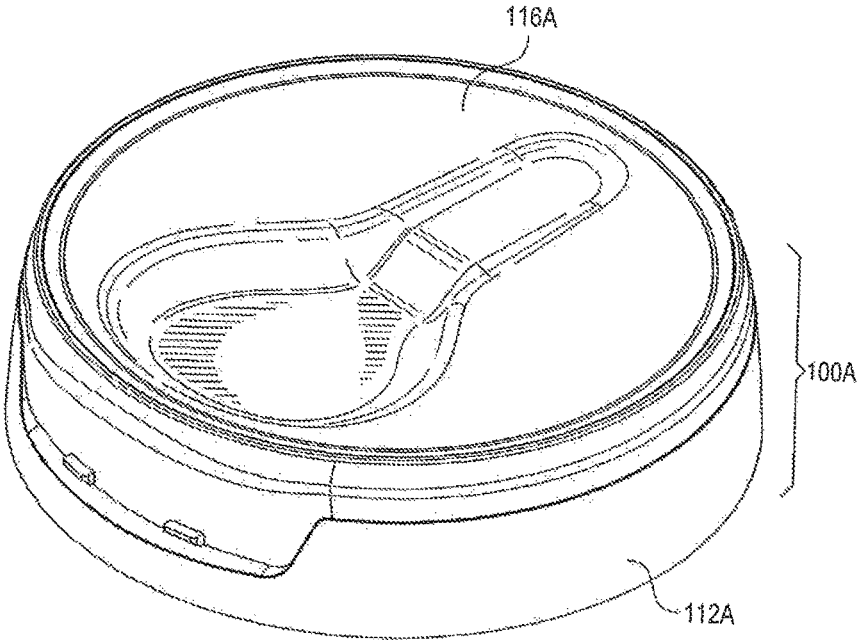
FIG. 19 is a perspective view similar to FIG. 10, but in FIG. 19 a tamper-evident member of the closure has been removed.
Figure 20:
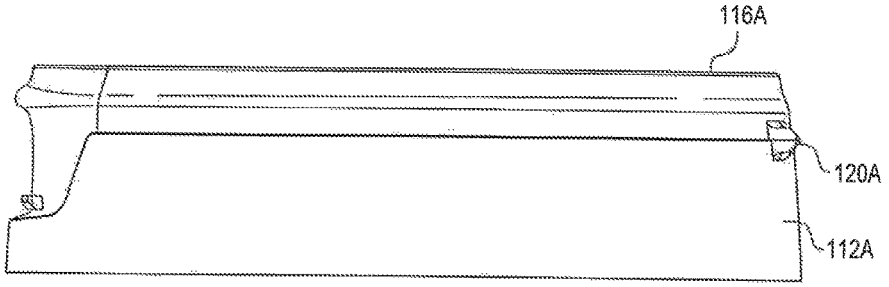
FIG. 20 is a right side elevation view of the closure shown in FIG. 19.
Figure 21:
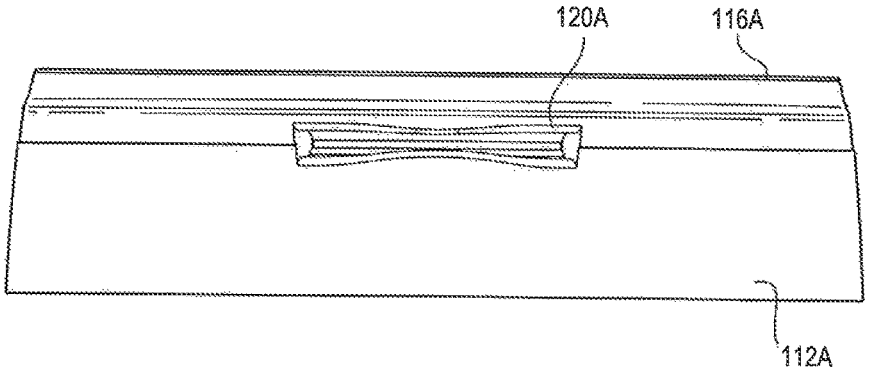
FIG. 21 is a rear elevation view of the closure shown in FIG. 19.
Figure 22:
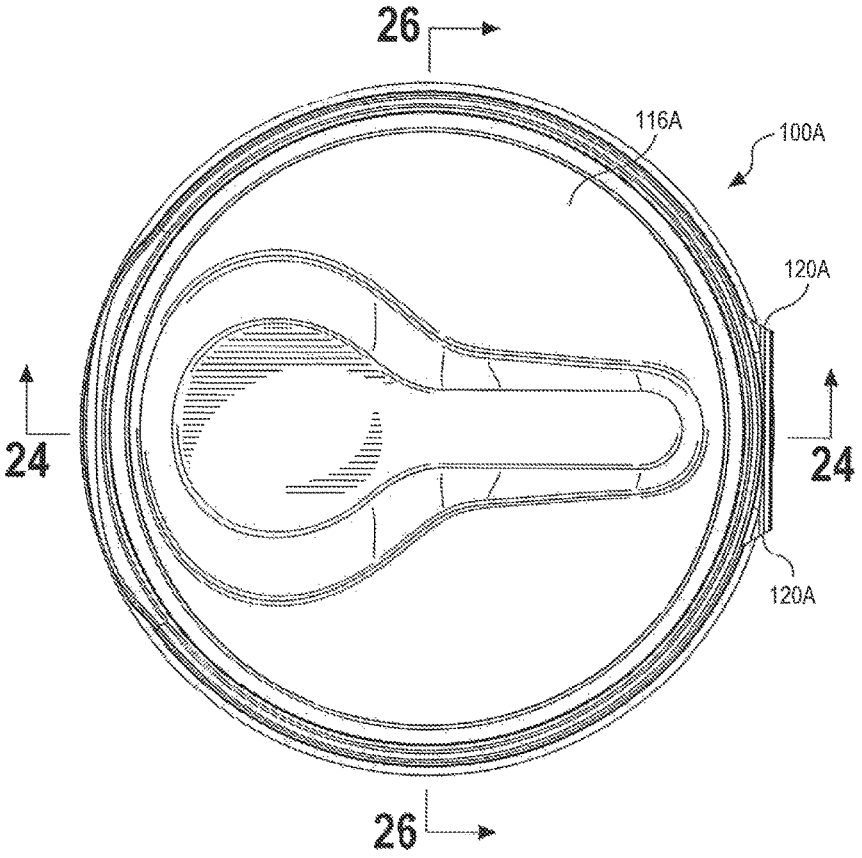
FIG. 22 is a top plan view of the closure shown in FIG. 19.
Figure 23:
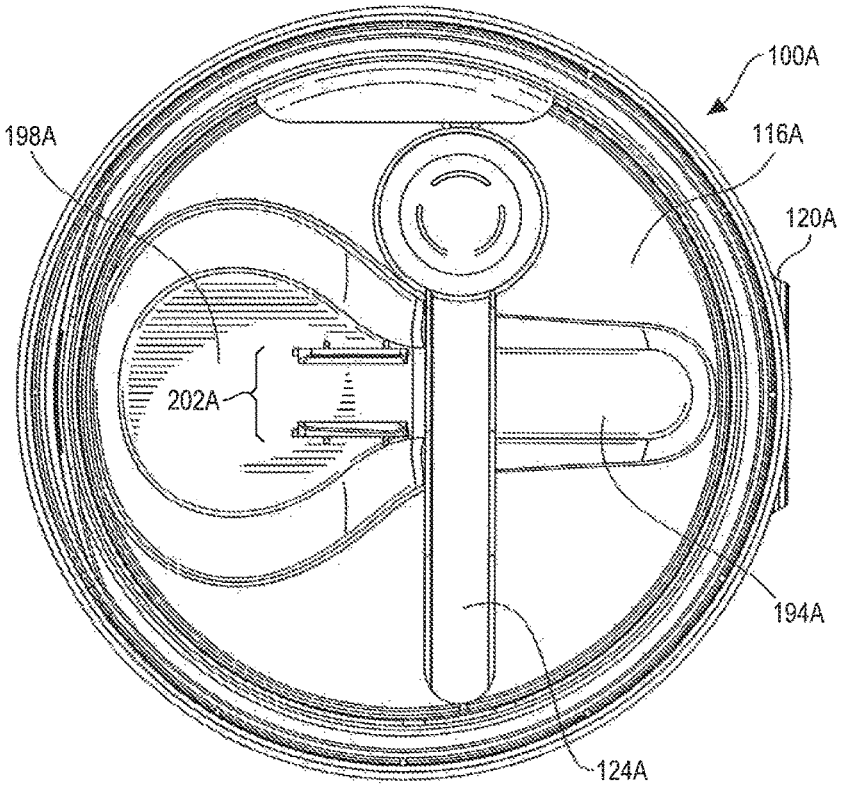
FIG. 23 is a bottom plan view of the closure shown in FIG. 19.
Figure 24:
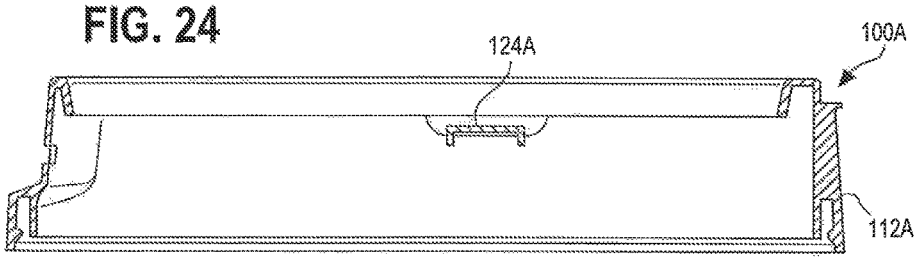
FIG. 24 is a cross-sectional, side elevation view of the closure taken along the plane 24-24 in FIG. 22.
Figure 25:
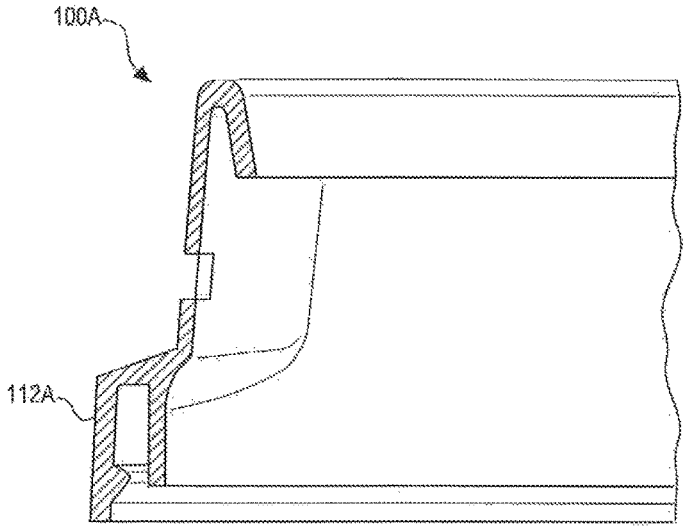
FIG. 25 is an enlarged, fragmentary, cross-sectional view of a front portion of the closure shown in FIG. 24.
Figure 26:
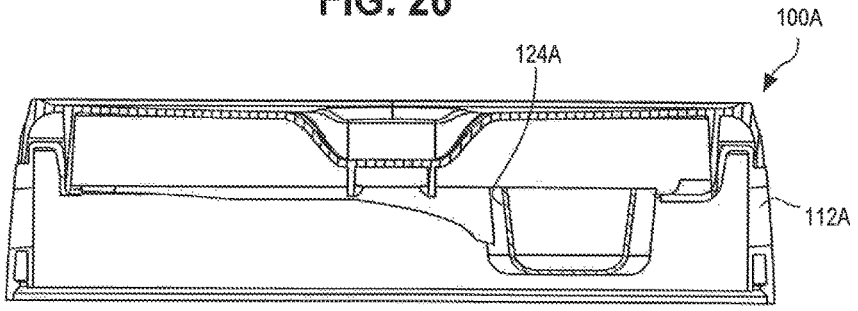
FIG. 26 is a cross-sectional view of the closure taken along the plane 26-26 in FIG. 22.
Figure 27:
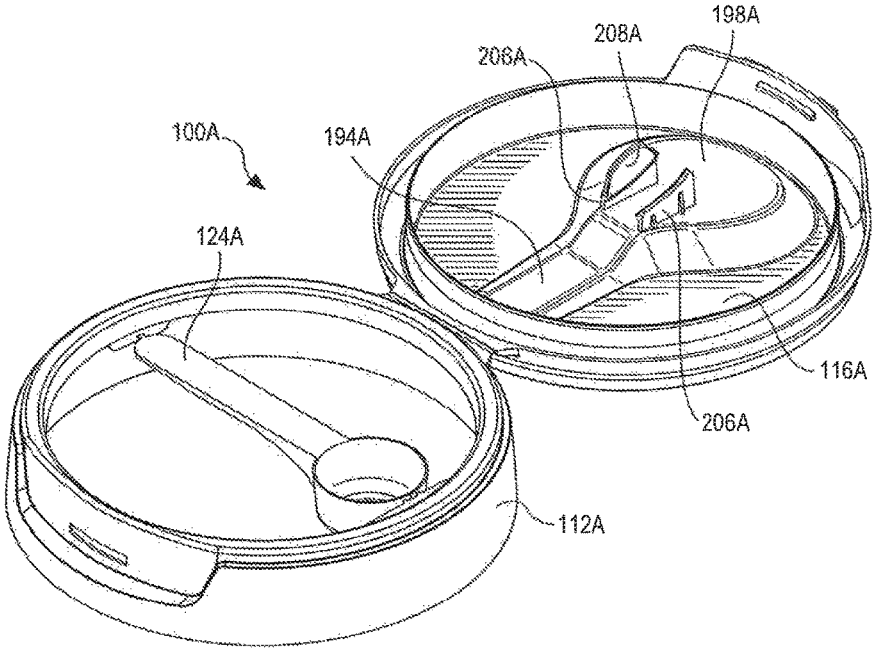
FIG. 27 is a perspective view similar to FIG. 19, but in FIG. 27 the closure lid has been moved to an open position after the tamper-evident member of the closure has been removed.
Figure 28:
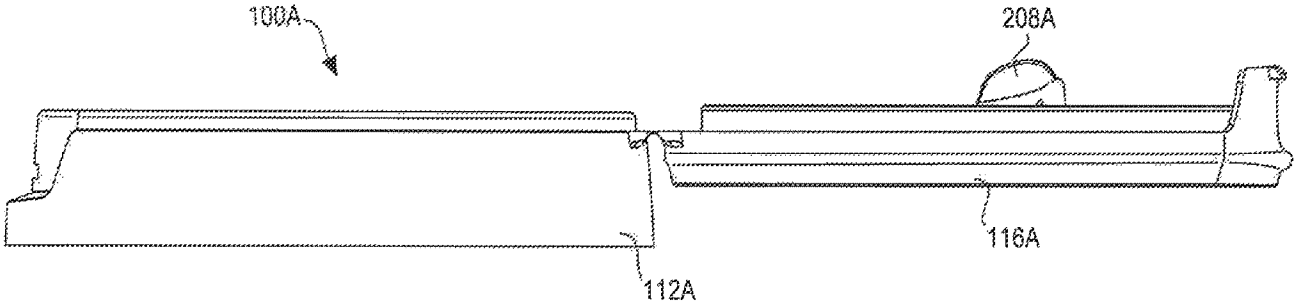
FIG. 28 is a right side elevation view of the closure shown in FIG. 27.
Figure 29:
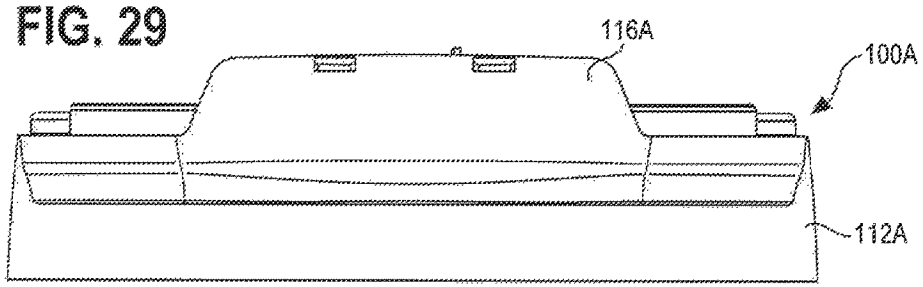
FIG. 29 is a rear elevation view of the closure shown in FIG. 27.
Figure 30:
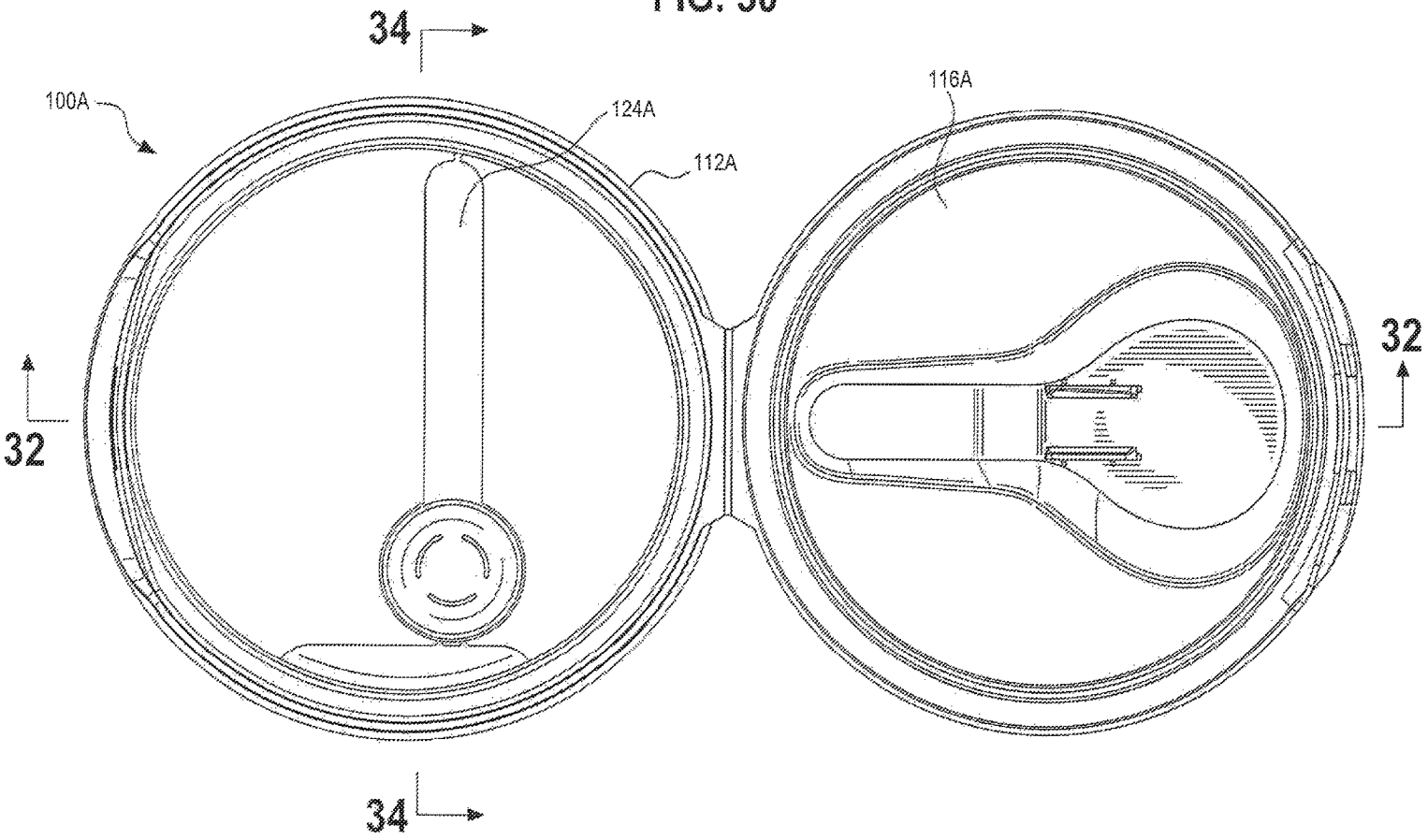
FIG. 30 is a top plan view of the closure shown in FIG. 27.
Figure 31:
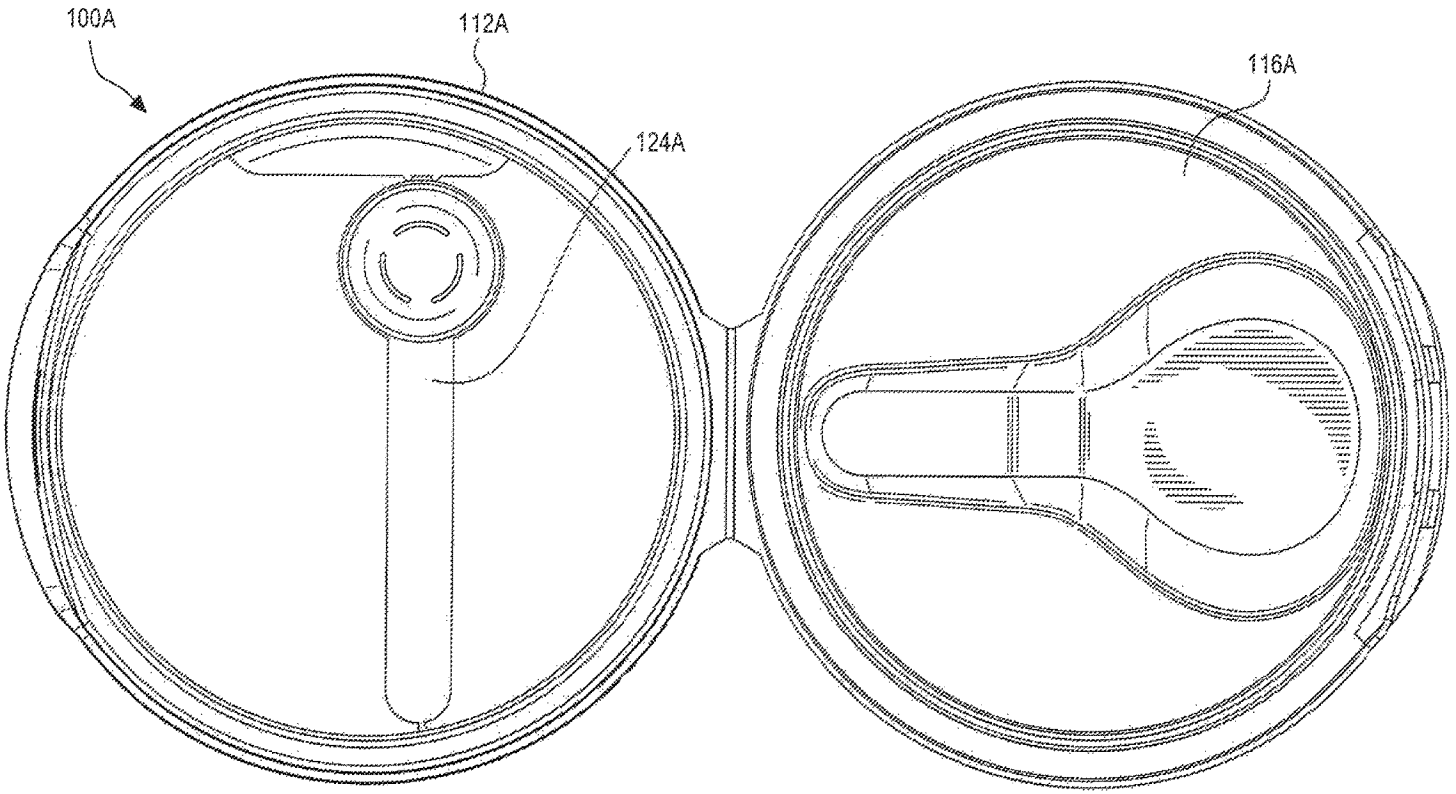
FIG. 31 is a bottom plan view of the closure shown in FIG. 27.
Figure 32:
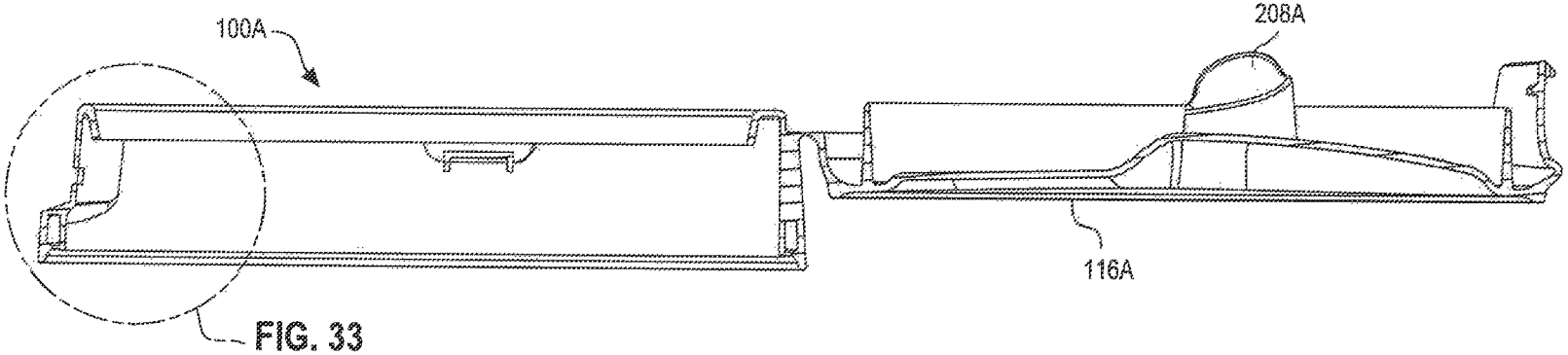
FIG. 32 is a cross-sectional view of the closure taken along the plane 32-32 in FIG. 30.
Figure 33:
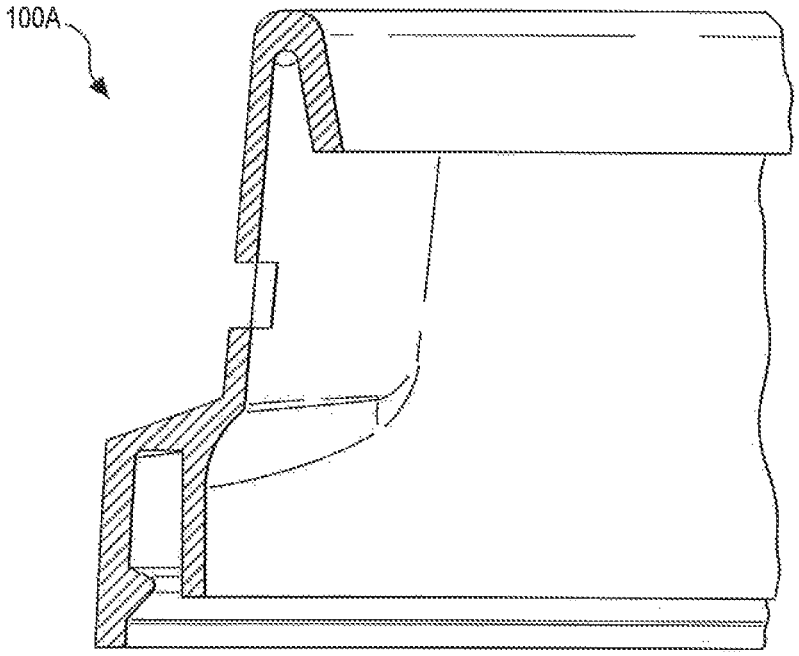
FIG. 33 is an enlarged, fragmentary, cross-sectional view of a front portion of the closure shown in FIG. 32.
Figure 34:
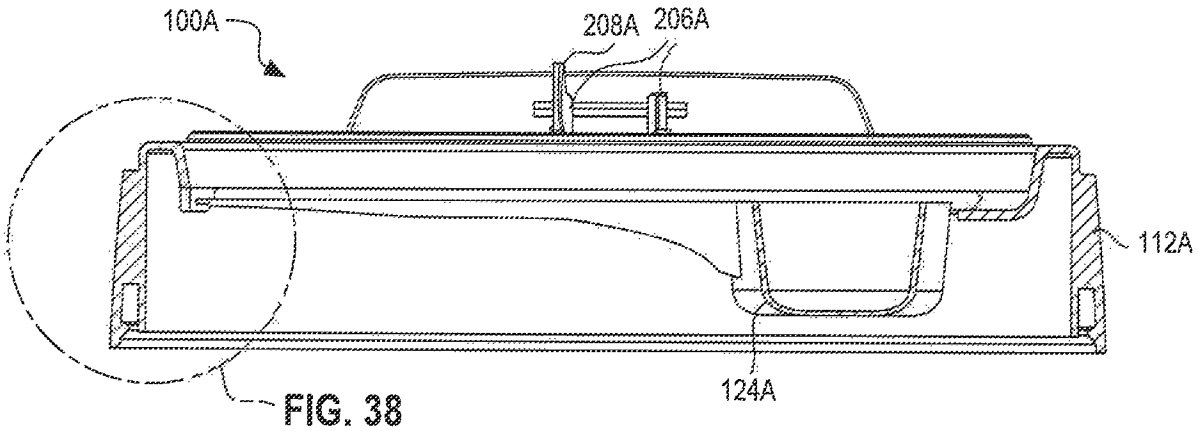
FIG. 34 is a cross-sectional view of the closure taken along the plane 34-34 in FIG. 30.
Figure 35:
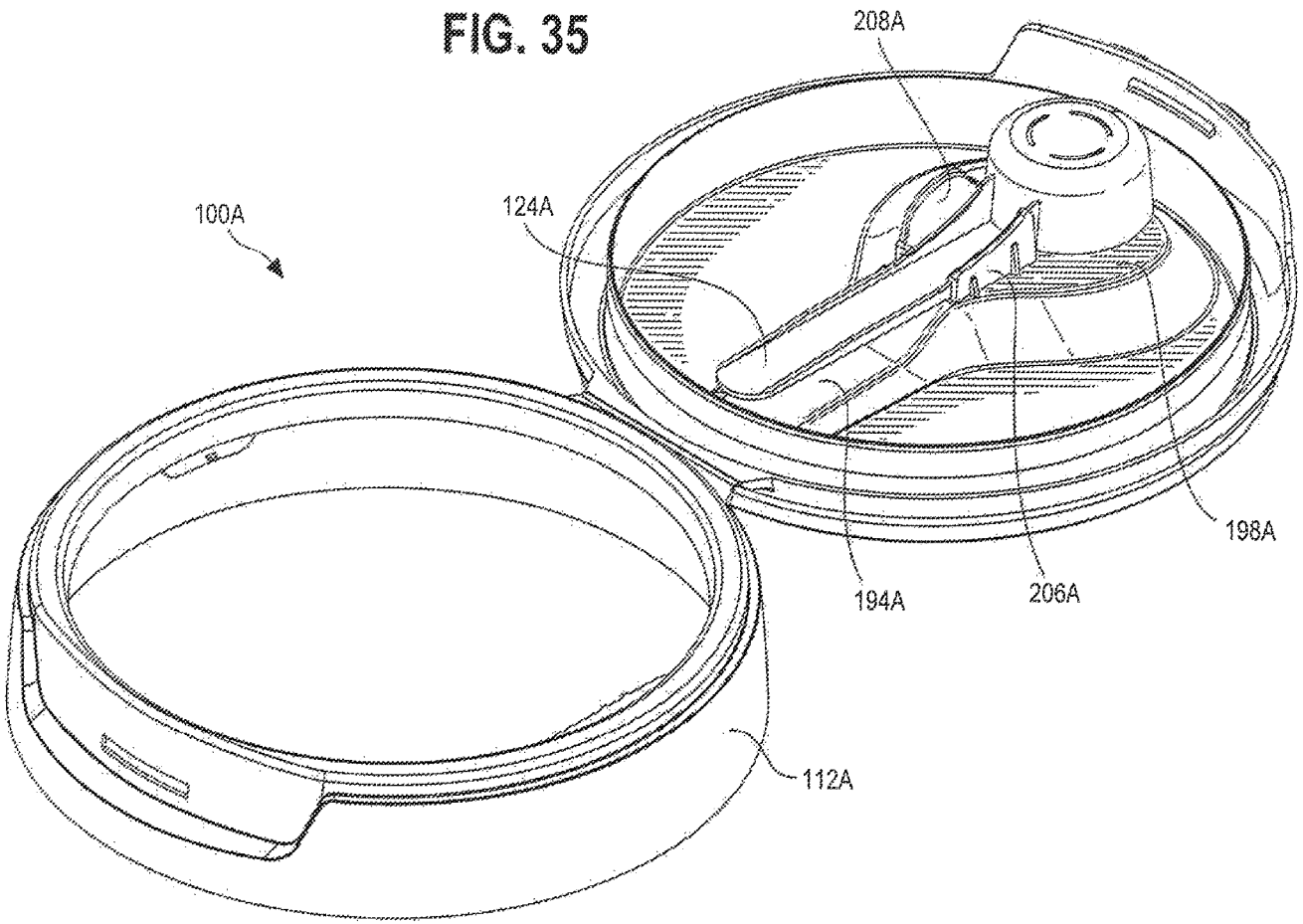
FIG. 35 is a perspective view similar to FIG. 27, but in FIG. 35 the utensil has been separated from the closure base, and the utensil is stored in the closure lid.
Figure 36:
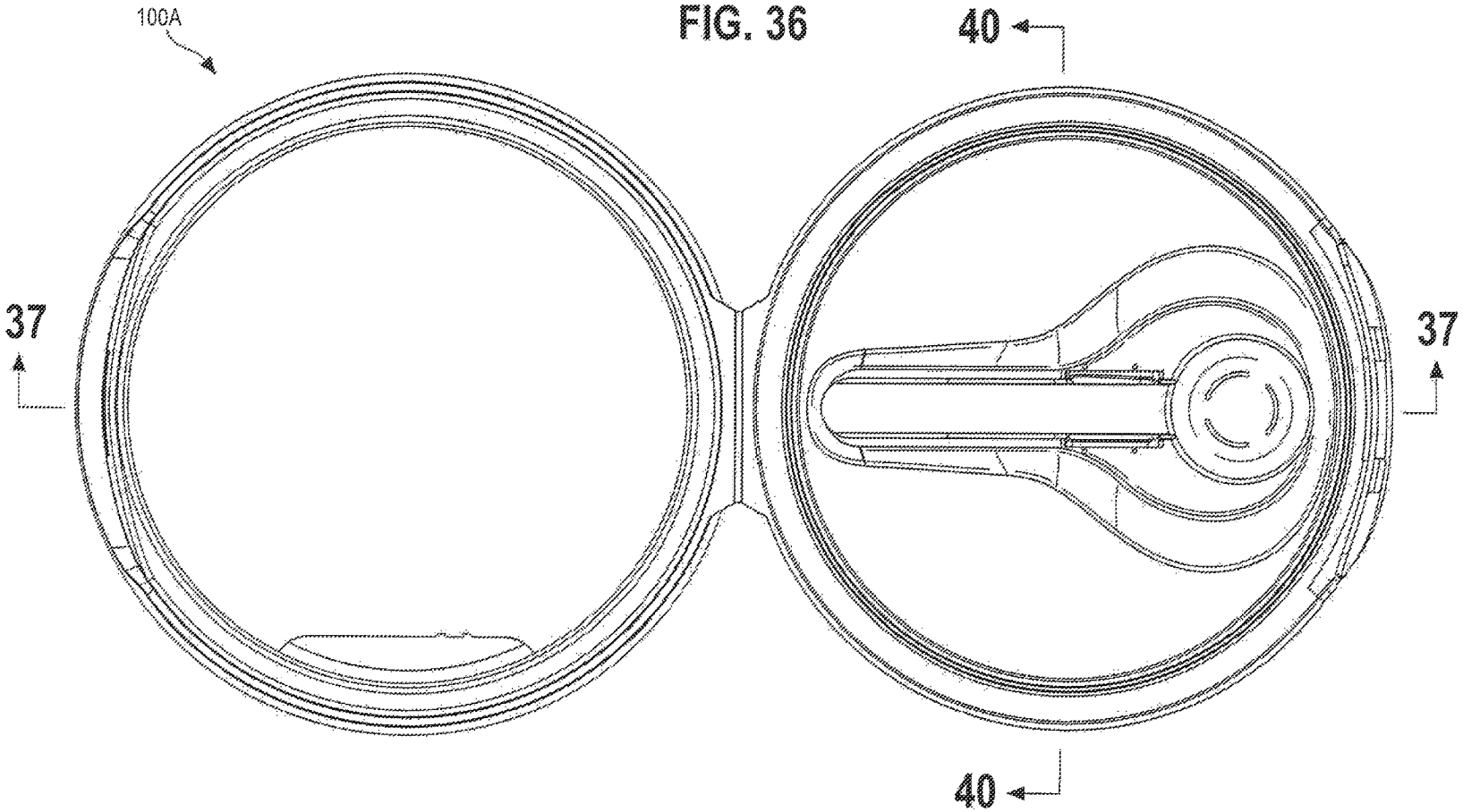
FIG. 36 is a top plan view of the closure shown in FIG. 35.
Figure 40:
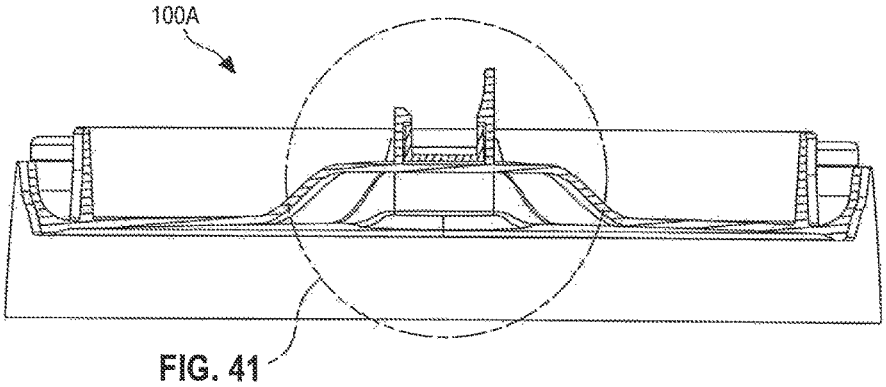
FIG. 40 is a cross-sectional view of the closure taken along the plane 40-40 in FIG. 36.

FIGS. 7-41 illustrate a second embodiment of a closure 100A according to the present invention. With reference to FIGS. 8-9, closure 100A includes a base 112A and a lid 116A. The base 112A is joined to the lid 116A by a hinge 120A. The closure base 112A initially holds a utensil 124A in a manner that permits the utensil 124A to be subsequently detached from the base 112A by the user and utilized for stirring a product in, or removing of a product from, a container 104A to which closure 100A is attached. The illustrated embodiment of the closure 100A is initially molded with the utensil 124A connected to the closure 100A by means of frangible bridges in the same manner as explained above for the first embodiment of the closure 100 illustrated in FIGS. 1-6.

In the second embodiment of the closure 100A, as illustrated in FIGS. 8, 27, 35, and 41, the underside of the lid 116A is exposed to a user when the lid 116A is in the open position, and the underside of the lid 116A has a raised platform 198A that slopes down to a recessed region 194A. The raised platform region 198A has a retainer 202A for receiving and storing the utensil 124A in the lid 116A. The retainer 202A has offset, or spaced-apart, generally parallel, walls 206A extending from the raised platform region 198A for retaining a portion of the utensil 124A. With reference to FIGS. 8 and 9, it will be understood that the recessed region 194A is recesses relative to the raised platform 198A that is exposed to a user on the underside of the lid 116A when the lid 116A is opened to accommodate storage of the utensil 124A.

Figure 41:
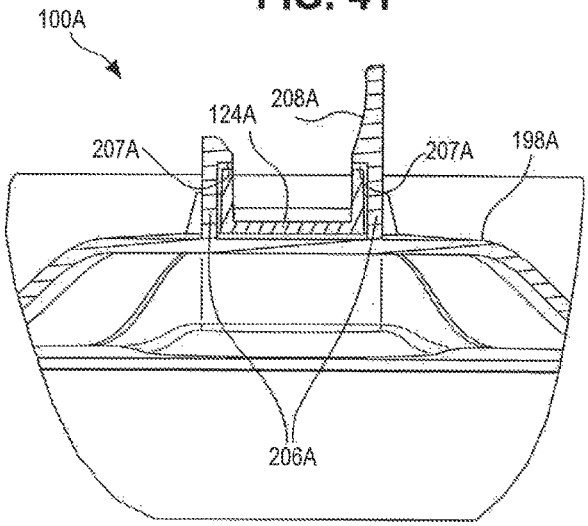
FIG. 41 is an enlarged, fragmentary, cross-sectional view of a lid of the closure shown in FIG. 40.
Figure 42:
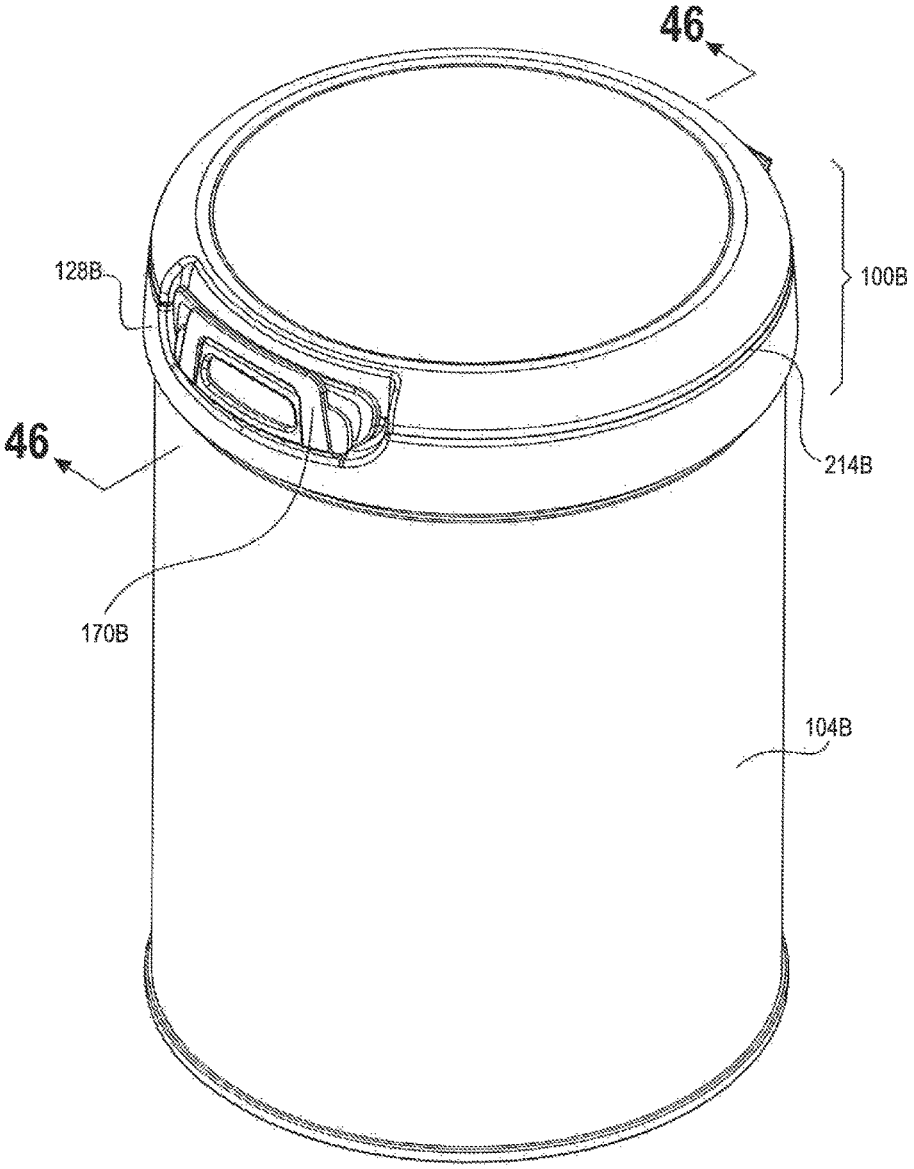
FIG. 42 is a perspective view taken from above of a third embodiment of a closure of the present invention shown in a closed condition and subsequently installed on a container in which a product may be stored—the closure, container, and product therein together constituting a "package"
Figure 43:
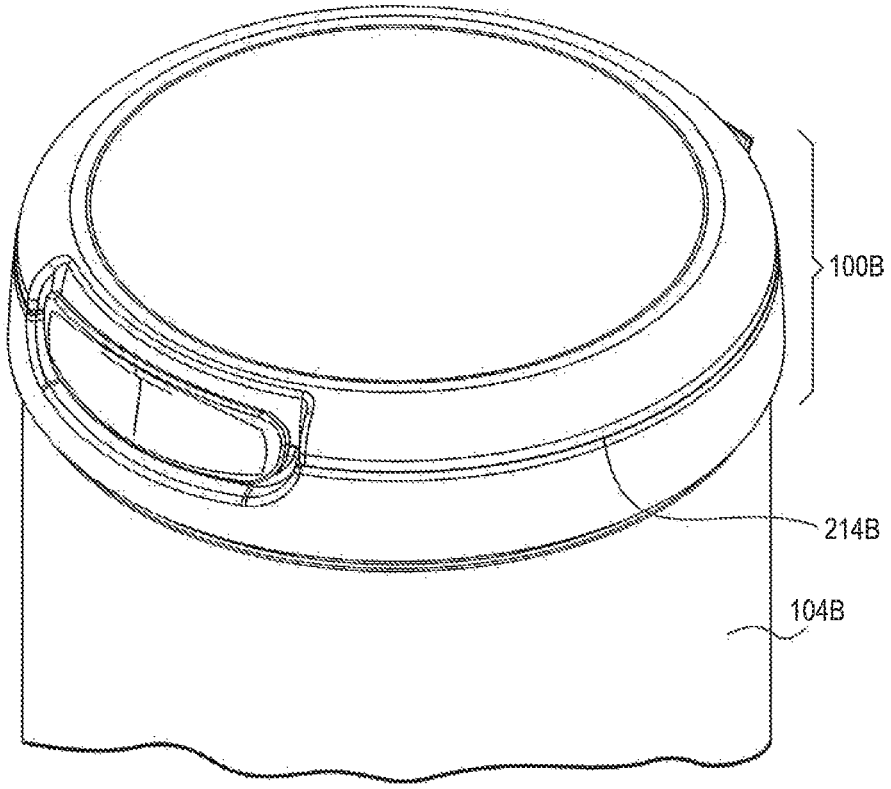
FIG. 43 is a fragmentary, perspective view taken from above the closure shown in FIG. 42, but in FIG. 43 only an upper portion of the package is shown, and a tamper-evident member of the closure has been removed.

As can be seen in FIG. 41, each wall 206A has a projecting portion or overhanging retention portion 207A for engaging and retaining a portion of the utensil 124A.

One of the walls 206A has a button portion or pressable region 208A for being engaged by a finger of the user, as will be discussed in detail hereinafter. When a user forces the utensil 124A between the walls 206A, at least the wall 206A with the pressable region 208A undergoes temporary elastic deformation and deflects so as to accommodate insertion of a portion of the utensil 124A, and the resiliency of the wall results in the utensil 124A being retained between the two walls 206A in the lid 116A. When a user subsequently applies a sufficient force to the pressable region 208A, the wall with the pressable region 208A is temporarily, elastically deformed and deflected outwardly so that the utensil 124A is released from the lid 116A.

While the pressable region 208A is shown as a curved portion on one of the walls 206A, it will be understood that the pressable region 208A may have a variety of geometries to accommodate the thumb or finger of a user. Such a pressable region 208A may extend from one or both of the walls 206A. In an alternate embodiment (not illustrated) the retainer 202A could be provided elsewhere on the lid 116A or on the closure base 112A instead of on the lid 116A.

Figure 44:
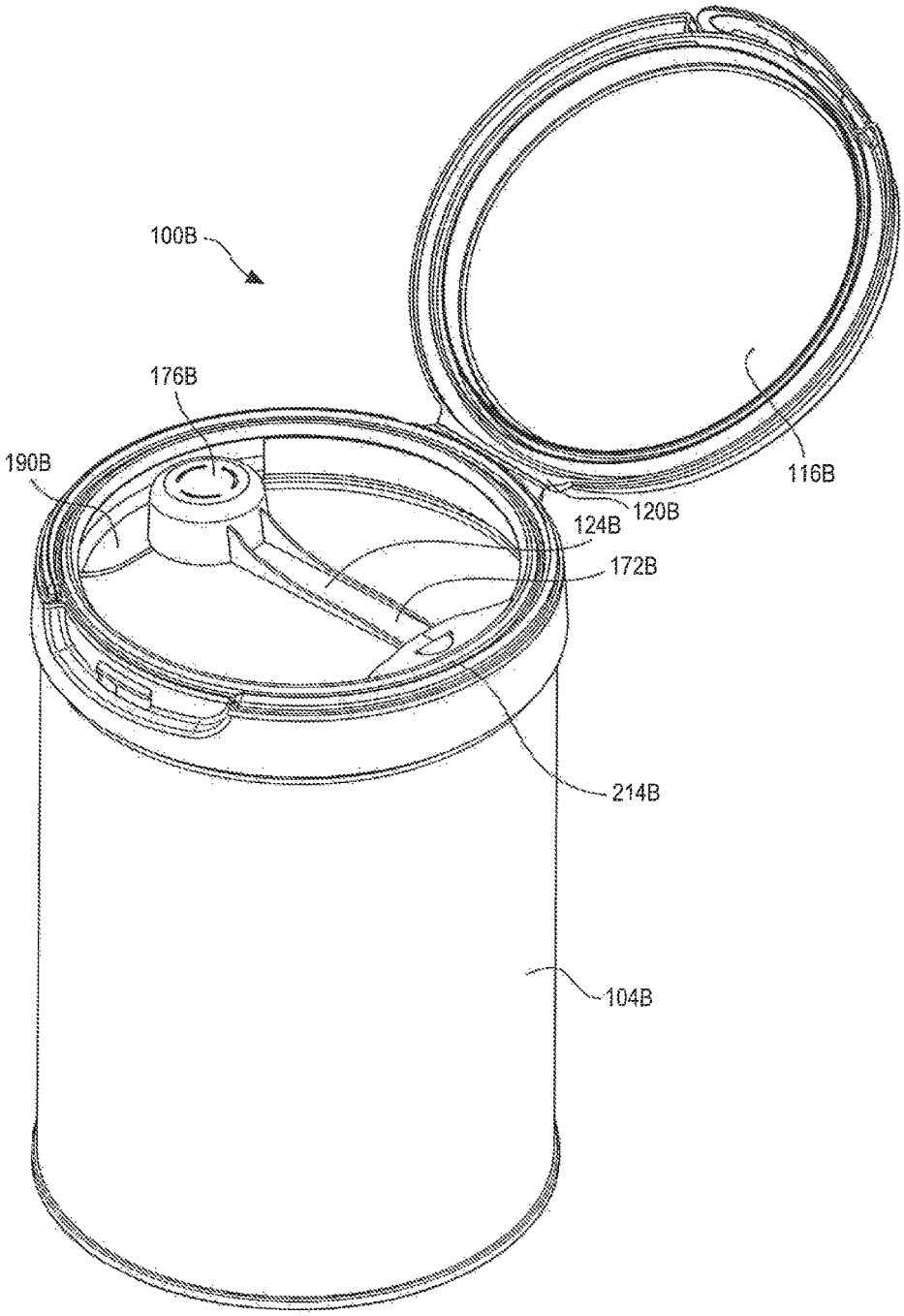
FIG. 44 is a perspective view similar to the perspective view in FIG. 43, but in FIG. 44 the lid of the closure has been moved from a closed position to an open position allowing access to the container interior, and in FIG. 44 a utensil is shown retained in an aperture of a flexible seal on the closure base.
Figure 45:
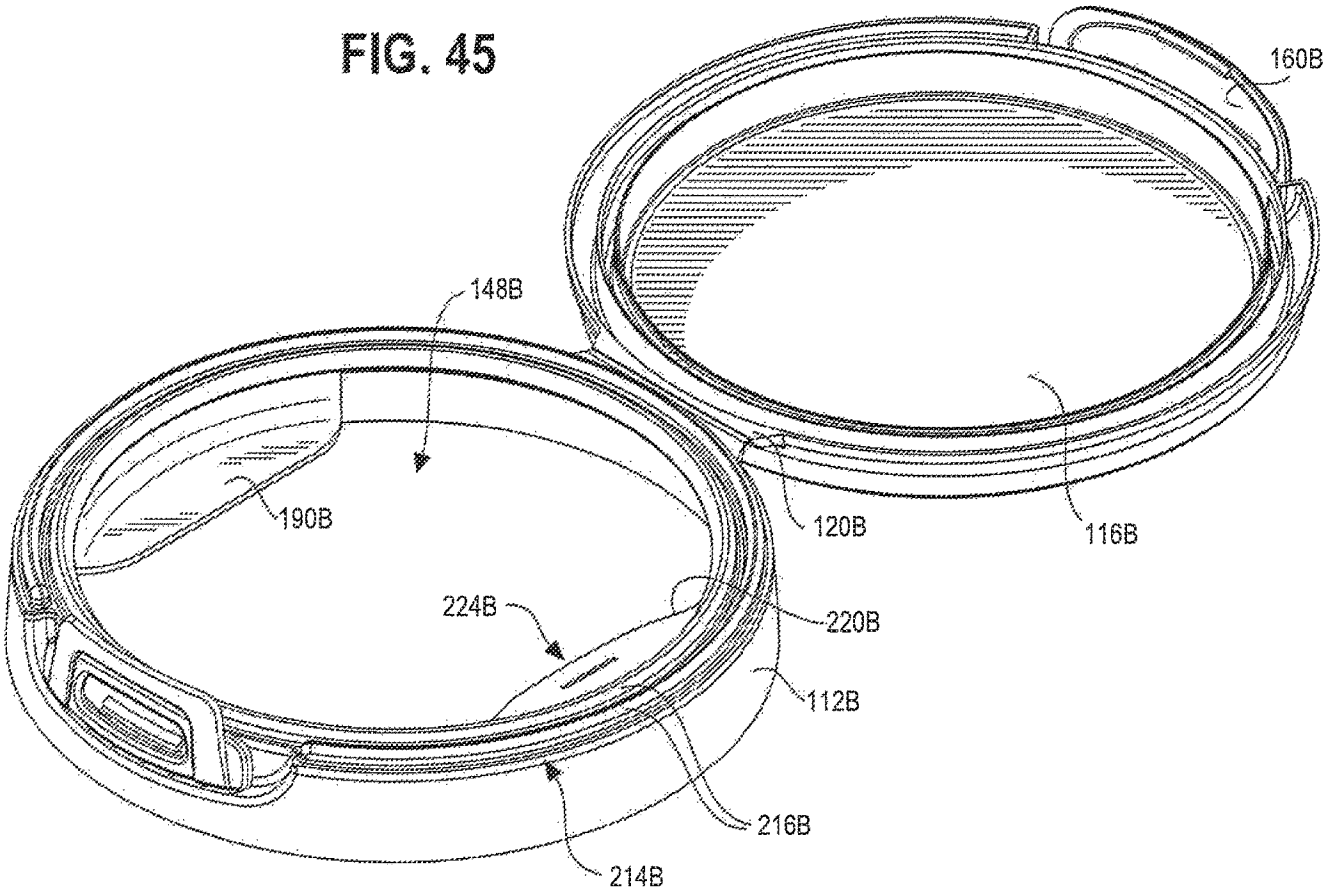
FIG. 45 is a perspective view of only the closure shown in FIG. 42.
Figure 46:
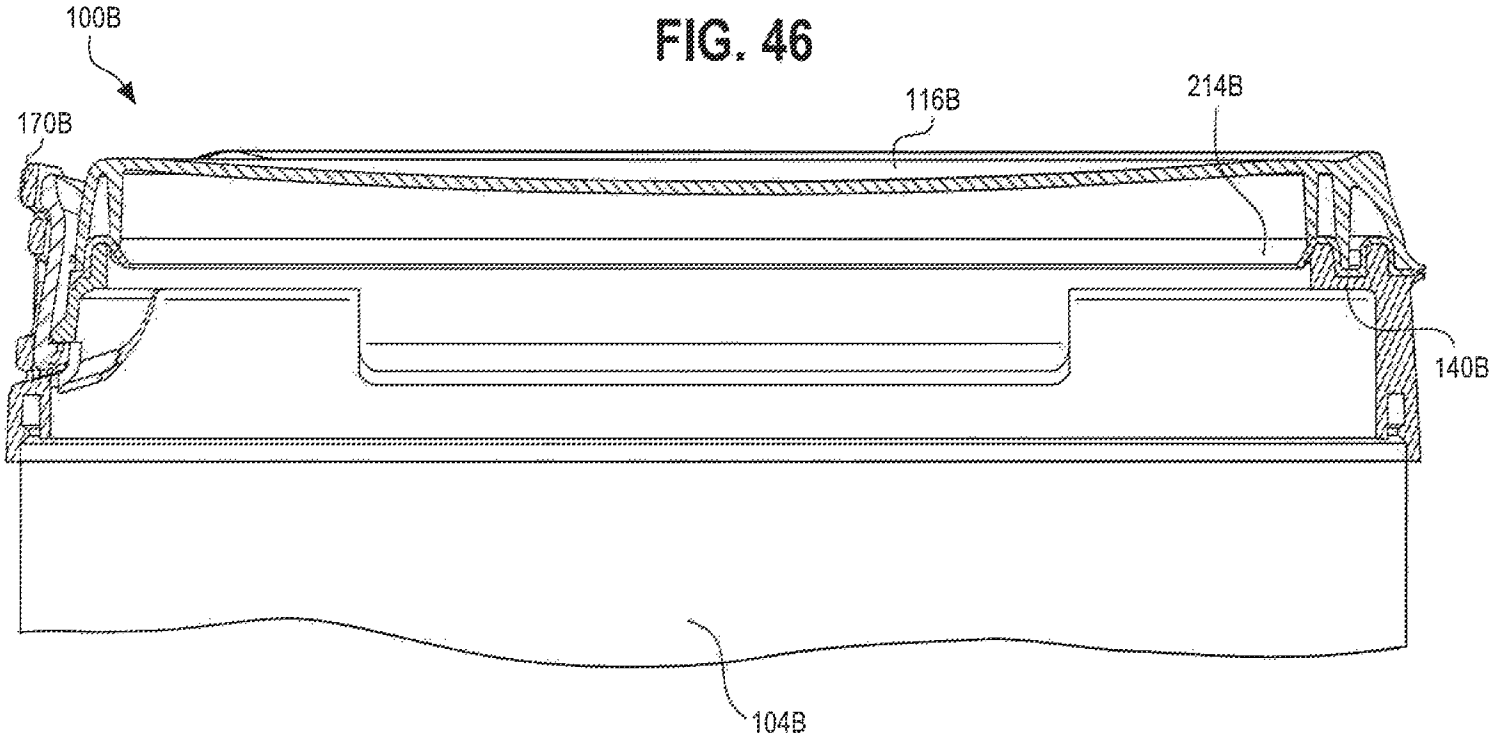
FIG. 46 is a fragmentary, enlarged, cross-sectional, perspective view taken generally along the plane 46-46 in FIG. 42 wherein the closure is shown as initially manufactured without an integral utensil provided therein.

FIGS. 42-46 illustrate a third embodiment of a closure 100B according to the present invention. Closure 100B is similar to closure 100 in that closure 100B includes a base 112B and a closing element or lid 116B joined to the base 112B by a hinge 120B. However, the closure base 112B has a flexible, resilient seal 214B that covers the rim of the base 112B and that engages the lid 116B in the closed position. Referring to FIG. 45, the seal 214B has a two concentric, annular, sealing walls 216B projecting upwardly for confronting a mating portion of the lid 116B. The seal 214B further has a laterally inwardly extending flexible platform 220B that partially extends across the access passage 148B of the base 112B. Platform 220B has a slit or aperture 224B for initially receiving and releasably holding a utensil 124B (e.g., the end of the handle portion of a scoop type utensil 124B as shown in FIG. 44). Aperture 224B permits the utensil 124B to be subsequently detached from the seal platform 220B by the user and utilized for removal of products from the container 104B to which closure 100B is attached. FIG. 44 shows the utensil handle portion 172B inserted and retained by the aperture 224B, while the utensil utility portion 176B (e.g., scoop or bowl) rests against a product leveler platform or flange 190B.

The flexible, resilient seal 214B is preferably bi-injection molded from a thermoplastic elastomer onto the base 112B, or can otherwise be a separately molded or formed component made from a suitable material (e.g., a thermoplastic elastomer) and applied to the base 112B (or lid 116B). Other materials could be used to form the seal 214B, and the seal 214B may be installed or applied to either the lid 116B or the base 112B by adhesive, secondary injection molding, heat welding, snap-fit engagement, or other means of connection.

Figure 47:
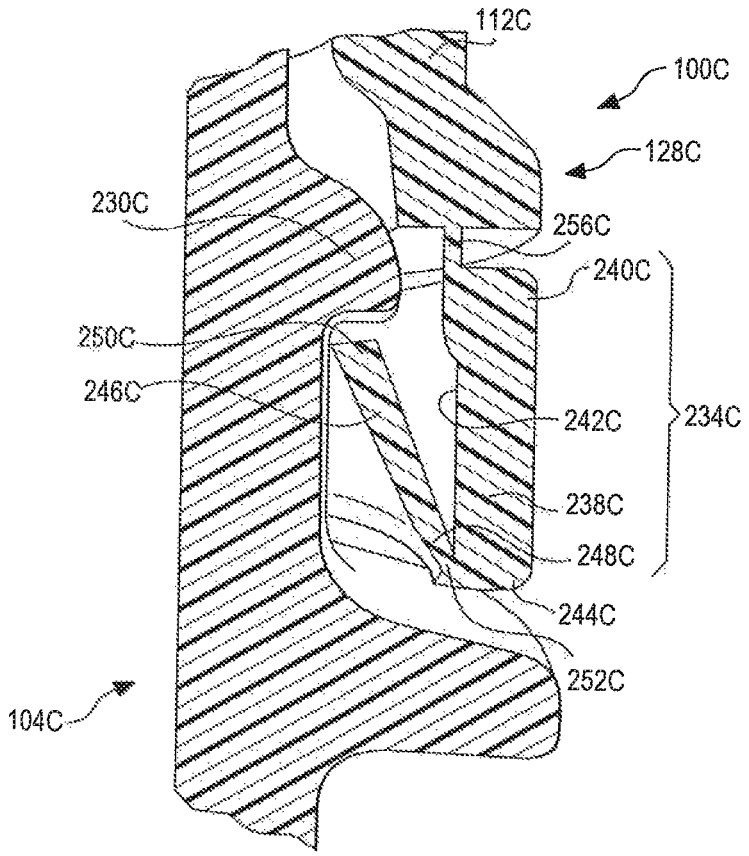
FIG. 47 is a fragmentary, cross-sectional, side elevation view of the bottom portion of a fourth embodiment of a closure of the present invention shown installed on a container in which a product may be stored—the closure, container, and product contained therein together constituting a "package"

FIG. 47 illustrates a fourth embodiment of a closure 100C according to one aspect of the present invention. Closure 100C is similar to closure 100 illustrated in FIGS. 1-6 in that closure 100C includes a base 112C for being installed at an opening of a container 104C having an annular, exterior, retention bead or flange 230C. The closure base 112C has a skirt 128C with a lower end portion 234C for being located adjacent the container flange 230C when the base 112C is installed at the container opening. The skirt lower end portion 234C has a first portion 238C with an outer side 240C, an inner side 242C, and a bottom end 244C. The skirt lower end portion 234C further has a second portion 246C with a proximal end 248C, a distal end 250C, and a connecting portion 252C that connects the first portion bottom end 244C and the second portion proximal end 248C.

When the closure 100C is installed on the container 104C by moving the closure 100C down over the open end of the container 104C, the connecting portion 252C accommodates an initial deflection of the second portion 246C by the container flange 230C toward the first portion inner side 242C. Subsequently, the connecting portion 252C also biases the second portion 246C back toward the container 104C (or at least accommodates movement of the second portion 246C away from the first portion inner side 242C toward the container 104C) after the closure 100C has been installed, and that movement locates the closure base second portion distal end 250C below the container flange 230C to prevent the base 112C from being removed or uninstalled from the container 104C.

Still referring to FIG. 47, in one preferred form, the skirt lower end portion 234C is connected to the remaining portion of the skirt 128C by a frangible connection 256C. The frangible connection 256C is a thin-walled portion or reduced-cross-sectional thickness portion of the closure base 112C to facilitate breaking of the connection 256C and separation of the skirt lower end portion 234C from the remaining portion of the skirt 128C. If a sufficient upward force is applied to the portion of the closure base 112C above the frangible connection 256C, such as by a user pulling up on the closure base 112C, the frangible connection 256C is torn apart, sheared, or otherwise broken such that the skirt lower end portion 234C remains secured to the container 104C and the remainder of the closure base 112C can be removed from the container 104C.

It will be appreciated that, if the removed closure 100C is placed back on the container 104C, then the broken frangible connection 256C provides an indication to a subsequent user that the closure 100C may have been removed, or at least may have been subjected to tampering.

It will be appreciated that the frangible connection 256C need not extend fully and continuously, circumferentially around the closure base 112C, and may instead be comprised of one or more separate, frangible connections.

Also, if the closure base 112C is intended to be permanently affixed to the container 104C, then the skirt 128C need not have any frangible connection 256C to the lower end portion 234C.

The inventors have discovered that the closure 100C having a skirt lower end portion 234C as described herein is especially suitable for use with containers 104C that are metal. Metal containers 104C manufactured to the same design specifications will tend to have slight differences in shape or size—especially if there are different suppliers or manufacturers producing the containers 104C. Furthermore, the containers 104C may be dented, deflected, warped, or otherwise altered from the specifications during processing, labeling, shipping, and/or storage of the containers 104C. The skirt lower end portion 234C with the flexible second portion 246C is particularly useful to compensate for such variances between suppliers of metal containers 104C.

FIGS. 48-82 illustrate a fifth embodiment of a closure 100D according to the present invention. Closure 100D is similar to closure 100 in that closure 100D includes a base 112D for being installed at an opening of a container 104D. Closure 100D further has a closing element or lid 116D pivotally connected to the base 112D to accommodate movement between a closed position occluding an access passage (not visible in FIGS. 48-49) of the closure 100D and an open position exposing the access passage.

The lid 116D has a latch member 160D (FIGS. 49 and 56) that is initially partially covered by a tamper-evident chamber 170D described in detail below. The lid latch member 160D is pivotally connected to the lid 116D for moving between an unlatched position (FIGS. 60 and 61) and a latched position engaging the base 112D to secure the lid 116D to the base 112D to retain the lid 116D in the closed position. Latch member 160D has a bead 164D (FIG. 62) for being received in an aperture 168D (FIGS. 56 and 62) in the base 112D.

The aperture 168D is defined in the base 112D along the aperture upper end or edge by an overhanging front portion 169D of the base 112D. When the lid latch member bead 164D is received in the aperture 168D, the latch member bead 164D and the overhanging front portion 169D of the base are in vertical registration. In this registration configuration, the bead 164D confronts the base overhanging front portion 169D which functions as an "engaging portion" 169D for engaging the latch member bead 164D to limit and prevent upward movement of the latch bead 164D. However, latch member 160D can be moved to an outwardly pivoted, unlatched position (not illustrated) for permitting the lid 116D to move from the closed position to the open position.

Figure 56:
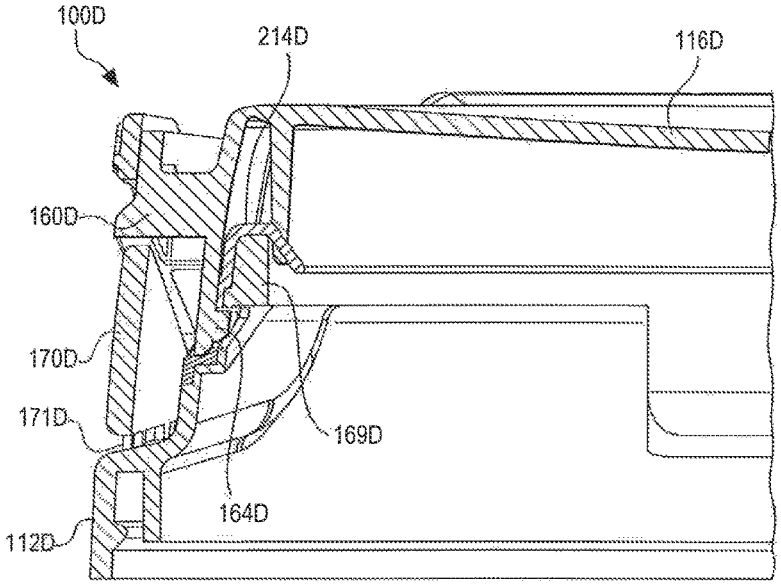
FIG. 56 is an enlarged, fragmentary, cross-sectional view of a front portion of the closure shown in FIG. 55.
Figure 57:
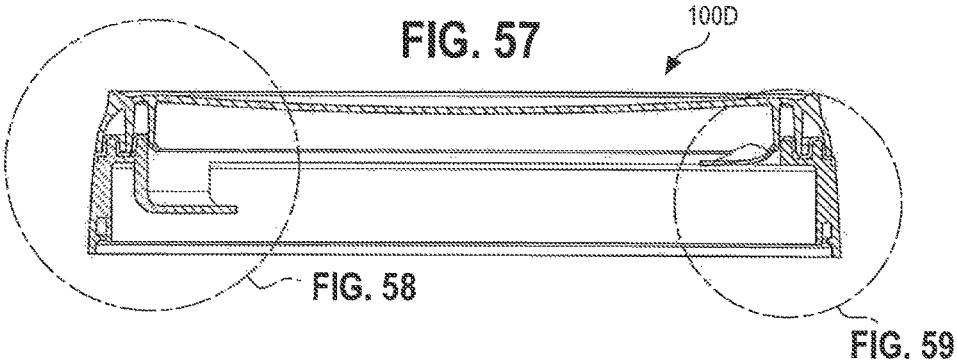
FIG. 57 is a cross-sectional view of the closure taken along the plane 57-57 in FIG. 53.
Figure 58:
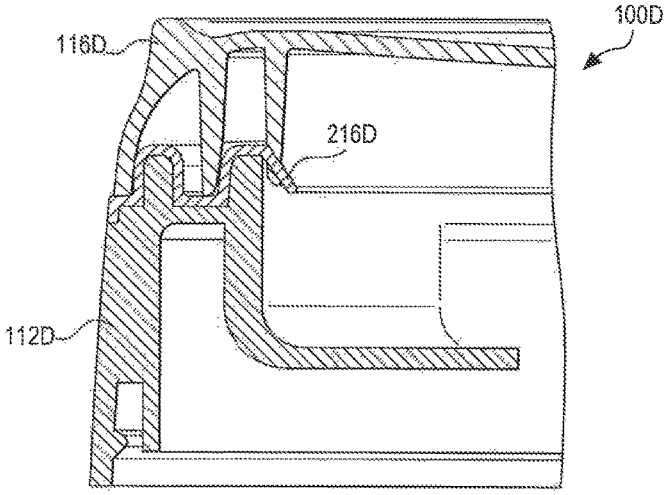
FIG. 58 is an enlarged, fragmentary, cross-sectional view of a right side portion of the closure of FIG. 57.
Figure 59:
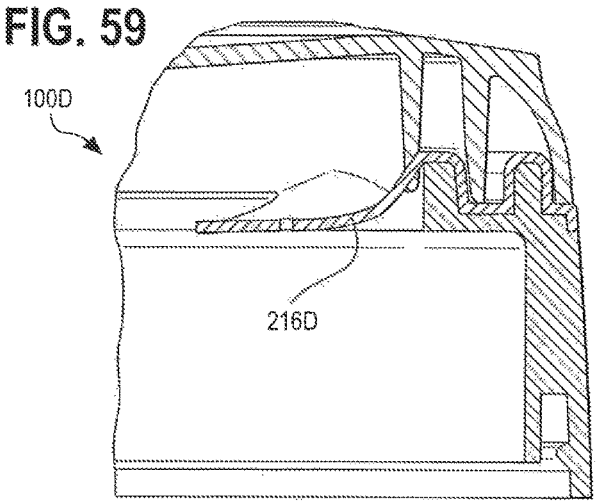
FIG. 59 is an enlarged, fragmentary, cross-sectional view of a left side portion of the closure shown in FIG. 57.

The closure 100D further has a flexible, resilient seal 214D located at the top portion of the base 112D. The seal 214D, which in the illustrated embodiment is formed from a thermoplastic elastomer, is compressed between the lid 116D and base 112D when the lid 116D is in the closed position and the latch member 160D is in the latched position (FIG. 56). The resiliency of the compressed seal 214D forces the lid latch member 160D upwardly into tight engagement with the base front engaging portion 169D at the top of the aperture 168D in the base 112 D, and that helps retain the latch member 160D in the latched position by increasing the friction engagement force between the parts.

Figure 48:
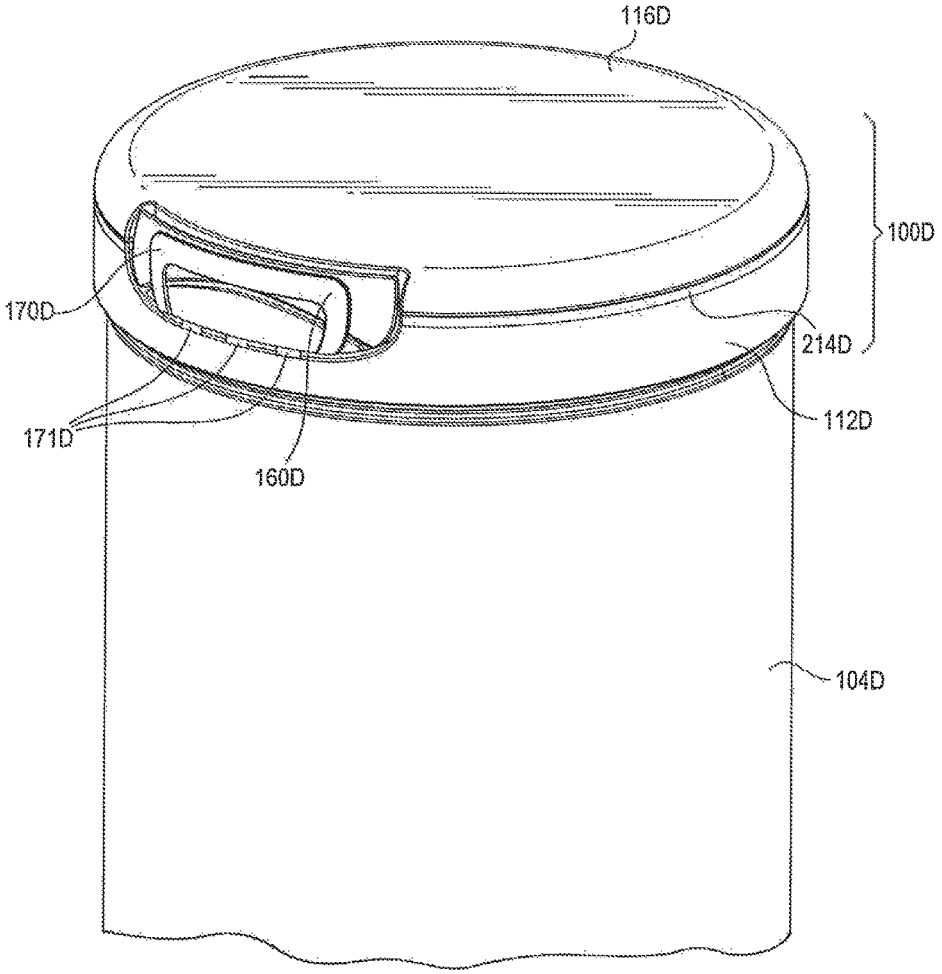
FIG. 48 is a fragmentary, perspective view taken from above of a fifth embodiment of a closure of the present invention shown in a closed condition installed on a container in which a product may be stored—the closure, container, and product therein together constituting a "package"
Figure 49:
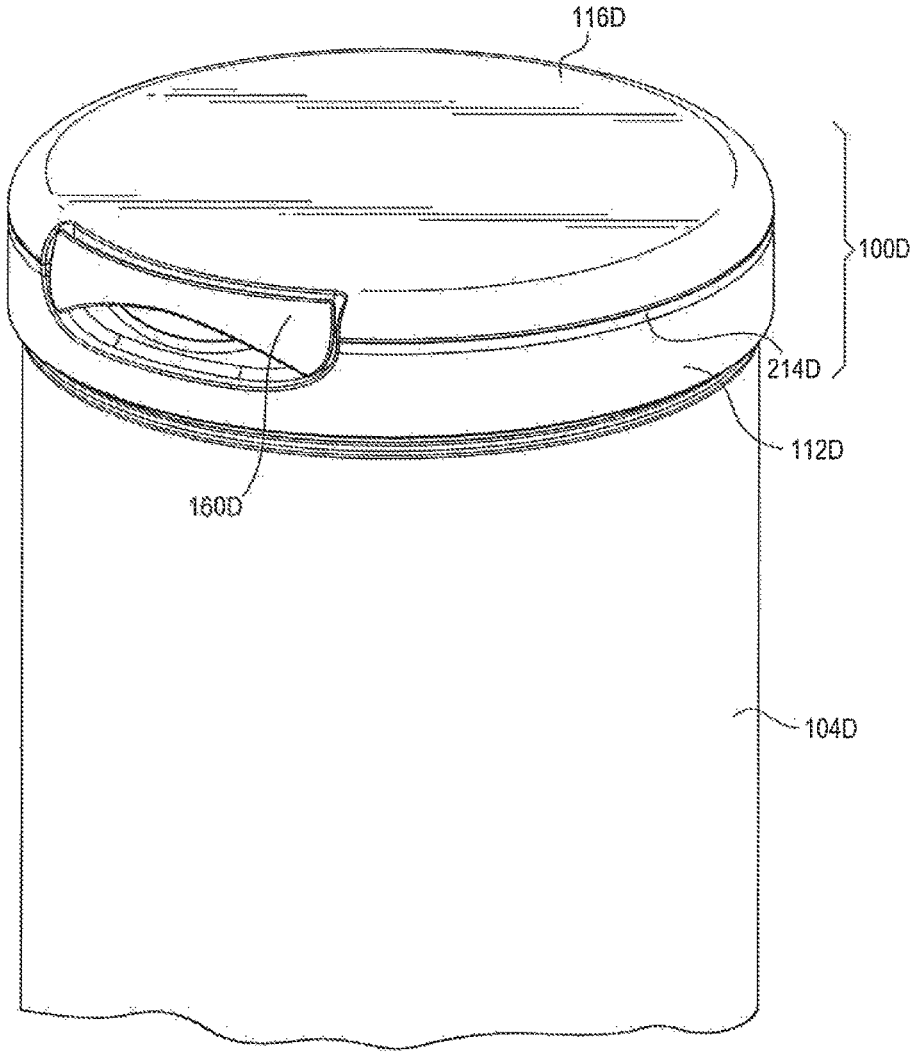
FIG. 49 is a fragmentary, perspective view similar to FIG. 48, but in FIG. 49 a tamper-evident member that is visible in FIG. 48 has been removed from the closure.
Figure 50:
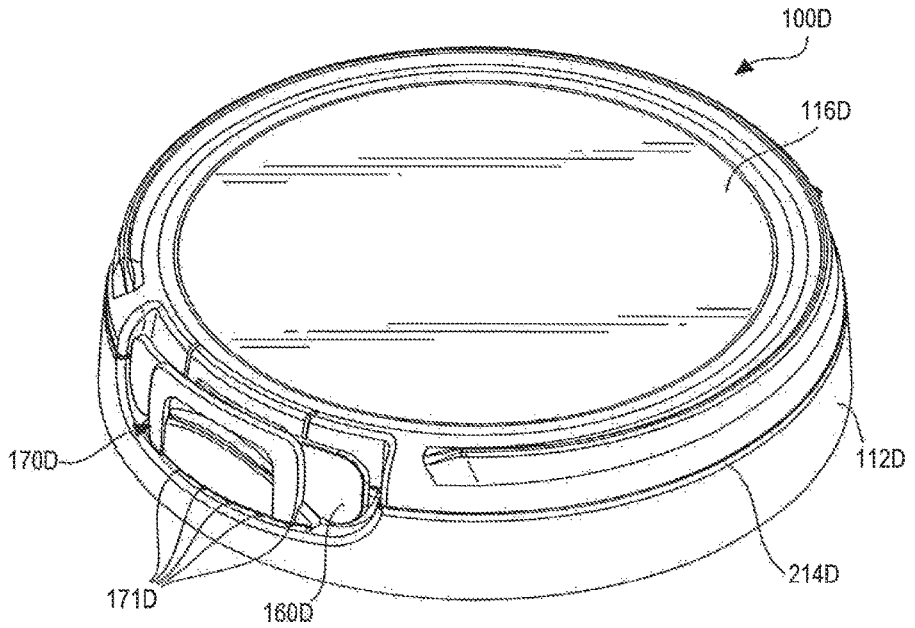
FIG. 50 is a perspective view taken from above of just the closure of the package of FIG. 47, the closure being shown in FIG. 50 in a closed condition as initially manufactured.
Figure 51:
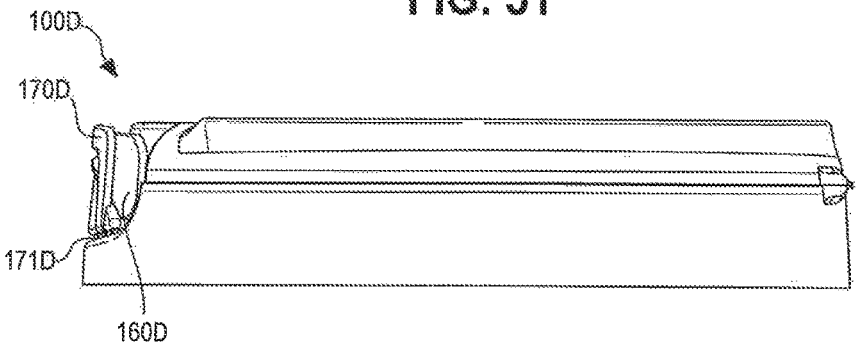
FIG. 51 is a side elevation view of the closure shown in FIG. 50.
Figure 52:
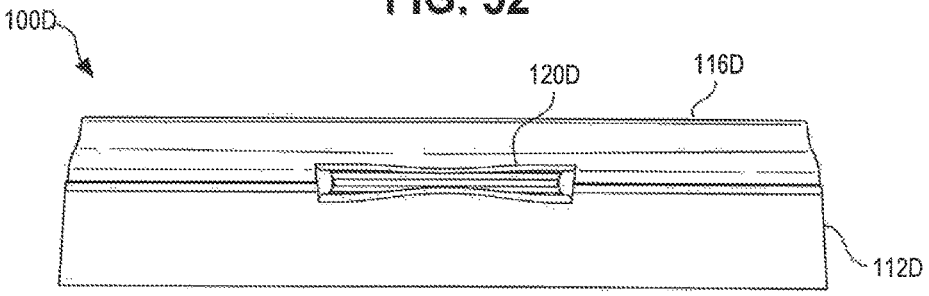
FIG. 52 is a rear elevation view of the closure shown in FIG. 50.
Figure 53:
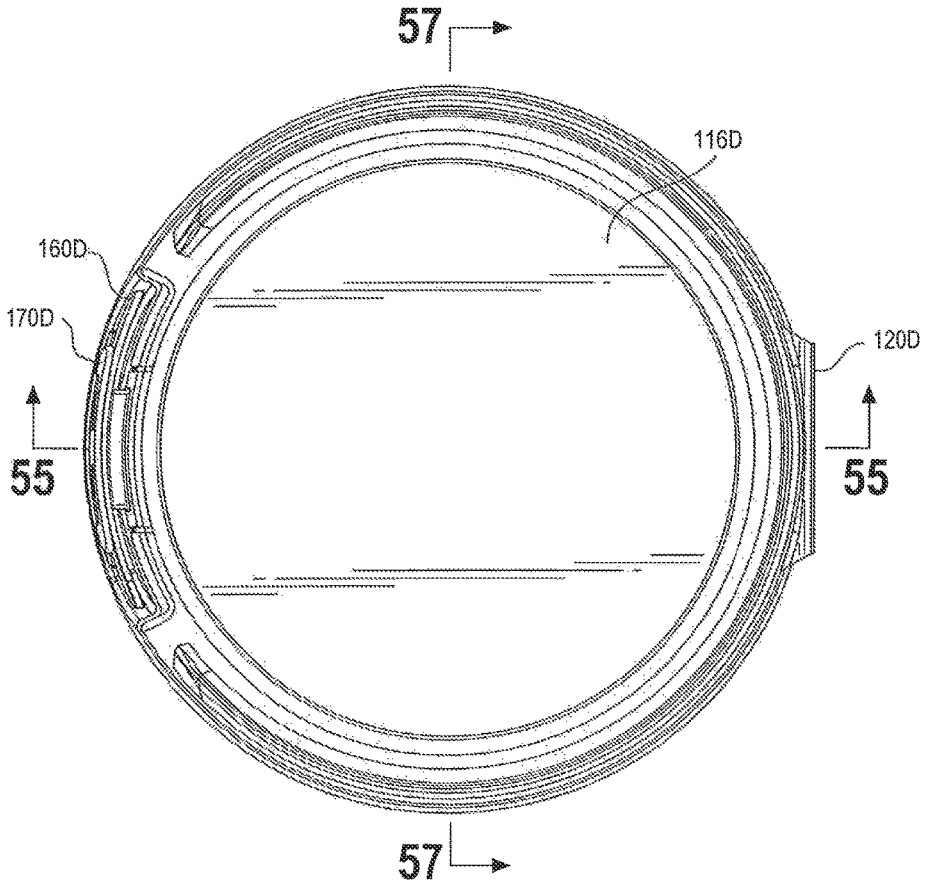
FIG. 53 is a top plan view of the closure shown in FIG. 50.
Figure 54:
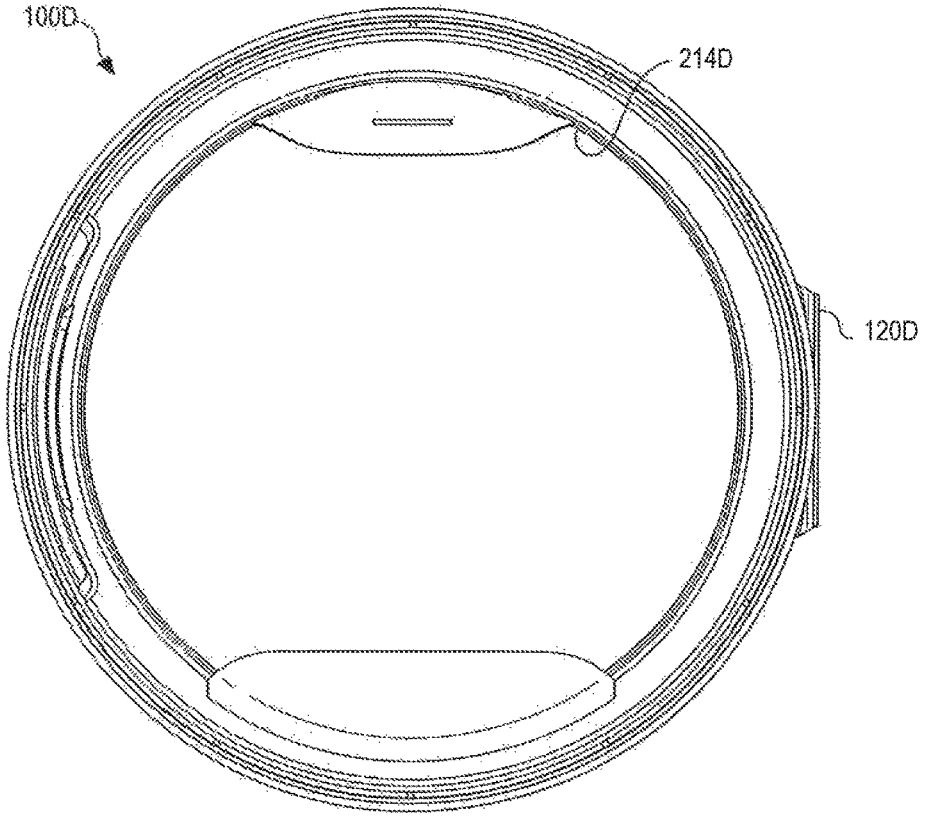
FIG. 54 is a bottom plan view of the closure shown in FIG. 50.
Figure 55:
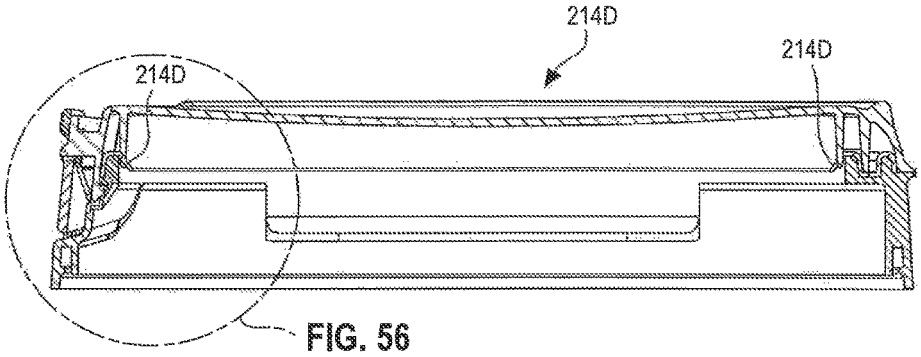
FIG. 55 is a cross-sectional view of the closure taken along the plane 55-55 in FIG. 53.
Figure 60:
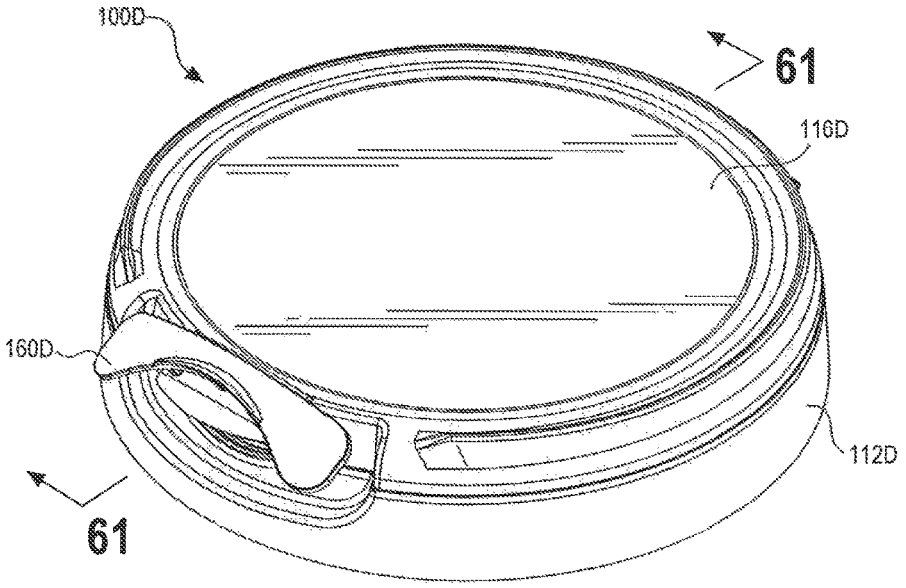
FIG. 60 is a perspective view taken from above of just the closure of FIG. 50, but FIG. 60 shows the tamper-evident member removed from the closure.
Figure 61:
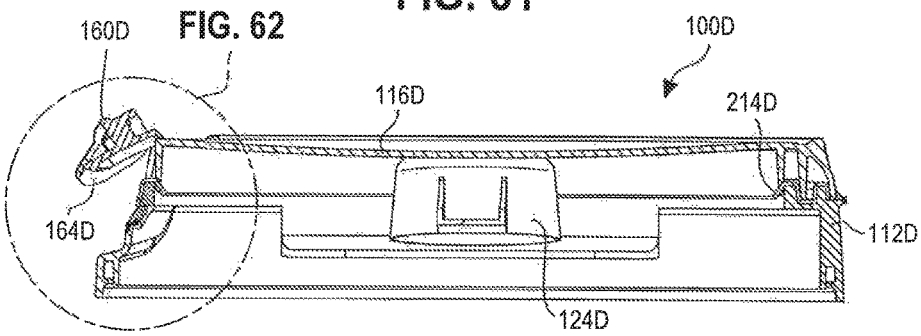
FIG. 61 is a cross-sectional view of the closure taken along the plane 61-61 in FIG. 60.
Figure 62:
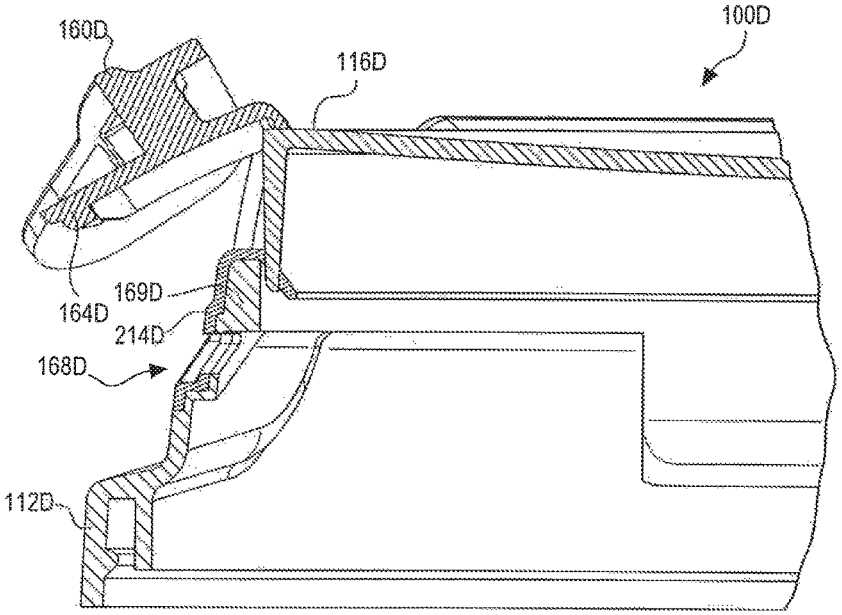
FIG. 62 is an enlarged, fragmentary, cross-sectional view of a front portion of the closure shown in FIG. 61.
Figure 63:
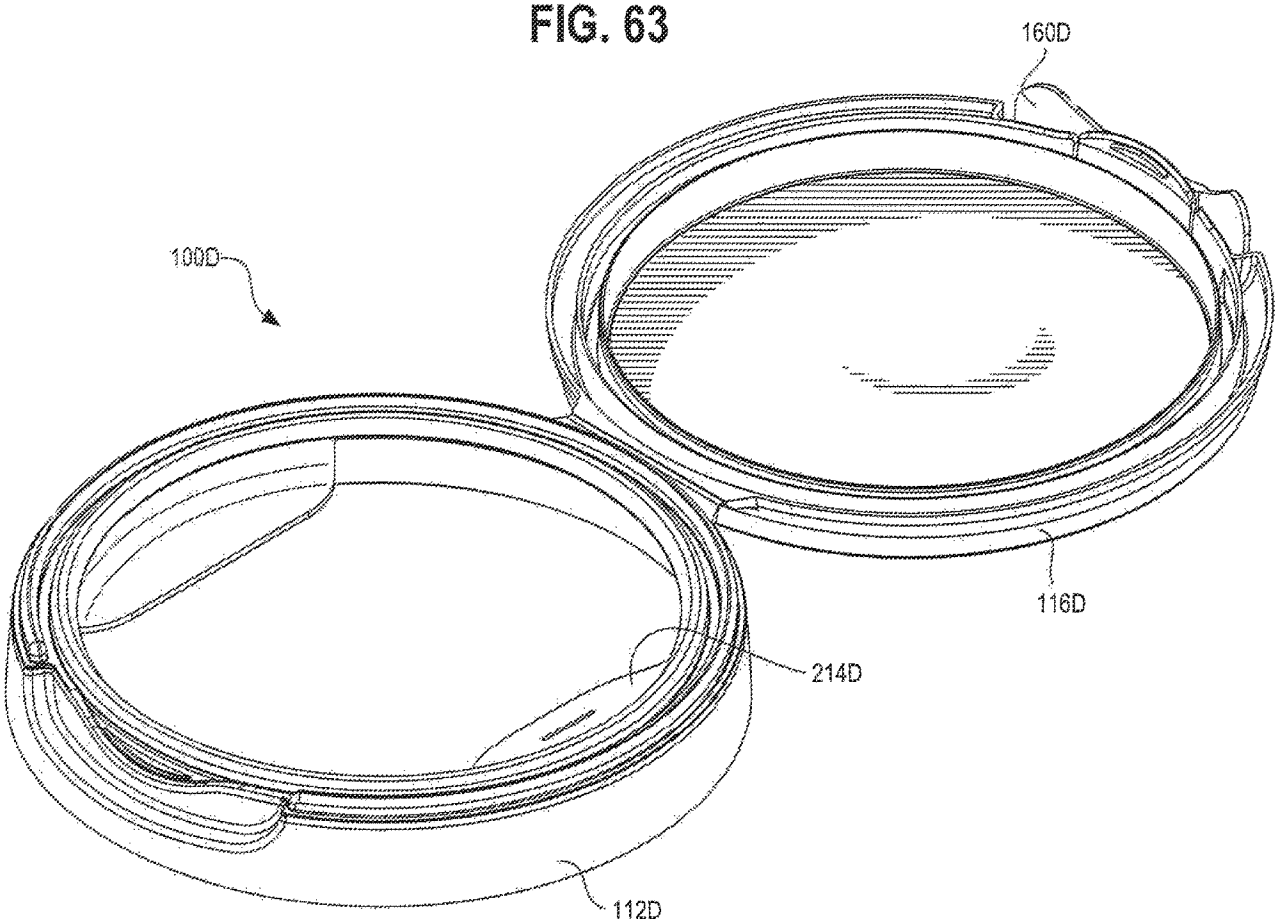
FIG. 63 is a perspective similar to FIG. 60, but in FIG. 63 the closure is shown with the lid in the open position.
Figure 64:
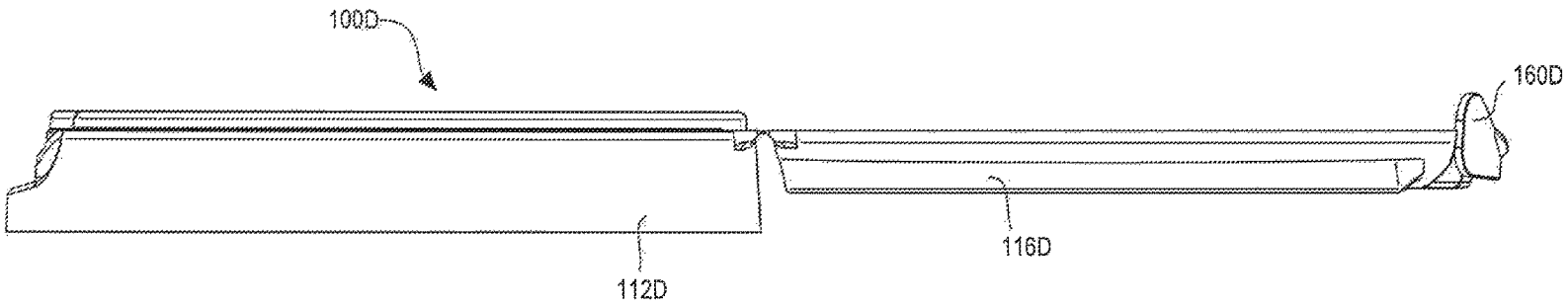
FIG. 64 is a side elevation view of the closure shown in FIG. 63.
Figure 65:
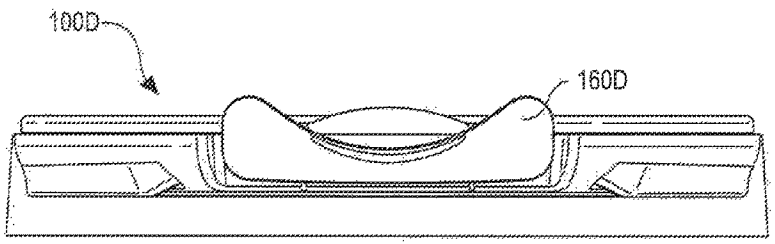
FIG. 65 is a rear elevation view of the closure shown in FIG. 63.
Figure 66:
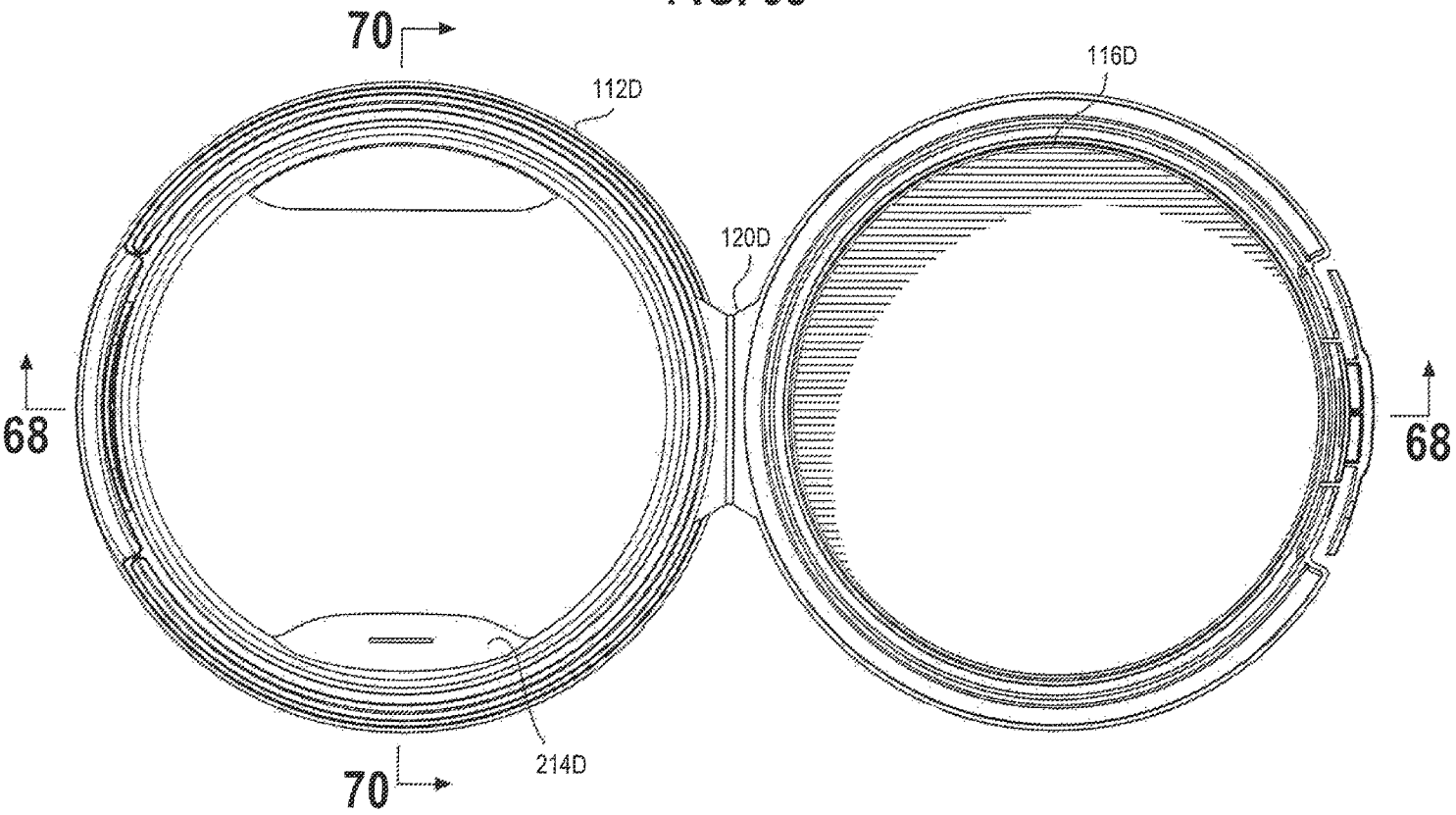
FIG. 66 is a top plan view of the closure shown in FIG. 63.
Figure 67:
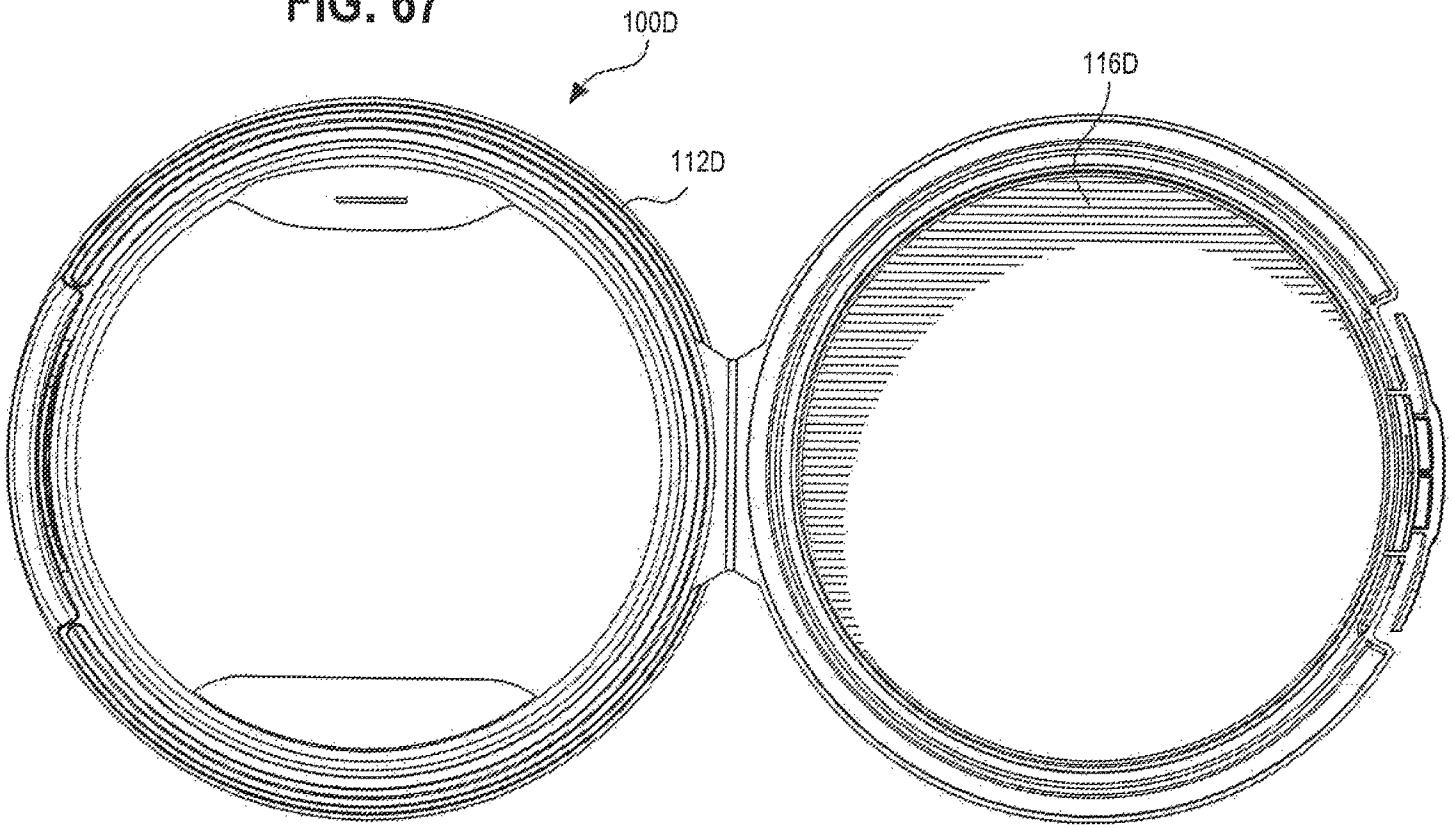
FIG. 67 is a bottom plan view of the closure shown in FIG. 63.
Figure 68:
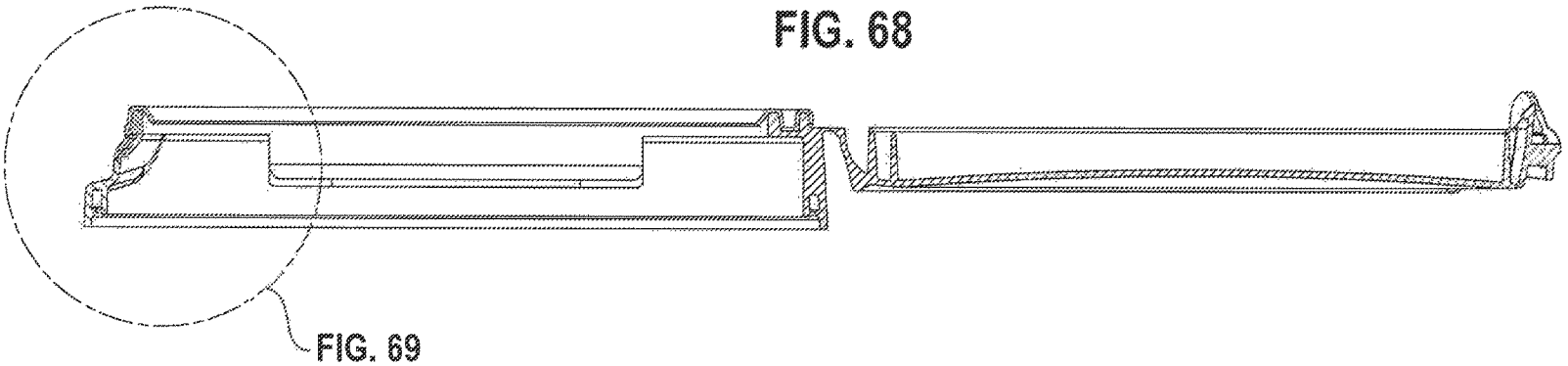
FIG. 68 is a cross-sectional view of the closure taken along the plane 68-68 in FIG. 66.
Figure 69:
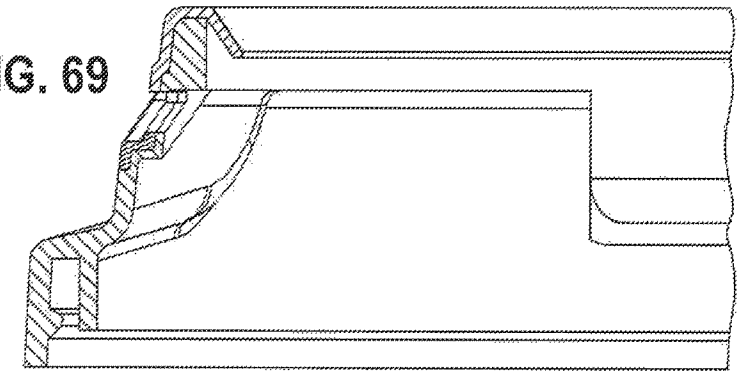
FIG. 69 is an enlarged, fragmentary, cross-sectional view of a front portion of the closure shown in FIG. 68.
Figure 70:
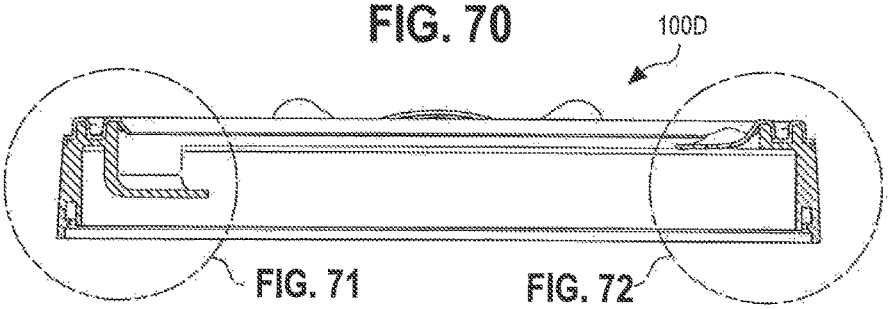
FIG. 70 is a cross-sectional view of the closure taken along the plane 70-70 in FIG. 66.
Figure 71:
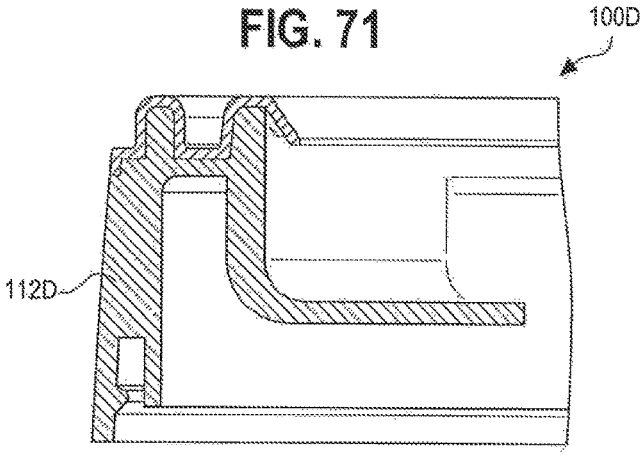
FIG. 71 is an enlarged, fragmentary, cross-sectional view of a right side portion of the closure shown in FIG. 70.
Figure 72:
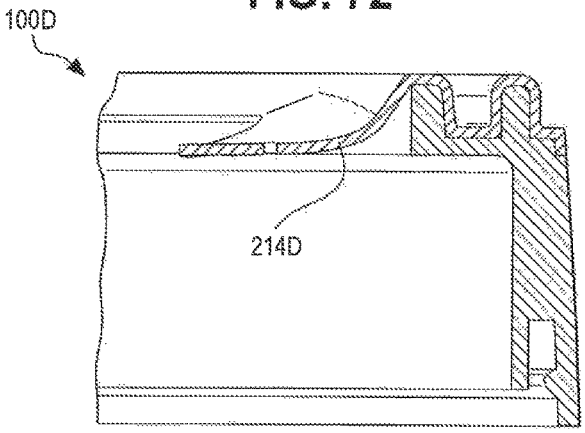
FIG. 72 is an enlarged, fragmentary, cross-sectional view of a left side portion of the closure shown in FIG. 70
Figure 73:
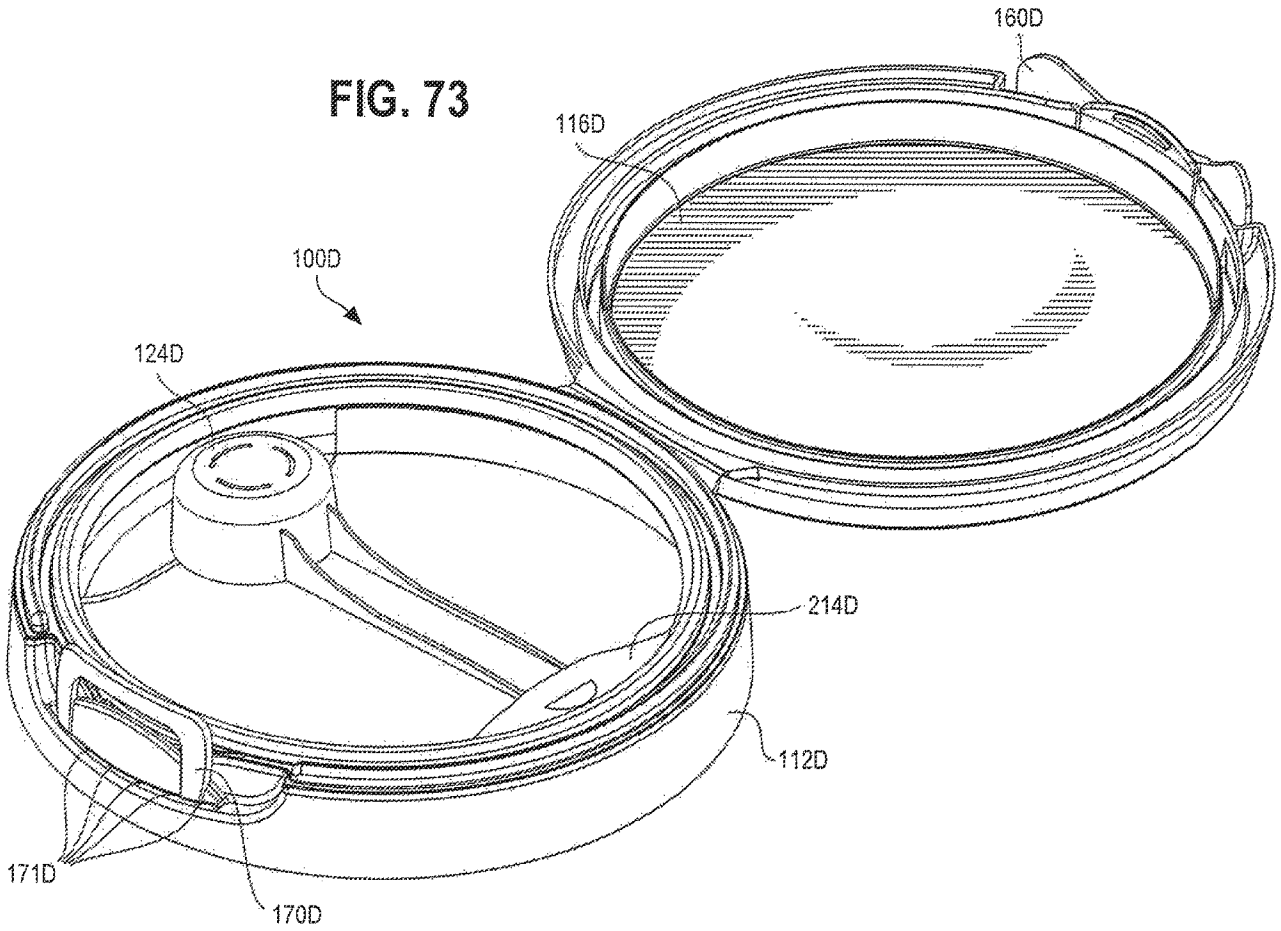
FIG. 73 is a perspective view taken from above the closure shown in FIG. 50, but in FIG. 73 the closure is shown with the lid in the open position and with a utensil stored on an extending platform portion of the closure body/lid seal.
Figure 74:
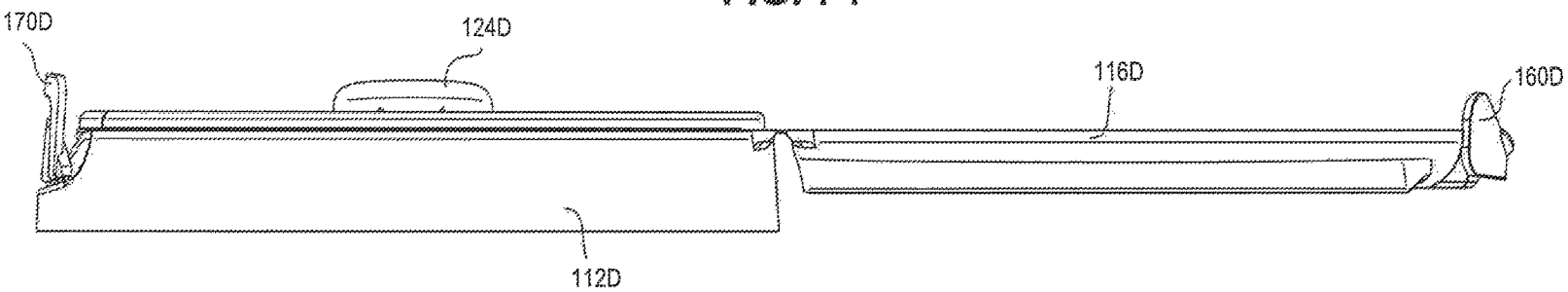
FIG. 74 is a side elevation view of the closure shown in FIG. 73.
Figure 75:
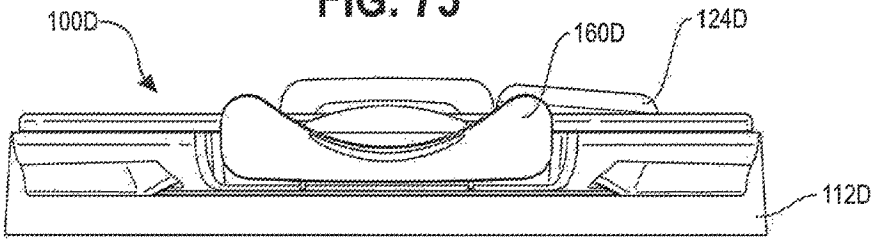
FIG. 75 is a rear elevation view of the closure shown in FIG. 73.
Figure 76:
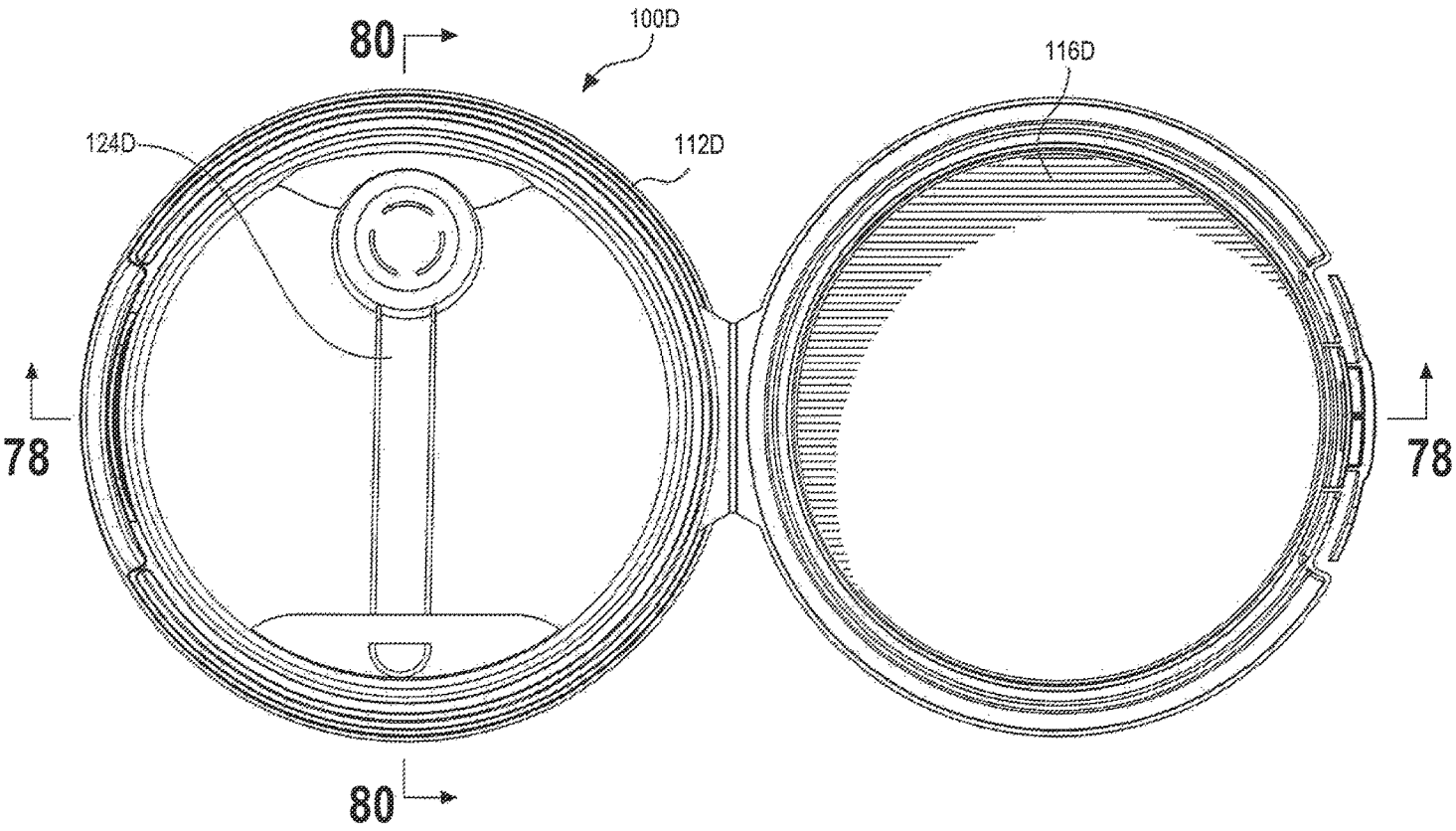
FIG. 76 is a top plan view of the closure shown in FIG. 73.
Figure 77:
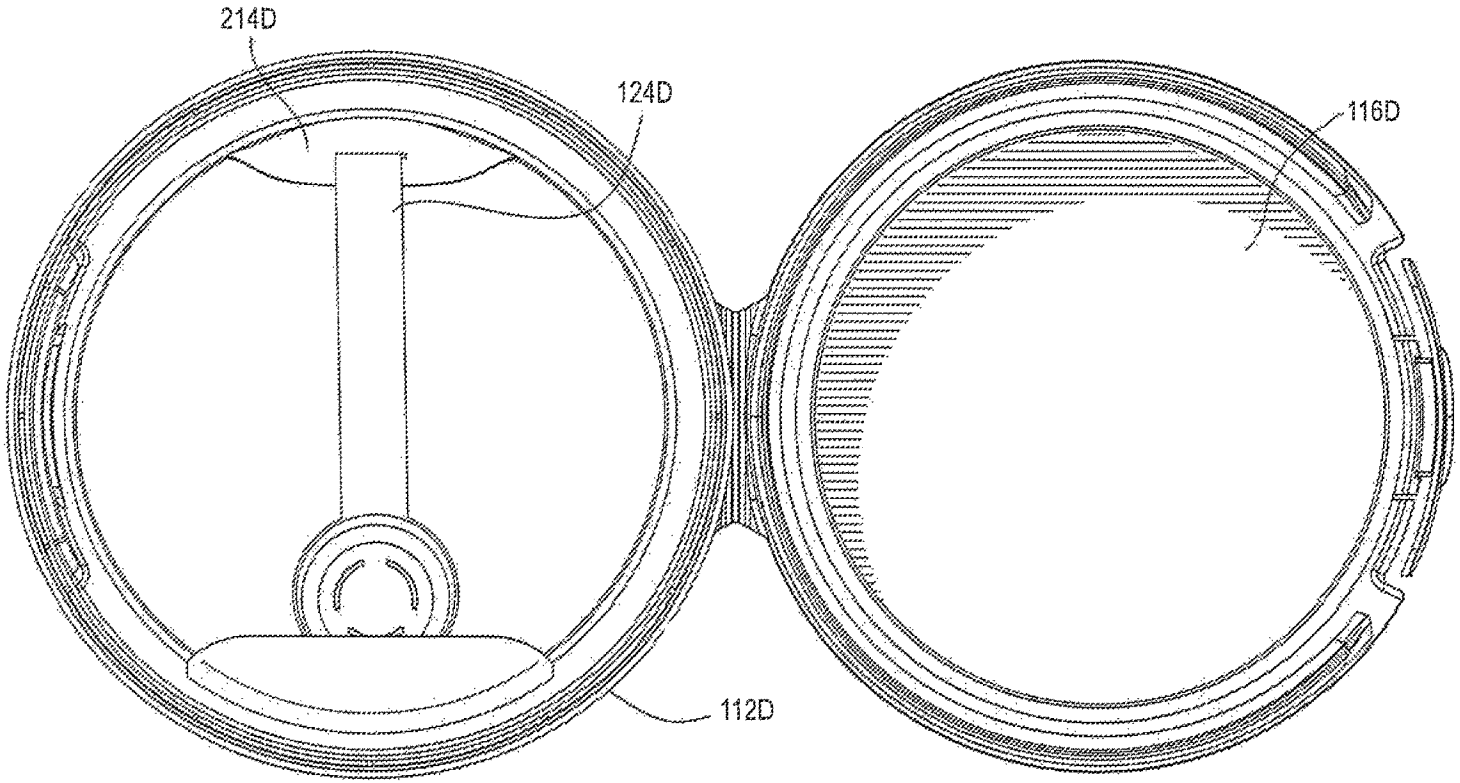
FIG. 77 is a bottom plan view of the closure shown in FIG. 73.
Figure 78:
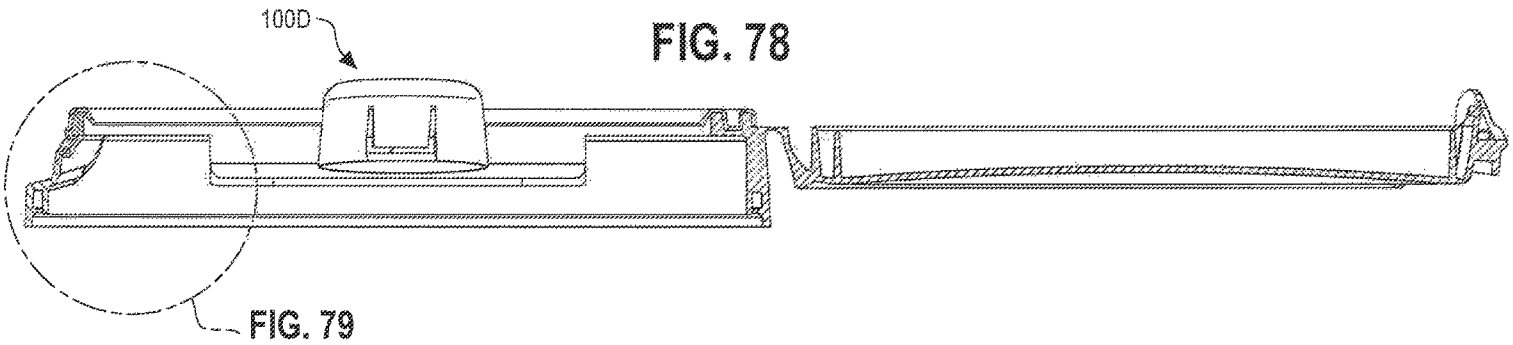
FIG. 78 is a cross-sectional, side elevation view of the closure taken along the plane 78-78 in FIG. 76.
Figure 79:
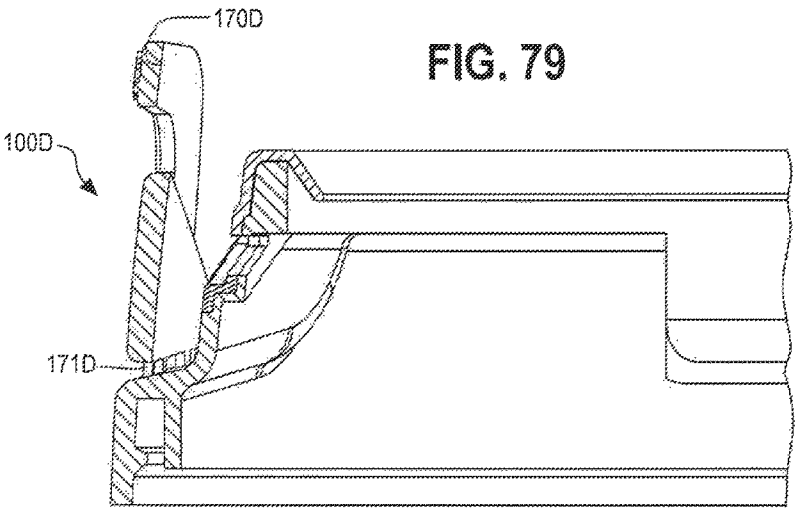
FIG. 79 is an enlarged, fragmentary, cross-sectional view of a front portion of the closure shown in FIG. 78.
Figure 80:
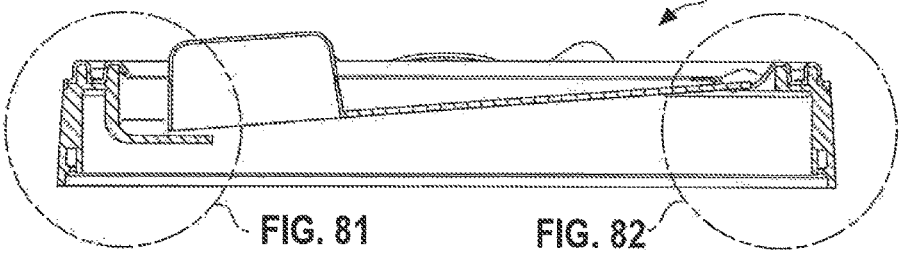
FIG. 80 is a cross-sectional view of the closure taken along the plane 80-80 in FIG. 76.
Figure 81:
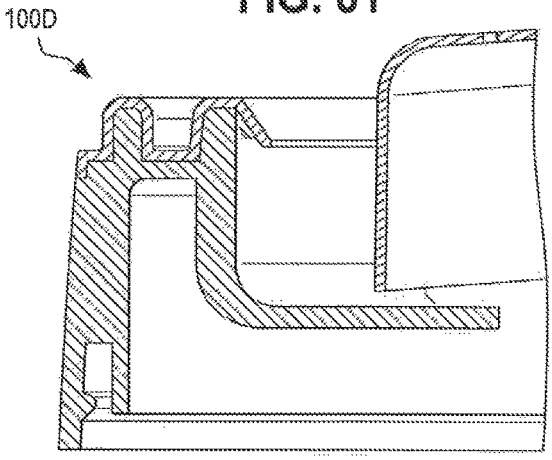
FIG. 81 is an enlarged, fragmentary, cross-sectional view of a right side portion of the closure shown in FIG. 80.
Figure 82:
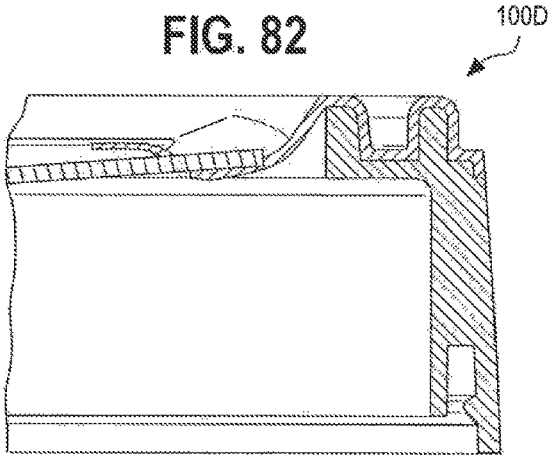
FIG. 82 is an enlarged, fragmentary, cross-sectional view of a left side portion of the closure shown in FIG. 80.

Closure 100D also has an optional tamper-evident member 170D that is initially frangibly connected to part of the rest of the base 112D by a plurality of frangible connections 171D (FIGS. 73 and 48). Tamper-evident member 170D confronts at least a portion of the latch member 160D when the latch member 160D is initially in the latched position (FIGS. 48, 50, and 51) to prevent the latch member 160D from being moved by a user from the latched position to the unlatched position. When a user exerts a sufficient bending or pulling force on the tamper-evident member 170D, the tamper-evident member frangible connections 171D are broken, and the tamper-evident member 170D is separated and can be removed from the closure base 112D by the user. Then the user can move the latch member 160D from the latched position (FIGS. 48-50) to the unlatched position (FIGS. 60 and 61).

It will be appreciated that, in another embodiment (not illustrated), the latch member 160D may have one or more apertures (not illustrated) instead of the bead 164D, and such apertures could receive one or more beads (not illustrated) located on the closure base 112D in place of the base aperture 168D.

It will be further appreciated that in an alternative embodiment (not illustrated), the tamper-evident member 170D could be located on the lid 116D of the closure 100D instead of on the base 112D while latch member 160D could be pivotally connected to the base 112D instead of to the lid 116D.

Furthermore, in another embodiment (not illustrated) the closure 100D need not have any tamper-evident member 170D at all.

Figure 83:
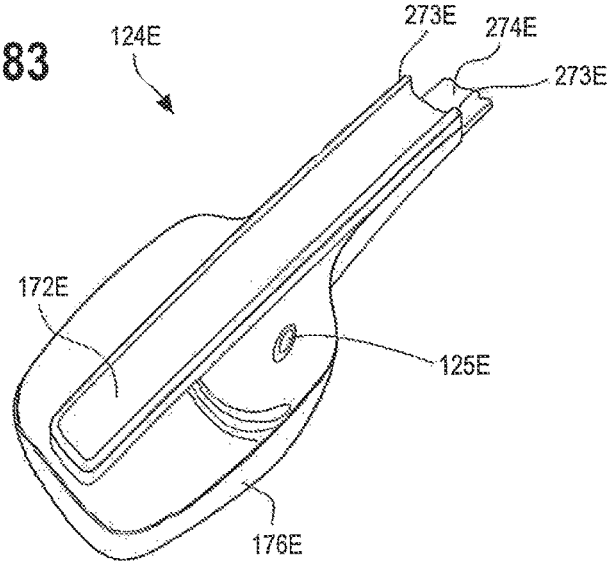
FIG. 83 is a perspective view taken from above another embodiment of a utensil that can be used with a closure of the present invention.
Figure 84:
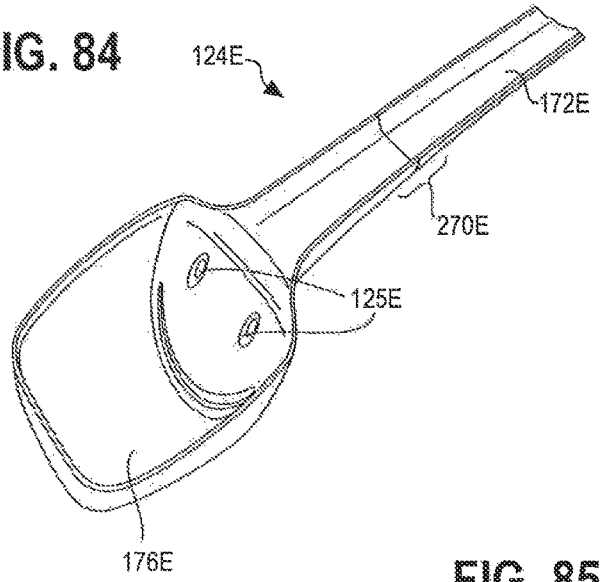
FIG. 84 is a perspective view similar to FIG. 83, but in FIG. 84 the utensil is shown in a longer, deployed "use" configuration.
Figure 85:
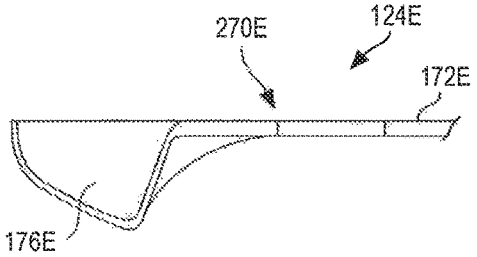
FIG. 85 is a side elevation view of the deployed configuration of the utensil shown in FIG. 84.

FIGS. 83-85 illustrate another embodiment of a utensil 124E according to one aspect of the present invention. Utensil 124E includes handle portion 172E for being grasped by a user of the utensil 124E, and the utensil 124E has a utility portion 176E for engaging (e.g., stirring or cutting or removing) a product stored within a container (not illustrated in FIGS. 83-85). In the embodiment illustrated in FIGS. 83-85, utensil 124E is a handled spoon or scoop, and utility portion 176E is a scoop portion defining an open-ended receptacle that defines a cavity or recess for holding some substance (e.g., some product stored in a container). Handle portion 172E is connected to the utility portion 176E by a hinge 270E (FIG. 84). Hinge 270E allows the utensil 124E to have a stored configuration (FIG. 83) wherein the handle portion 172E is pivoted to a location adjacent the utility portion 176E. Hinge 270E further allows the utensil 124E to have a deployed configuration (FIGS. 84 and 85) wherein the handle portion 172E is pivoted away from the utility portion 176E. Utensil has a support portion 274E that extends away from the utility portion 176E for supporting the handle portion 172E when the handle portion 172E is in the deployed configuration. The support portion 274E is visible in FIG. 83, but is hidden from view in FIGS. 84 and 85 by a lateral, longitudinal flange 273E (FIG. 83) along each edge of the handle portion 172E. The flanges 273E frictionally engage the support portion 274E to retain the utensil handle portion 172E in the deployed configuration.

The inventors have found that the utensil 124E with a stored configuration and a deployed configuration allows for a utensil 124E to be stored in a suitable container while the utensil is in its stored configuration even though the length of the utensil 124E in the deployed configuration is larger than the opening of the container.

In a broad concept of one aspect of the invention, the utensil 124E need not have a hinge 270E connecting the utility portion 176E and the handle portion 172E, and instead the utensil 124E may have other retaining structures such as pin and slot, offset walls, or other structures for frictionally or otherwise securing the utility portion 176E and the handle portion 172E in the deployed configuration. Depending on the arrangement for retaining the utensil 124E in the deployed configuration, the portion 274E could be omitted.

The illustrated utensil 124E has the form of a spoon or shallow scoop with a plurality of vents or holes to prevent or at least minimize air pockets from forming when scooping granular product. Minimization of air pockets ensures that the user obtains an intended volume when scooping product from the container (not illustrated). It will be understood that other types of utensils could readily be implemented in accordance with other embodiments of the invention, such as a deeper scoop, ladle, knife, fork, spear, or other structure, particularly those having an elongated handle. For example, in an embodiment featuring a fork utensil (not illustrated), the utility portion may include a plurality of fork tines, while in an embodiment featuring a knife utensil (not illustrated), the utility portion may include a cutting edge.

Figure 86:
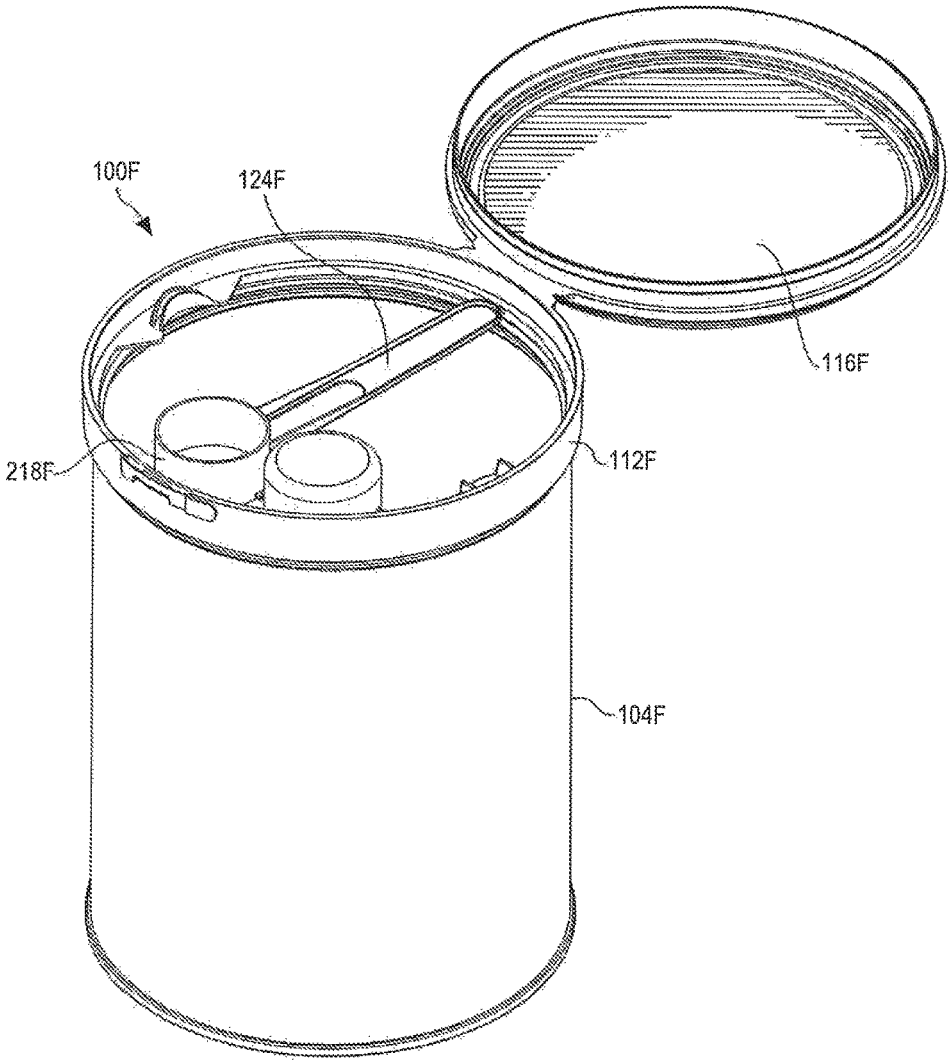
FIG. 86 is a perspective view taken from above another embodiment of a utensil that can be used with a closure of the present invention.
Figure 87:
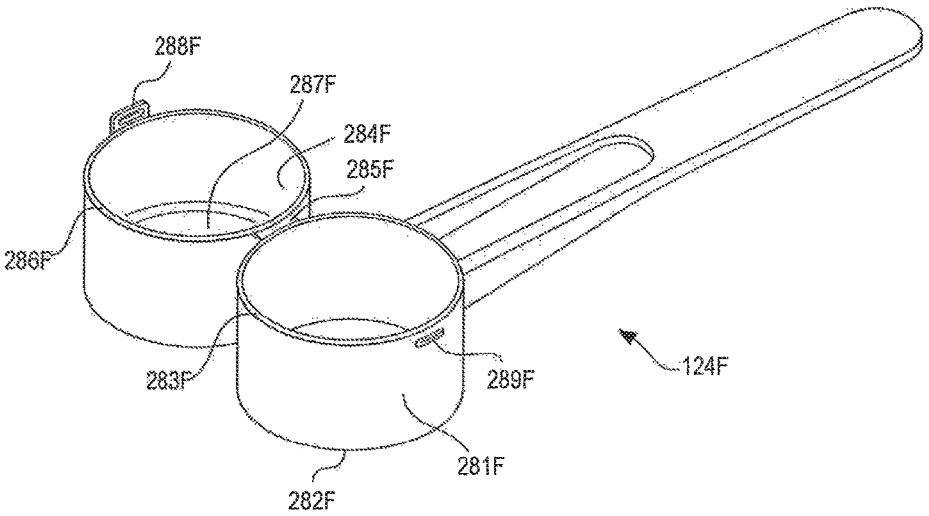
FIG. 87 is a perspective view of only the utensil of FIG. 86, and in FIG. 87 the utensil is shown in a storage, "non-use," configuration.
Figure 88:
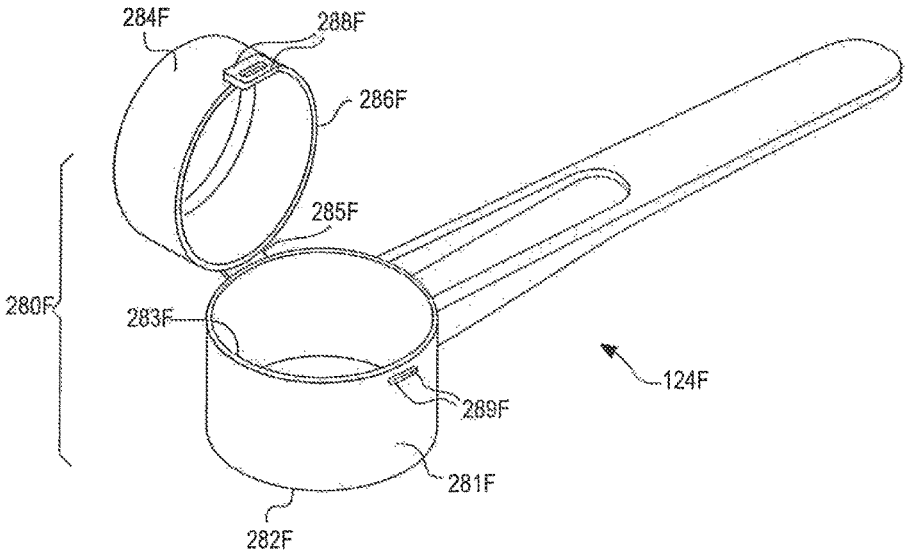
FIG. 88 is a perspective view the utensil shown in FIG. 87, and in FIG. 88 the utensil is shown in another configuration that is intermediate between the storage configuration and a "use" configuration.
Figure 89:
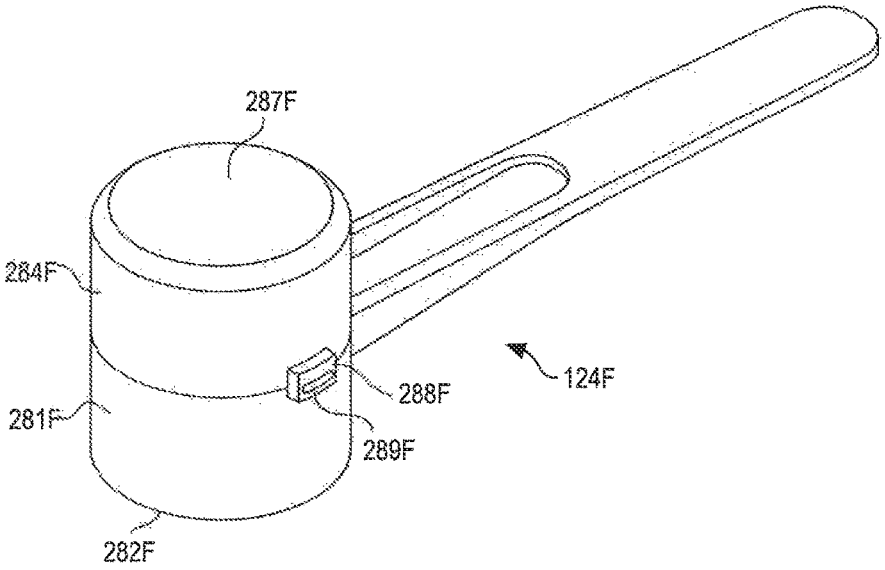
FIG. 89 is a perspective view the utensil shown in FIG. 87, and in FIG. 89 the utensil is shown in a use configuration.
Figure 90:
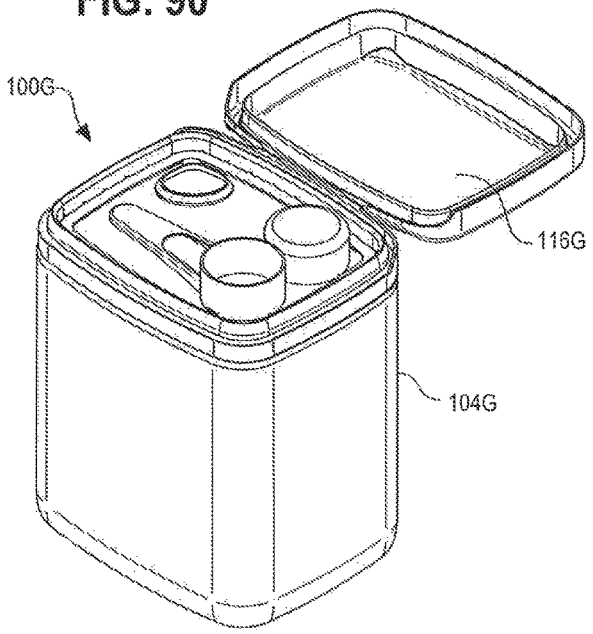
FIG. 90 is a perspective view taken from above of another embodiment of a utensil that can be used with a closure of the present invention.

FIGS. 86-89 illustrate another embodiment of a utensil 124F according to another aspect of the present invention for use with a closure 100F for a container 104F. Utensil 124F includes handle portion 172F for being grasped by a user of the utensil 124F, and the utensil 124F has a scoop portion 280F for removing a product stored within a container 104F. The scoop portion 280F has a top part 281F having an open top end 282F and an open bottom end 283F, and a through passage extending from the open top end 282F to the open bottom end 283F. The scoop portion 280F further has a bottom part 284F connected to top part 280F by a hinge 285F (FIG. 88). Bottom part 284F has an open top end 286F (FIGS. 87 and 88) and a closed bottom end 287F (FIGS. 87 and 89).

FIG. 89 shows a "use" configuration of the utensil 124F in which the top part 281F and bottom part 284F are engaged so that said top part open bottom end 283F confronts the bottom part open top end 286F. A latch member 288F extends from the bottom part 284F and defines an aperture for receiving a bead 289F that extends from the top part 281F.

FIG. 87 shows a "storage" configuration of the utensil 124F in which the top part 281F and bottom part 284F are moved away from the use configuration. The "storage" configuration is also the configuration in which the utensil is initially molded in, and as part of, the closure 100F using frangible bridges as illustrated in FIG. 86.

The inventors have found that the utensil 124F with such a "storage" configuration and a "use" configuration allows for the utensil 124F having a deep scoop portion 280F to be integrally molded in the storage configuration with closure 100F that has a relatively low profile (i.e., low height)—especially in an alternate embodiment (not illustrated) where the bottom of the closure 100F or top of the container 104F initially includes a removable liner (i.e., sealing membrane) across the opening below the utensil. As can be seen in FIG. 86, the storage configuration of the utensil 124F permits the lid 116F to have a shorter height, thus reducing the amount of material needed for manufacturing the closure 100F and also providing a more aesthetically appealing configuration.

If desired, after use, the utensil 124F can be opened to the "storage" configuration and stored in the closure body 112F on suitable diametrically opposite support projections (visible in FIG. 86) so as to orient the utensil 90 degrees from the initial, "molded-in" orientation as provided by the manufacturer.

In a broad concept of one aspect of the invention, the utensil 124F need not have a hinge 285F connecting the top part 281F and bottom part 284F, and instead the utensil 124F may have other latching or retaining structures (not illustrated) such as pin and slot, offset walls, or other such structures for frictionally, or otherwise, securing the top and bottom parts 281F, 284F together in the use configuration. With such alternative connecting structures, the utensil 124F may not need to have the latch member 288F or cooperating bead 289F.

Figure 94:
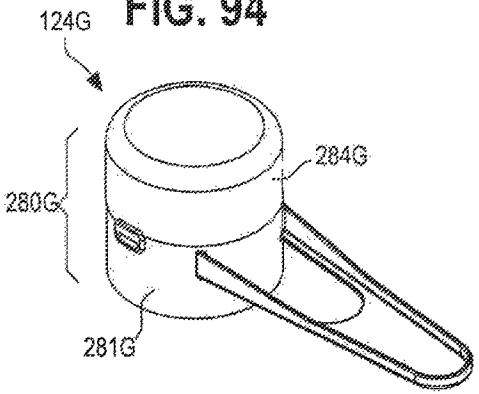
FIG. 94 is a perspective view the utensil shown in FIG. 92, and in FIG. 94 the utensil is shown in a "use" configuration.
Figure 93:
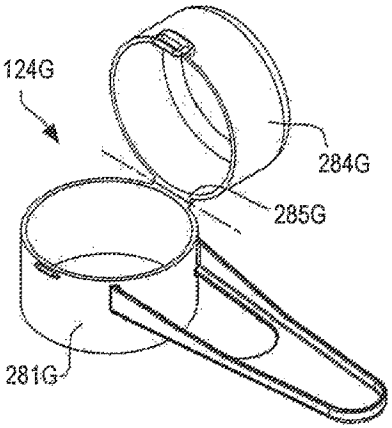
FIG. 93 is a perspective of the utensil shown in FIG. 92, and in FIG. 93 the utensil is shown in another configuration that is intermediate between the "non-use" configuration and a "use" configuration.
Figure 92:
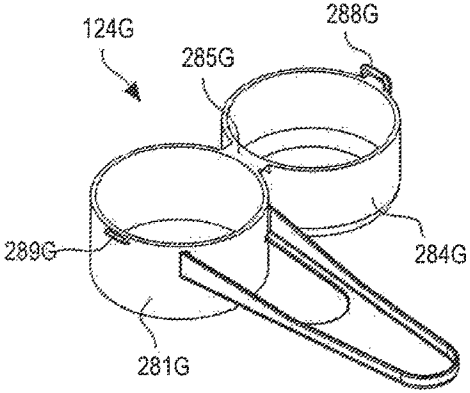
FIG. 92 is a perspective view of only the utensil shown in FIG. 90, and in FIG. 92 the utensil is shown in a "non-use" configuration.
Figure 95:
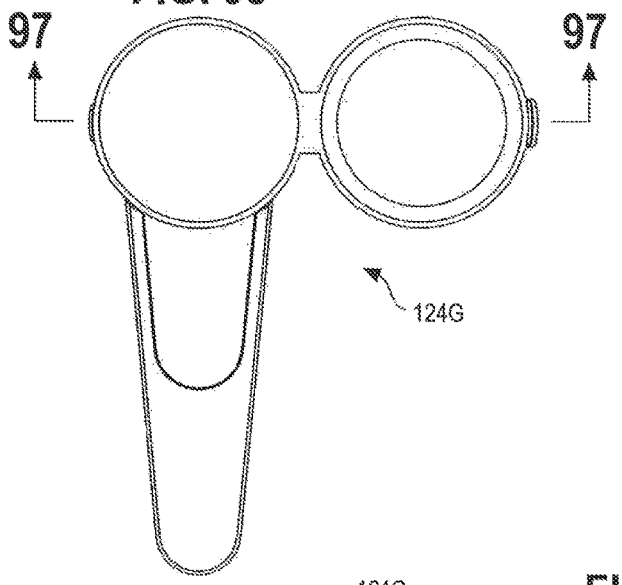
FIG. 95 is a top plan view of the utensil shown in FIG. 92.
Figure 96:
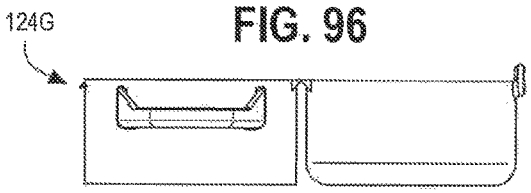
FIG. 96 is a front elevation view of the utensil of FIG. 92 wherein the "front" is facing generally toward the viewer in FIG. 92.
Figure 97:
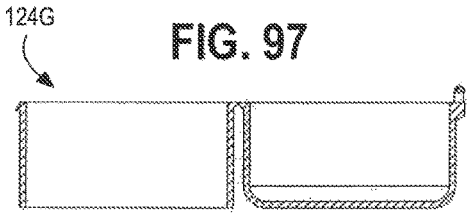
FIG. 97 is a cross-sectional view of the utensil taken along the plane 97-97 in FIG. 95.
Figure 98:
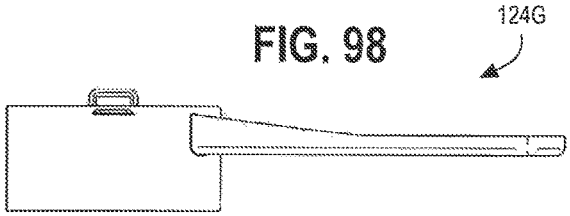
FIG. 98 is a near side (i.e., left side) elevation view of the utensil shown in FIG. 92.
Figure 99:
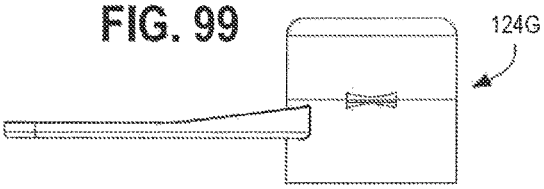
FIG. 99 is a far side (i.e., right side) elevation view of the utensil shown in FIG. 94.
Figure 100:
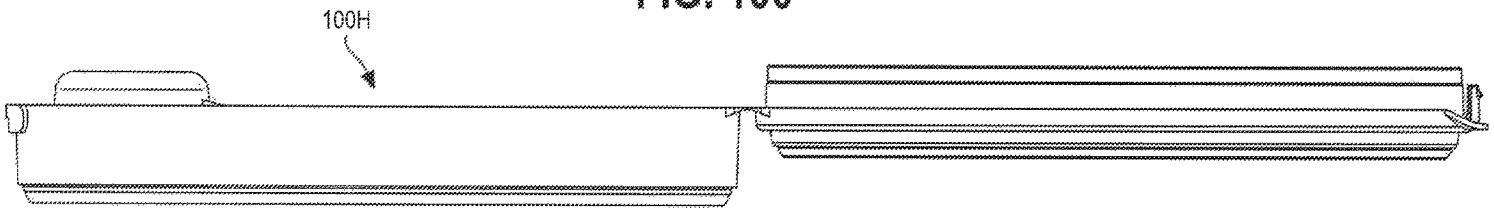
FIG. 100 is a right side elevation view of another embodiment of a closure according to the present invention.
Figure 102:
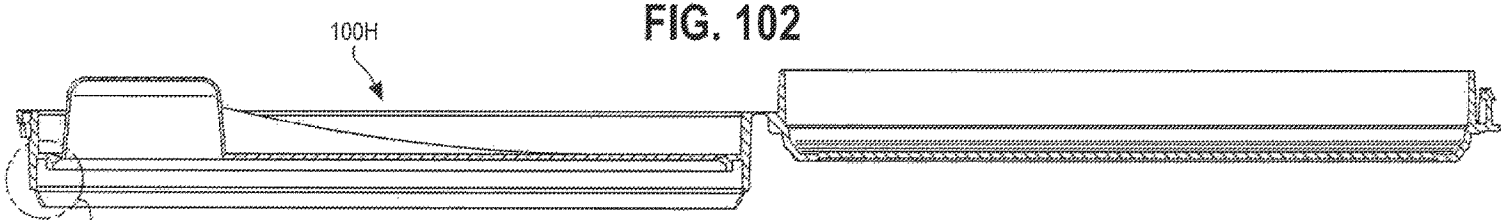
FIG. 102 is a cross-sectional view of the closure taken along the plane 102-102 in FIG. 101.

FIGS. 91-99 illustrate another embodiment of a utensil 124G having an initial storage configuration and a use configuration, and wherein according to one aspect of the present invention, the utensil 124G is provided and used with a closure 100G for a container 104G. With reference to FIG. 94, the use configuration of the utensil 124G includes handle portion 172G for being grasped by a user of the utensil 124G, and the utensil 124G has a scoop portion 280G for engaging (e.g., removing) a product stored within the container 104G. The scoop portion 280G functions analogously to scoop portion 280F discussed above with respect to the storage and use configurations illustrated in FIGS. 86-89. The utensil 124G is initially molded in its "storage" configuration as part of the closure 100G as described below.

Figure 91:
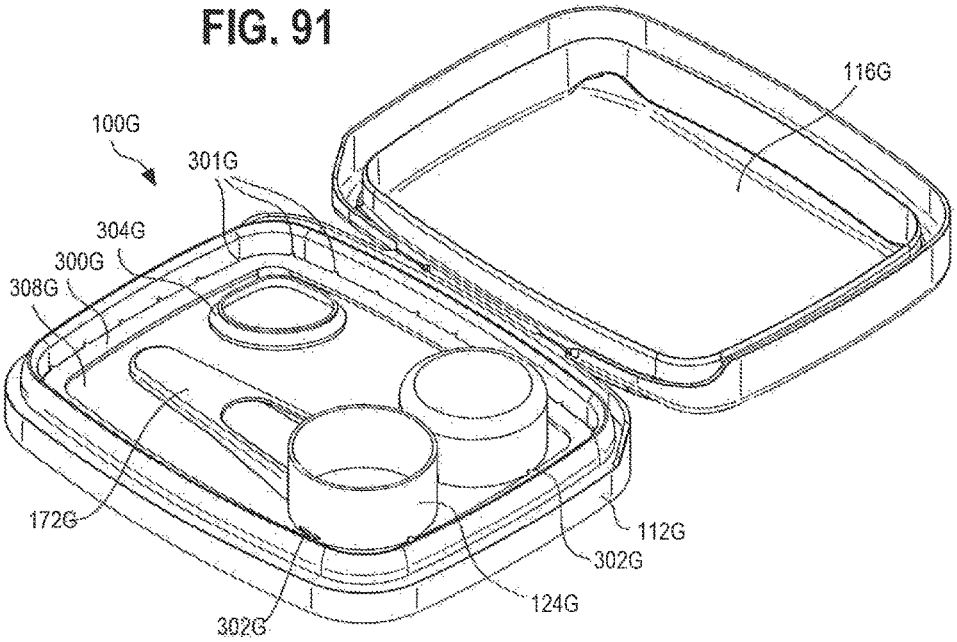
FIG. 91 is a perspective view of only the closure and utensil shown in FIG. 90.

With reference to FIG. 91, closure 100G has a separable peripheral body or ring 300G that is connected to the base 112G by a plurality of frangible connections 301G. A conventional or special membrane or liner 308G is located beneath the utensil 124G and is sealed to the underside of the ring 300G—and to the internal periphery of the closure base 112G below, and radially beyond, the ring 300G—so as to occlude the access passage of the closure 100G and seal the contents of the container 104G. The location of the liner 308G at the underside of the ring 300G also prevents contamination of the utensil 124G by the contents of the container 104G during shipping, storage, or processing of a package comprising the closure 100G on the filled container 104G.

A type of such a liner/ring system is described in the U.S. Pat. No. 7,721,901. The use of such a liner forms no part of the broad aspects of this embodiment of the invention.

As can be seen in FIG. 91, the utensil 124G has an initially-molded, storage configuration wherein the scoop portion 280G is frangibly connected to the ring 300G with frangible bridges, such as bridges 302G. Projecting from the ring 300G is a pull loop or tab 304G for being grasped by a user of the closure 100G to break the connections 301G (that join the ring 300G to the closure base 112G), and then the user can pull the loop 304G to separate the ring 300G from the remaining portion of the base 112G and remove the ring 300G (along with the still-attached utensil 124G and along with a major portion of the underlying liner 308G which tears away around the exterior of the ring 300G.) The utensil 124G could be removed from the ring 300G prior to the removal of the ring 300G from the closure, or after removal of the ring 300 and utensil 124G together from the closure 100G.

In some applications, wherein the liner 308G is employed, the liner 308G need not be sealed to the bottom of the ring 300G. In such case, removal of ring 300G (with the attached utensil 124G) enables a user to access the outer periphery of the liner 308G to tear or cut away the liner 308G around its periphery. The liner 308G may be made from a thermoplastic, foil, paper, or composite for sealing the contents in the container and inhibiting removal of the contents of the container 104G until the liner 308G is removed, pierced, or otherwise compromised by the user.

It will be understood that the location, number, and shape of the frangible connections (e.g., the frangible connections 301G between the ring 300G and the remaining portion of the closure base 112G, and/or the frangible connections 302G between the utensil 124G and the ring 300G) may vary from what is depicted in FIGS. 91-99.

Figure 103:
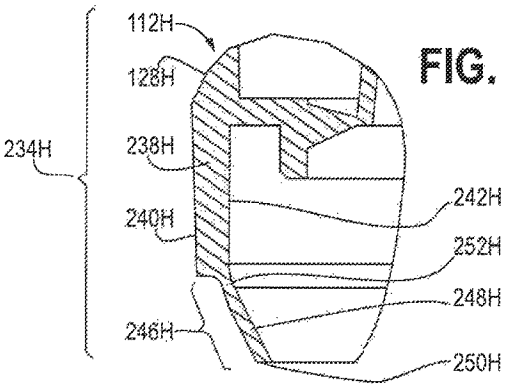
FIG. 103 is an enlarged, fragmentary, cross-sectional view of a lower skirt portion of the closure shown in FIG. 102.
Figure 101:
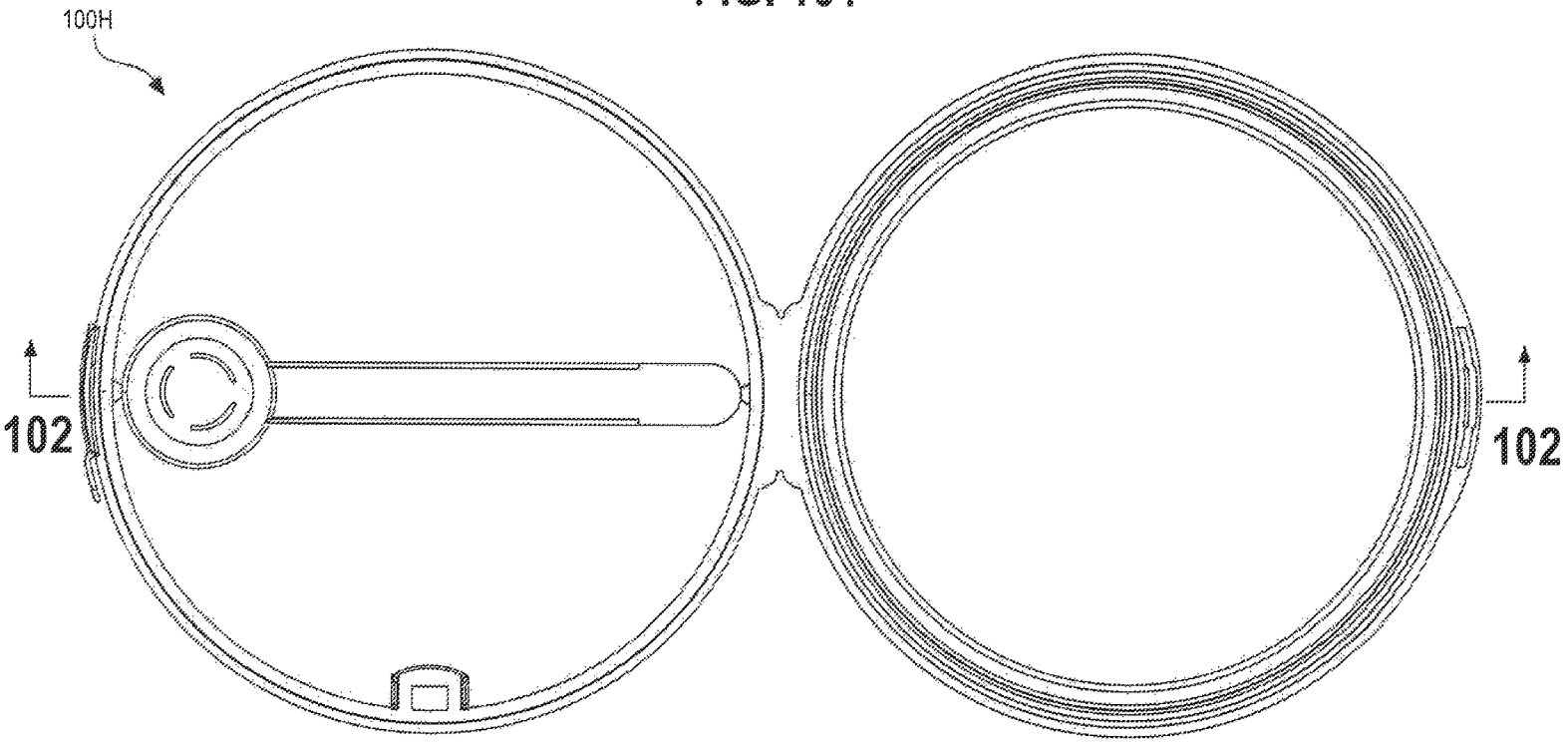
FIG. 101 is a top plan view of the closure of FIG. 100.
Figure 105:
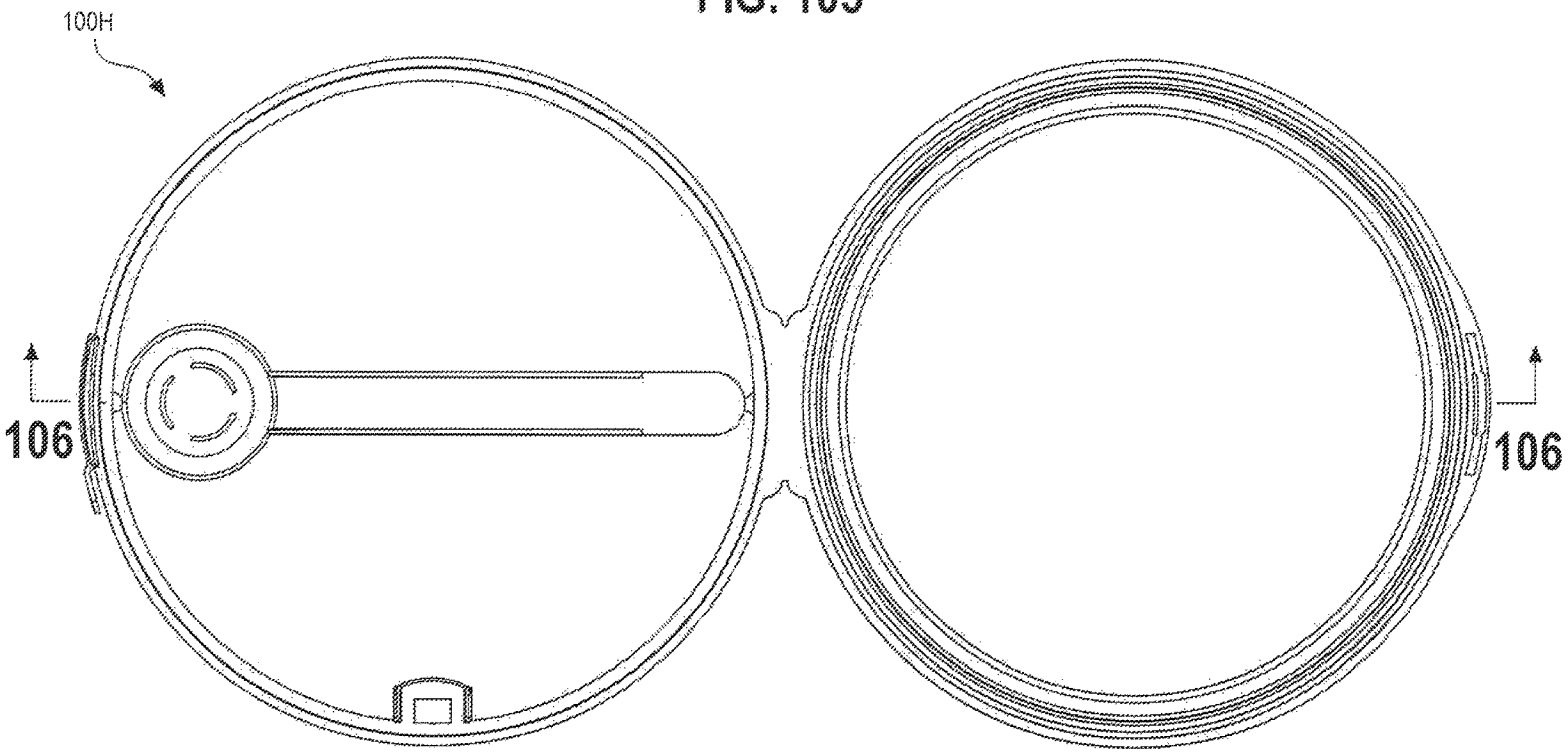
FIG. 105 is a top plan view of the package of FIG. 104.

FIGS. 100-107 illustrate another embodiment of a closure 100H according to an aspect of the present invention. Closure 100H is similar to the aforementioned closure 100C in that closure 100H includes a base 112H for being installed at an opening of a container 104H (FIG. 107) having an exterior flange 230H (FIG. 107). With reference to FIGS. 103 and 107, the closure base 112H has a skirt 128H with a lower end portion 234H for being located adjacent the container flange 230H when the base 112H is installed on the container 104H. The skirt lower end portion 234H has a first portion 238H defining an outer side 240H, an inner side 242H, and a bottom end 244H. The skirt lower end portion 234H also has a second portion 246H that includes a proximal end 248H and a distal end 250H. The skirt lower end portion 234H further includes a connecting portion 252H that connects the second portion proximal end 248H and the first portion bottom end 244H.

When the closure 100H is installed on the container 104H by moving the closure 100H down over the open end of the container 104H, the skirt connecting portion 252H accommodates an initial deflection of the second portion 246H by the container flange 230H toward the skirt first portion inner side 242H. The connecting portion 252H subsequently permits movement of the second portion 246H away from the first portion inner side 242H after the closure 100H has been installed to locate the closure base second portion distal end 250H below the container flange 230H to prevent the base 112H from being removed (i.e., uninstalled) from the container 104H.

Figure 108:
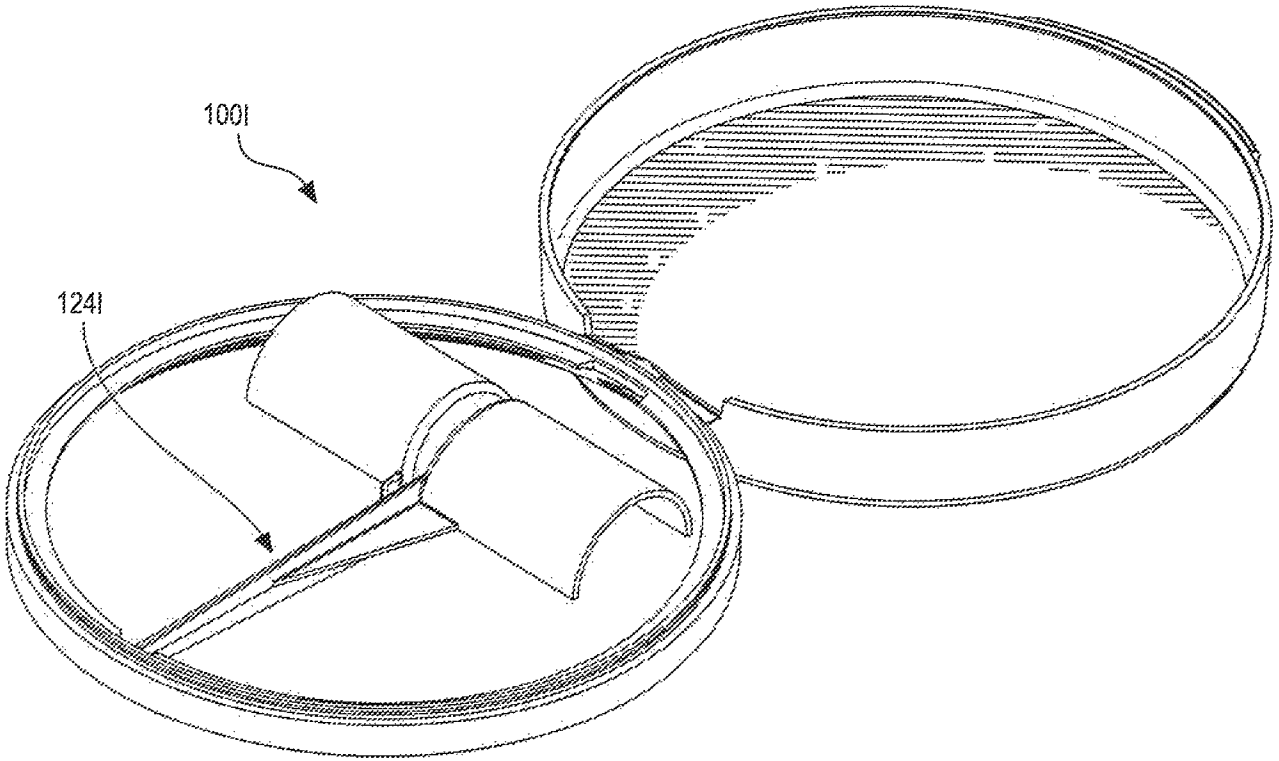
FIG. 108 is a perspective view taken from above of another embodiment of a closure of the present invention shown in the as-molded, open configuration prior to the closure being installed on a container.
Figure 109:
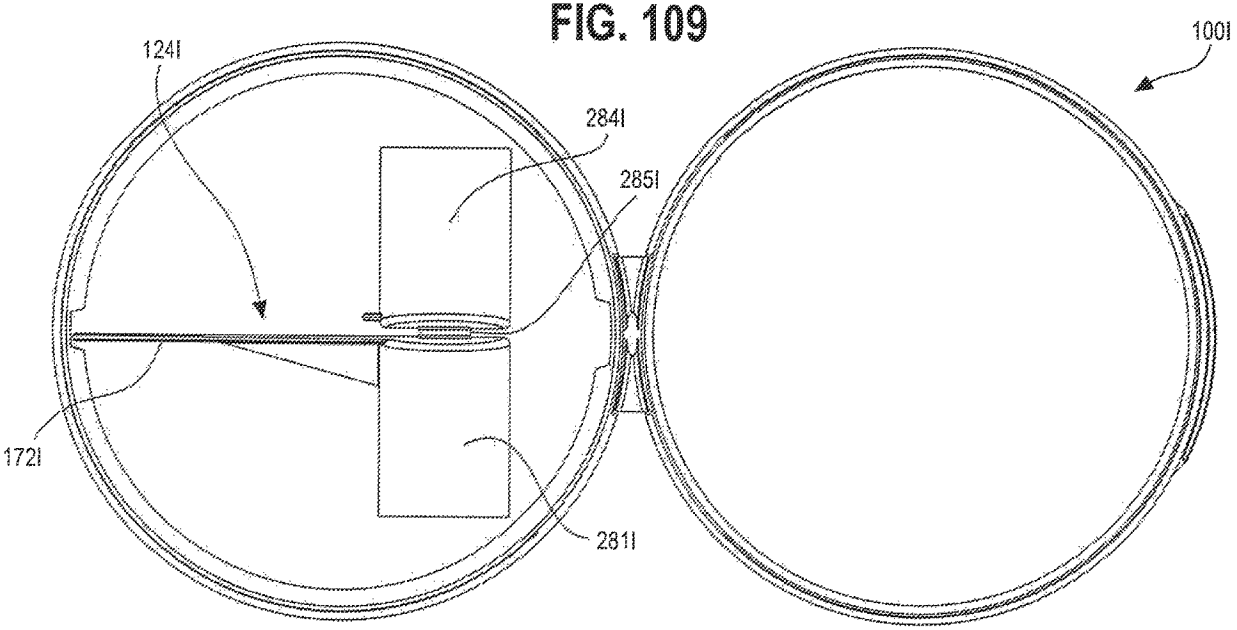
FIG. 109 is a top plan view of the closure of FIG. 108.
Figure 110:
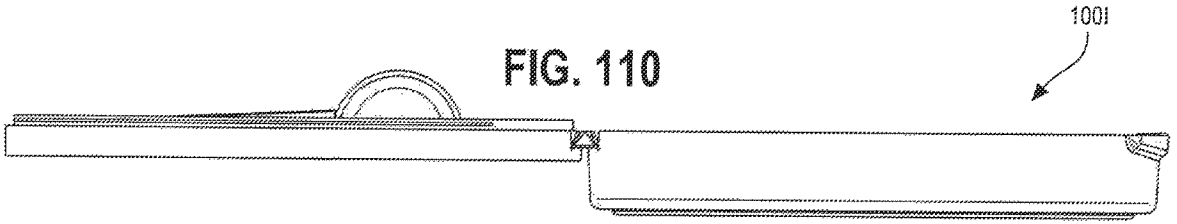
FIG. 110 is a side elevation view of the closure shown in FIG. 108.

FIGS. 108-110 illustrate another embodiment of a closure 100I to another aspect of the present invention. The closure 100I is similar to closure 100 illustrated in FIGS. 1-6 in that closure 100I includes a base 112I for being installed at an opening of a container (not illustrated) and a lid 116I hingedly connected to the base 112I. The closure 100I also includes a utensil 124I that is initially frangibly connected to the closure 100I at a handle portion 172I (FIG. 109) of the utensil 124I. The utensil handle portion 172I is configured for being grasped by a user of the utensil 124I after the utensil 124I has been separated from a remaining portion of the closure 100I. The utensil 124I has a scoop formed from a first side part 281I and a second side part 284I (FIG. 109). The first and second side parts 281I/284I are connected by a hinge 285I (FIG. 109), and are rotatable generally along an axis defined by the handle portion 172I.

FIGS. 108 and 109 show an as-molded, "storage" configuration of the utensil 124I, in which the first side part 281I and the second side part 284I are open and connected only by the hinge 285I.

Figure 111:
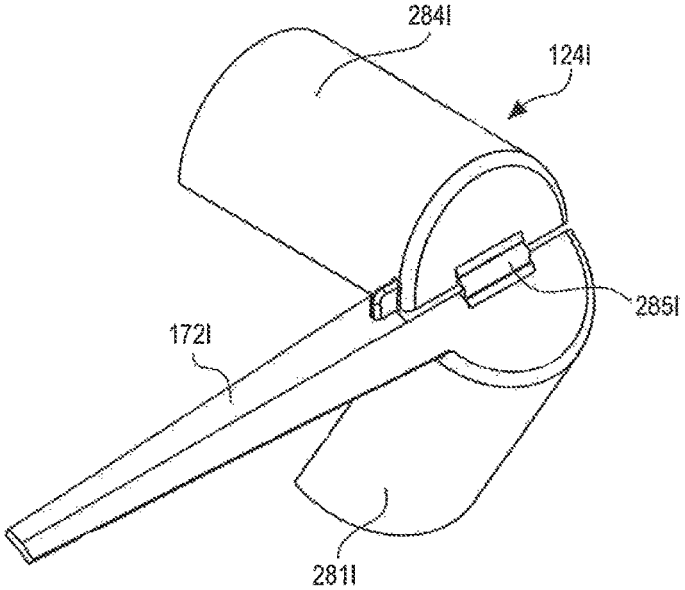
FIG. 111 is a perspective view of the just the utensil shown in FIG. 108, and in FIG. 111 the utensil has been removed from the closure and rotated toward a "use" configuration.
Figure 112:
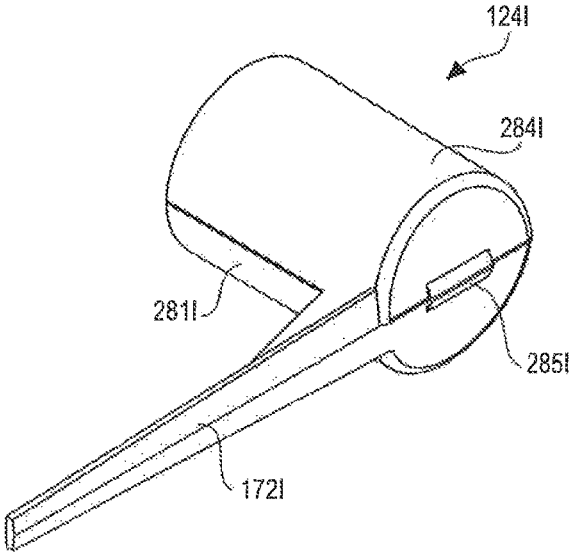
FIG. 112 is a perspective view of the just the utensil shown in FIG. 108, and in FIG. 111 the utensil has been removed from the closure and rotated into a "use" configuration.

FIGS. 111 and 112 show the movement of the utensil 124I from the "storage" configuration toward, and into, a "use" configuration wherein the first side part 281I and the second side part 284I are engaged to form a scoop.

The inventors have found that a utensil 124I with such a "storage" configuration and a "use" configuration allows the utensil 124I to have a relatively deep scoop, which can be integrally molded in the "storage" configuration with a closure 100I having an especially low profile (i.e., low height). As can be seen in FIG. 110, the "storage" configuration of the utensil 124I permits the lid 116I to have a shorter height, thus reducing the amount of material needed for manufacturing the closure 100I and also providing a more aesthetically appealing configuration.

While the illustrated utensil 124I has the form of a deep scoop, it will be understood that other types of utensils could readily be implemented in accordance with other embodiments of the invention, such as a shallower scoop, ladle, knife, fork, spear, or other structure, particularly those having an elongated handle. For example, in an embodiment featuring a fork utensil (not illustrated), the utility portion may include a plurality of fork tines, while in an embodiment featuring a knife utensil (not illustrated), the utility portion may include a cutting edge.

It will be readily apparent from the foregoing detailed description of the invention and from the illustrations thereof that numerous variations and modifications may be effected without departing from the true spirit and scope of the novel concepts or principles of this invention.

For example, it will be appreciated that one broad aspect of the invention includes a closure with the inventive feature which includes a retainer for releasably retaining a utensil and which further includes a raised platform region to accommodate a user's finger engaging a handle portion of the utensil. That feature may be considered to be a separate feature which may provide utility separately apart from other features. Thus, it is contemplated that this one broad aspect of the invention may be claimed separately without necessarily being in combination with one or more of the other features. Alternatively, this one feature may be claimed in combination with other features disclosed herein.

Furthermore, it will be appreciated that another broad aspect of the invention includes the inventive feature of a closure with a utensil retainer which has a pressable region for being engaged by a finger of the user to release the utensil. That feature may be considered to be a separate feature which may provide utility separately apart from other features. Thus, it is contemplated that this one broad aspect of the invention may be claimed separately without necessarily being in combination with one or more of the other features. Alternatively, this one feature may be claimed in combination with other features disclosed herein.

In addition, it will be appreciated that another broad aspect of the invention includes the inventive feature of a closure base which has an attachment skirt having a movable portion to accommodate initial deflection away from a flange of a container or other system during installation of the closure on a system. The movable portion subsequently moves toward and under the system flange to prevent the closure from being removed from the system. That feature may be considered to be a separate feature which may provide utility separately apart from other features. Thus, it is contemplated that this one broad aspect of the invention may be claimed separately without necessarily being in combination with one or more of the other features. Alternatively, this one feature may be claimed in combination with other features disclosed herein.

Furthermore, it will be appreciated that another broad aspect of the invention includes the inventive feature of a utensil having a handle portion and a utility portion, a "stored" configuration where the handle portion is located adjacent the utility portion, and a "use" or "deployed" configuration where the handle portion is connected to the utility portion to extend away from the handle portion. That feature may be considered to be a separate feature which may provide utility separately apart from other features. Thus, it is contemplated that this one broad aspect of the invention may be claimed separately without necessarily being in combination with one or more of the other features. Alternatively, this one feature may be claimed in combination with other features disclosed herein.

Additionally, it will be appreciated that another broad aspect of the invention includes the inventive feature of a closure having a flexible, resilient seal that has an extending flexible platform defining an aperture for retaining a portion of the utensil. That feature may be considered to be a separate feature which may provide utility separately apart from other features. Thus, it is contemplated that this one broad aspect of the invention may be claimed separately without necessarily being in combination with one or more of the other features. Alternatively, this one feature may be claimed in combination with other features disclosed herein.

In addition, it will be appreciated that another broad aspect of the invention includes the inventive feature of a closure having a base, a lid, a latch member, and a flexible, resilient seal for being compressed between a portion of the lid and the base when the latch member is in a latched position so as to increase the opening resistance of the latch system. That feature may be considered to be a separate feature which may provide utility separately apart from other features. Thus, it is contemplated that this one broad aspect of the invention may be claimed separately without necessarily being in combination with one or more of the other features. Alternatively, this one feature may be claimed in combination with other features disclosed herein.

Furthermore, it will be appreciated that another broad aspect of the invention includes the inventive feature of a utensil having a handle portion and a scoop portion wherein the scoop portion includes a plurality of parts, and wherein the plurality of parts accommodate arrangement in (1) a "use" configuration where two parts of the utensil scoop portion are confronting, and (2) a "storage" configuration where two parts are moved away from the "use" configuration. That feature may be considered to be a separate feature which may provide utility separately apart from other features. Thus, it is contemplated that this one broad aspect of the invention may be claimed separately without necessarily being in combination with one or more of the other features. Alternatively, this one feature may be claimed in combination with other features disclosed herein.

What is claimed is:

1. A closure for (1) a system having an opening to the interior of the system wherein contents may be stored, and (2) retaining a utensil having a handle portion of predetermined length, said closure comprising:

(A) a base for being located at the system opening, said base having an access passage through said base for permitting access to the system interior; and (B) a lid that is movable between a closed position for occluding said access passage and an open position to expose said access passage, wherein one of said lid and base has an interior surface that (a) is exposed to a user when said lid is in said open position, and (b) said interior surface includes i. a raised platform region, ii. a recessed region that is recessed relative to said raised platform region, and iii. a retainer on said raised platform region for releasably retaining the utensil so as to locate part of the length of the utensil handle portion spaced away from said recessed region beyond said raised platform region to accommodate a user's finger engaging the utensil handle portion located beyond said raised platform region to facilitate the user grasping the utensil handle portion; and wherein said retainer having at least a first wall that i. projects from said interior surface, ii. defines an engaging surface for engaging the utensil when the utensil is retained in said retainer, iii. is deflectable to accommodate receipt and release of the utensil, and iv. defines a pressable region at a location that is further from said interior surface than is said engaging surface whereby said pressable region can be pressed by a user's finger to deflect said first wall to accommodate release of the utensil.

2. The closure in accordance with claim 1 in which said retainer also includes a second wall that is spaced from said first wall and that can engage the utensil.

* * * * *